US006603454B1

(12) United States Patent
Nakamura et al.

(10) Patent No.: US 6,603,454 B1
(45) Date of Patent: Aug. 5, 2003

(54) DISPLAY PANEL HAVING PIXELS ARRANGED IN MATRIX

(75) Inventors: Koji Nakamura, Tokai (JP); Yoshihiro Tsubaki, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/512,421

(22) Filed: Feb. 23, 2000

(30) Foreign Application Priority Data

Feb. 24, 1999 (JP) ..... 11-046884
Jan. 11, 2000 (JP) ..... 2000-006180

(51) Int. Cl.[7] ..... G09G 3/36

(52) U.S. Cl. ..... 345/97; 345/87; 345/88; 345/90; 345/92; 345/95; 345/96; 345/98; 345/100; 345/103; 345/694; 345/695; 345/696

(58) Field of Search ..... 345/95, 97, 98, 345/100, 103, 87, 88, 90, 92, 96, 694, 695, 696

(56) References Cited

U.S. PATENT DOCUMENTS 5,182,549 A 1/1993 Taniguchi et al.
5,488,388 A 1/1996 Taniguchi et al.
5,719,651 A * 2/1998 Okada et al. ..... 349/85
6,326,981 B1 * 12/2001 Mori et al. ..... 345/695

FOREIGN PATENT DOCUMENTS

| | | |
|---|---|---|
| EP | 193728 | 8/1992 |
| JP | 5-119746 | 5/1993 |
| JP | 7-20441 | 1/1995 |
| JP | 8-328039 | 12/1996 |
| JP | 9-68728 | 3/1997 |

* cited by examiner

*Primary Examiner*—Richard Hjerpe
*Assistant Examiner*—Jean Lesperance
(74) *Attorney, Agent, or Firm*—Posz & Bethards, PLC

(57) ABSTRACT

A matrix-display panel such as a liquid crystal display panel is composed of row and column electrodes and liquid crystal interposed between both row and column electrodes. Pixels formed at each intersection of the electrodes are driven by imposing composite voltages consisting of scanning voltages supplied to the row electrodes and image data voltages supplied to the column electrodes. Pixels aligned along one row electrode are alternately connected to two or three neighboring row electrodes in a zigzag manner, and an interlaced scanning is performed by jumping one or two row electrodes at a time, thereby reducing a flicker frequency to an invisible level and making a line-scroll invisible. The pixels may be driven by switching a transistor connected to each pixel.

2 Claims, 67 Drawing Sheets

LINE MEMORY R2, G2, B2 READ, WRITE
AD3
CL4
EN
SCK
DP
t
D1,1 D2,0 D3,1 D4,0 ...
D1277,1 D1278,0 D1278,1 D1279,0 D1279,1 D1280,0
D1277 D1278 D1279 D1280
1 2 3 4 ...
W
R

LINE MEMORY R2, G2, B2 READ, WRITE
AD3
CL4
EN
SCK
DP
t
D1,1 D2,0 D3,1 D4,0 ...
D1,3 D2,2 D3,3 D4,2 ...
D1277,1 D1278,0 D1278,1 D1279,0 D1279,1 D1280,0
D1277,3 D1278,2 D1278,3 D1279,2 D1279,3 D1280,2
D1277 D1278 D1279 D1280
1 2 3 4 ...
R
W

FIG. 10

| H \ V | 1 | 2 | 3 | 4 | 5 | 6 | 7 | | 1277 | 1278 | 1279 | 1280 |
|---|---|---|---|---|---|---|---|---|---|---|---|---|
| 0 | $D_{1,0}$ | $D_{2,0}$ | $D_{3,0}$ | $D_{4,0}$ | $D_{5,0}$ | $D_{6,0}$ | $D_{7,0}$ | | $D_{1277,0}$ | $D_{1278,0}$ | $D_{1279,0}$ | $D_{1280,0}$ |
| 1 | $D_{1,1}$ | $D_{2,1}$ | $D_{3,1}$ | $D_{4,1}$ | $D_{5,1}$ | $D_{6,1}$ | $D_{7,1}$ | | $D_{1277,1}$ | $D_{1278,1}$ | $D_{1279,1}$ | $D_{1280,1}$ |
| 2 | $D_{1,2}$ | $D_{2,2}$ | $D_{3,2}$ | $D_{4,2}$ | $D_{5,2}$ | $D_{6,2}$ | $D_{7,2}$ | | $D_{1277,2}$ | $D_{1278,2}$ | $D_{1279,2}$ | $D_{1280,2}$ |
| 3 | $D_{1,3}$ | $D_{2,3}$ | $D_{3,3}$ | $D_{4,3}$ | $D_{5,3}$ | $D_{6,3}$ | $D_{7,3}$ | | $D_{1277,3}$ | $D_{1278,3}$ | $D_{1279,3}$ | $D_{1280,3}$ |
| 4 | $D_{1,4}$ | $D_{2,4}$ | $D_{3,4}$ | $D_{4,4}$ | $D_{5,4}$ | $D_{6,4}$ | $D_{7,4}$ | | $D_{1277,4}$ | $D_{1278,4}$ | $D_{1279,4}$ | $D_{1280,4}$ |
| 1024 | $D_{1,1024}$ | $D_{2,1024}$ | $D_{3,1024}$ | $D_{4,1024}$ | $D_{5,1024}$ | $D_{6,1024}$ | $D_{7,1024}$ | | $D_{1277,1024}$ | $D_{1278,1024}$ | $D_{1279,1024}$ | $D_{1280,1024}$ |
| 1025 | $D_{1,1025}$ | $D_{2,1025}$ | $D_{3,1025}$ | $D_{4,1025}$ | $D_{5,1025}$ | $D_{6,1025}$ | $D_{7,1025}$ | | $D_{1277,1025}$ | $D_{1278,1025}$ | $D_{1279,1025}$ | $D_{1280,1025}$ |

FIG. 11

| | | | | | | | | | | | | |
|---|---|---|---|---|---|---|---|---|---|---|---|---|
| 1H | X | 1 | 2 | 3 | 4 | 5 | 6 | 7 | 1277 | 1278 | 1279 | 1280 |
| | $Y_1$ | $D_{1,1}$ | $D_{2,0}$ | $D_{3,1}$ | $D_{4,0}$ | $D_{5,1}$ | $D_{6,0}$ | $D_{7,1}$ | $D_{1277,1}$ | $D_{1278,0}$ | $D_{1279,1}$ | $D_{1280,0}$ |
| 514H | X | 1 | 2 | 3 | 4 | 5 | 6 | 7 | 1277 | 1278 | 1279 | 1280 |
| | $Y_2$ | $D_{1,2}$ | $D_{2,1}$ | $D_{3,2}$ | $D_{4,1}$ | $D_{5,2}$ | $D_{6,1}$ | $D_{7,2}$ | $D_{1277,2}$ | $D_{1278,1}$ | $D_{1279,2}$ | $D_{1280,1}$ |
| 2H | X | 1 | 2 | 3 | 4 | 5 | 6 | 7 | 1277 | 1278 | 1279 | 1280 |
| | $Y_3$ | $D_{1,3}$ | $D_{2,2}$ | $D_{3,3}$ | $D_{4,2}$ | $D_{5,3}$ | $D_{6,2}$ | $D_{7,3}$ | $D_{1277,3}$ | $D_{1278,2}$ | $D_{1279,3}$ | $D_{1280,2}$ |
| 515H | X | 1 | 2 | 3 | 4 | 5 | 6 | 7 | 1277 | 1278 | 1279 | 1280 |
| | $Y_4$ | $D_{1,4}$ | $D_{2,3}$ | $D_{3,4}$ | $D_{4,3}$ | $D_{5,4}$ | $D_{6,3}$ | $D_{7,4}$ | $D_{1277,4}$ | $D_{1278,3}$ | $D_{1279,4}$ | $D_{1280,3}$ |
| 1025H | X | 1 | 2 | 3 | 4 | 5 | 6 | 7 | 1277 | 1278 | 1279 | 1280 |
| | $Y_{1024}$ | $D_{1,1024}$ | $D_{2,1023}$ | $D_{3,1024}$ | $D_{4,1023}$ | $D_{5,1024}$ | $D_{6,1023}$ | $D_{7,1024}$ | $D_{1277,1024}$ | $D_{1278,1023}$ | $D_{1279,1024}$ | $D_{1280,1023}$ |
| 513H | X | 1 | 2 | 3 | 4 | 5 | 6 | 7 | 1277 | 1278 | 1279 | 1280 |
| | $Y_{1025}$ | $D_{1,1025}$ | $D_{2,1024}$ | $D_{3,1025}$ | $D_{4,1024}$ | $D_{5,1025}$ | $D_{6,1024}$ | $D_{7,1025}$ | $D_{1277,1025}$ | $D_{1278,1024}$ | $D_{1279,1025}$ | $D_{1280,1024}$ |

FIG. 25

| H \ V | 1 | 2 | 3 | 4 | 5 | 6 | 7 | | 1277 | 1278 | 1279 | 1280 |
|---|---|---|---|---|---|---|---|---|---|---|---|---|
| 0 | $D_{1,0}$ | $D_{2,0}$ | $D_{3,0}$ | $D_{4,0}$ | $D_{5,0}$ | $D_{6,0}$ | $D_{7,0}$ | | $D_{1277,0}$ | $D_{1278,0}$ | $D_{1279,0}$ | $D_{1280,0}$ |
| 1 | $D_{1,1}$ | $D_{2,1}$ | $D_{3,1}$ | $D_{4,1}$ | $D_{5,1}$ | $D_{6,1}$ | $D_{7,1}$ | | $D_{1277,1}$ | $D_{1278,1}$ | $D_{1279,1}$ | $D_{1280,1}$ |
| 2 | $D_{1,2}$ | $D_{2,2}$ | $D_{3,2}$ | $D_{4,2}$ | $D_{5,2}$ | $D_{6,2}$ | $D_{7,2}$ | | $D_{1277,2}$ | $D_{1278,2}$ | $D_{1279,2}$ | $D_{1280,2}$ |
| 3 | $D_{1,3}$ | $D_{2,3}$ | $D_{3,3}$ | $D_{4,3}$ | $D_{5,3}$ | $D_{6,3}$ | $D_{7,3}$ | | $D_{1277,3}$ | $D_{1278,3}$ | $D_{1279,3}$ | $D_{1280,3}$ |
| 4 | $D_{1,4}$ | $D_{2,4}$ | $D_{3,4}$ | $D_{4,4}$ | $D_{5,4}$ | $D_{6,4}$ | $D_{7,4}$ | | $D_{1277,4}$ | $D_{1278,4}$ | $D_{1279,4}$ | $D_{1280,4}$ |
| 1024 | $D_{1,1024}$ | $D_{2,1024}$ | $D_{3,1024}$ | $D_{4,1024}$ | $D_{5,1024}$ | $D_{6,1024}$ | $D_{7,1024}$ | | $D_{1277,1024}$ | $D_{1278,1024}$ | $D_{1279,1024}$ | $D_{1280,1024}$ |
| 1025 | $D_{1,1025}$ | $D_{2,1025}$ | $D_{3,1025}$ | $D_{4,1025}$ | $D_{5,1025}$ | $D_{6,1025}$ | $D_{7,1025}$ | | $D_{1277,1025}$ | $D_{1278,1025}$ | $D_{1279,1025}$ | $D_{1280,1025}$ |

FIG. 26

| | | | | | | | | | | | | |
|---|---|---|---|---|---|---|---|---|---|---|---|---|
| 1H | X | 1 | 2 | 3 | 4 | 5 | 6 | 7 | 1277 | 1278 | 1279 | 1280 |
| | $Y_1$ | $D_{1,0}$ | $D_{2,0}$ | $D_{3,1}$ | $D_{4,0}$ | $D_{5,0}$ | $D_{6,0}$ | $D_{7,1}$ | $D_{1277,0}$ | $D_{1278,0}$ | $D_{1279,0}$ | $D_{1280,1}$ |
| 343H | X | 1 | 2 | 3 | 4 | 5 | 6 | 7 | 1277 | 1278 | 1279 | 1280 |
| | $Y_2$ | $D_{1,0}$ | $D_{2,1}$ | $D_{3,2}$ | $D_{4,1}$ | $D_{5,0}$ | $D_{6,1}$ | $D_{7,2}$ | $D_{1277,1}$ | $D_{1278,0}$ | $D_{1279,1}$ | $D_{1280,2}$ |
| 685H | X | 1 | 2 | 3 | 4 | 5 | 6 | 7 | 1277 | 1278 | 1279 | 1280 |
| | $Y_3$ | $D_{1,1}$ | $D_{2,2}$ | $D_{3,3}$ | $D_{4,2}$ | $D_{5,1}$ | $D_{6,2}$ | $D_{7,3}$ | $D_{1277,2}$ | $D_{1278,1}$ | $D_{1279,2}$ | $D_{1280,3}$ |
| 2H | X | 1 | 2 | 3 | 4 | 5 | 6 | 7 | 1277 | 1278 | 1279 | 1280 |
| | $Y_4$ | $D_{1,2}$ | $D_{2,3}$ | $D_{3,4}$ | $D_{4,3}$ | $D_{5,2}$ | $D_{6,3}$ | $D_{7,4}$ | $D_{1277,3}$ | $D_{1278,2}$ | $D_{1279,3}$ | $D_{1280,4}$ |
| 342H | X | 1 | 2 | 3 | 4 | 5 | 6 | 7 | 1277 | 1278 | 1279 | 1280 |
| | $Y_{1024}$ | $D_{1,1022}$ | $D_{2,1023}$ | $D_{3,1024}$ | $D_{4,1023}$ | $D_{5,1022}$ | $D_{6,1023}$ | $D_{7,1024}$ | $D_{1277,1023}$ | $D_{1278,1022}$ | $D_{1273,1023}$ | $D_{1280,1024}$ |
| 684H | X | 1 | 2 | 3 | 4 | 5 | 6 | 7 | 1277 | 1278 | 1279 | 1280 |
| | $Y_{1025}$ | $D_{1,1023}$ | $D_{2,1024}$ | $D_{3,1025}$ | $D_{4,1024}$ | $D_{5,1023}$ | $D_{6,1024}$ | $D_{7,1025}$ | $D_{1277,1024}$ | $D_{1278,1023}$ | $D_{1273,1024}$ | $D_{1280,1025}$ |
| 1026H | X | 1 | 2 | 3 | 4 | 5 | 6 | 7 | 1277 | 1278 | 1279 | 1280 |
| | $Y_{1026}$ | $D_{1,1024}$ | $D_{2,1025}$ | $D_{3,1025}$ | $D_{4,1025}$ | $D_{5,1024}$ | $D_{6,1025}$ | $D_{7,1025}$ | $D_{1277,1025}$ | $D_{1278,1024}$ | $D_{1273,1025}$ | $D_{1280,1025}$ |

[SEQUENTIAL SCANNING]

[INTERLACED SCANNING (2ELECTRODES JUMPED)]

LINE MEMORY R2, G2, B2 READ, WRITE
AD3
CL4
EN
SCK
DP
D1278,0 D1280,0
D1277,0 D1279,0
D1278,0 D1280,1
D1277,0 D1279,0
t

LINE MEMORY R2, G2, B2 READ, WRITE
AD3
CL4
EN
SCK
DP
D1278,0 D1280,0
D1277,0 D1279,0
D1278,0 D1280,1
D1277,0 D1279,0
D1278,2 D1280,1
D1277,0 D1279,0
t

FIG. 38

| H \ V | 1 | 2 | 3 | 4 | 5 | 6 | 7 | | 1277 | 1278 | 1279 | 1280 |
|---|---|---|---|---|---|---|---|---|---|---|---|---|
| 0 | $D_{1,0}$ | $D_{2,0}$ | $D_{3,0}$ | $D_{4,0}$ | $D_{5,0}$ | $D_{6,0}$ | $D_{7,0}$ | | $D_{1277,0}$ | $D_{1278,0}$ | $D_{1279,0}$ | $D_{1280,0}$ |
| 1 | $D_{1,1}$ | $D_{2,1}$ | $D_{3,1}$ | $D_{4,1}$ | $D_{5,1}$ | $D_{6,1}$ | $D_{7,1}$ | | $D_{1277,1}$ | $D_{1278,1}$ | $D_{1279,1}$ | $D_{1280,1}$ |
| 2 | $D_{1,2}$ | $D_{2,2}$ | $D_{3,2}$ | $D_{4,2}$ | $D_{5,2}$ | $D_{6,2}$ | $D_{7,2}$ | | $D_{1277,2}$ | $D_{1278,2}$ | $D_{1279,2}$ | $D_{1280,2}$ |
| 3 | $D_{1,3}$ | $D_{2,3}$ | $D_{3,3}$ | $D_{4,3}$ | $D_{5,3}$ | $D_{6,3}$ | $D_{7,3}$ | | $D_{1277,3}$ | $D_{1278,3}$ | $D_{1279,3}$ | $D_{1280,3}$ |
| 4 | $D_{1,4}$ | $D_{2,4}$ | $D_{3,4}$ | $D_{4,4}$ | $D_{5,4}$ | $D_{6,4}$ | $D_{7,4}$ | | $D_{1277,4}$ | $D_{1278,4}$ | $D_{1279,4}$ | $D_{1280,4}$ |
| 1024 | $D_{1,1024}$ | $D_{2,1024}$ | $D_{3,1024}$ | $D_{4,1024}$ | $D_{5,1024}$ | $D_{6,1024}$ | $D_{7,1024}$ | | $D_{1277,1024}$ | $D_{1278,1024}$ | $D_{1279,1024}$ | $D_{1280,1024}$ |
| 1025 | $D_{1,1025}$ | $D_{2,1025}$ | $D_{3,1025}$ | $D_{4,1025}$ | $D_{5,1025}$ | $D_{6,1025}$ | $D_{7,1025}$ | | $D_{1277,1025}$ | $D_{1278,1025}$ | $D_{1279,1025}$ | $D_{1280,1025}$ |

FIG. 39

| | | | | | | | | | | | |
|---|---|---|---|---|---|---|---|---|---|---|---|
| 1H | X | 1 | 2 | 3 | 4 | 5 | 6 | 7 | 1277 | 1278 | 1279 | 1280 |
| | $Y_1$ | $D_{1,1}$ | $D_{2,0}$ | $D_{3,1}$ | $D_{4,0}$ | $D_{5,1}$ | $D_{6,0}$ | $D_{7,1}$ | $D_{1277,1}$ | $D_{1278,0}$ | $D_{1279,1}$ | $D_{1280,0}$ |
| 2H | X | 1 | 2 | 3 | 4 | 5 | 6 | 7 | 1277 | 1278 | 1279 | 1280 |
| | $Y_2$ | $D_{1,2}$ | $D_{2,1}$ | $D_{3,2}$ | $D_{4,1}$ | $D_{5,2}$ | $D_{6,1}$ | $D_{7,2}$ | $D_{1277,2}$ | $D_{1278,1}$ | $D_{1279,2}$ | $D_{1280,1}$ |
| 3H | X | 1 | 2 | 3 | 4 | 5 | 6 | 7 | 1277 | 1278 | 1279 | 1280 |
| | $Y_3$ | $D_{1,3}$ | $D_{2,2}$ | $D_{3,3}$ | $D_{4,2}$ | $D_{5,3}$ | $D_{6,2}$ | $D_{7,3}$ | $D_{1277,3}$ | $D_{1278,2}$ | $D_{1279,3}$ | $D_{1280,2}$ |
| 4H | X | 1 | 2 | 3 | 4 | 5 | 6 | 7 | 1277 | 1278 | 1279 | 1280 |
| | $Y_4$ | $D_{1,4}$ | $D_{2,3}$ | $D_{3,4}$ | $D_{4,3}$ | $D_{5,4}$ | $D_{6,3}$ | $D_{7,4}$ | $D_{1277,4}$ | $D_{1278,3}$ | $D_{1279,4}$ | $D_{1280,3}$ |
| 1024H | X | 1 | 2 | 3 | 4 | 5 | 6 | 7 | 1277 | 1278 | 1279 | 1280 |
| | $Y_{1024}$ | $D_{1,1024}$ | $D_{2,1023}$ | $D_{3,1024}$ | $D_{4,1023}$ | $D_{5,1024}$ | $D_{6,1023}$ | $D_{7,1024}$ | $D_{1277,1024}$ | $D_{1278,1023}$ | $D_{1279,1024}$ | $D_{1280,1023}$ |
| 1025H | X | 1 | 2 | 3 | 4 | 5 | 6 | 7 | 1277 | 1278 | 1279 | 1280 |
| | $Y_{1025}$ | $D_{1,1025}$ | $D_{2,1024}$ | $D_{3,1025}$ | $D_{4,1024}$ | $D_{5,1025}$ | $D_{6,1024}$ | $D_{7,1025}$ | $D_{1277,1025}$ | $D_{1278,1024}$ | $D_{1279,1025}$ | $D_{1280,1024}$ |

FRAME MEMORY R1,G1,B1 READ
AD2
CL3
REN
D1,1
D2,0
D3,1
D4,0
D1277,1
D1278,0
D1279,1
D1280,0
1277
1278
1279
1280
t

FRAME MEMORY R1,G1,B1 READ
AD2
CL3
REN
D1,2
D2,1
D3,2
D4,1
D1277,2
D1278,1
D1279,2
D1280,1
1277
1278
1279
1280
t

LINE MEMORY R2, G2, B2 READ, WRITE
AD3
CL4
EN
SCK
DP
t

LINE MEMORY R2, G2, B2 READ, WRITE
AD3
CL4
EN
SCK
DP
t

V.
Vg
GATE LINE
Y2n-1
t1
1FRAME (t1x2050)
t2

V.
Vg
GATE LINE
Y2n

V.
Vw
VE
-Vw
SOURCE LINE
X2m-1

V.
Vw
VE
-Vw
SOURCE LINE
X2m

V.
Vw
VE
-Vw
PIXEL
G2m-1, 2n-1

V.
Vw
VE
-Vw
PIXEL
G2m, 2n-1

B.
PIXEL
G2m-1, 2n-1

B.
PIXEL
G2m, 2n-1
t

GATE LINE Yn-2
V.
Vg
t1
1FRAME (t1x2052)
t1x100

GATE LINE Yn-1
V.
Vg

GATE LINE Yn
V.
Vg

SOURCE LINE X3m-2
V.
Vw
VE
-Vw

SOURCE LINE X3m-1
V.
Vw
VE
-Vw

SOURCE LINE X3m
V.
Vw
VE
-Vw
t

V.
Vw
VE
-Vw
PIXEL
G3m-2, n

V.
Vw
VE
-Vw
PIXEL
G3m-1, n

V.
Vw
VE
-Vw
PIXEL
G3m, n

B.
PIXEL
G3m-2, n

B.
PIXEL
G3m-1, n

B.
PIXEL
G3m, n
t

DISPLAY PANEL HAVING PIXELS ARRANGED IN MATRIX

CROSS-REFERENCE TO RELATED APPLICATIONS

This application is based upon and claims benefit of priority of Japanese Patent Applications No. Hei-11-46884 filed on Feb. 24, 1999 and No. Hei-12-6180 filed on Jan. 11, 2000, the contents of which are incorporated herein by reference.

BACKGROUND OF THE INVENTION

1. Field of the Invention

The present invention relates to a matrix-type display panel such as a liquid crystal display panel and to a display device that includes a display panel and apparatus to drive the panel.

2. Description of Related Art

A display panel having pixels arranged in a matrix and scanning electrode stripes and data electrode stripes which run perpendicularly to the scanning electrode stripes is generally known. Scanning voltages are usually given to the scanning electrodes sequentially, for example, from the top of the panel toward the bottom.

It is also known to perform interlaced scanning by jumping a certain number of scanning electrodes to reduce flicker on the displayed image. In the sequential scanning, a scanning interval between one electrode and an electrode next scanned is Tv/n, where Tv is a time required to scan all the scanning electrodes and n is the number of scanning electrodes. In the interlaced scanning performed by jumping p electrodes, the scanning interval is Tv/(p+1). This means that the scanning moves quicker from the top to the bottom, and a viewer of the display feels as if the scanning frequency increased by (p+1) times. In this manner, flicker on the displayed image can be decreased to a certain level. However, if a space in which the (p+1) electrodes are included is large enough to be seen by a viewer, and if the scanning frequency is not sufficiently high, a phenomenon called a line scroll appears on the display. The line scroll which is detrimental to display quality is such a phenomenon that horizontal stripes move upward or downward on the display.

SUMMARY OF THE INVENTION

The present invention has been made in view of the above-mentioned problem, and an object of the present invention is to provide an improved matrix-display panel and its driving device in which the flicker and the line-scroll are suppressed and made invisible.

The matrix-display panel is composed of row electrodes Yj, column electrodes Xi running perpendicularly to the row electrodes, and an electro-optical material such as antiferroelectric liquid crystal interposed between both electrodes. Pixels G(i,j) arranged in a matrix are formed at each intersection of both electrodes Yj an d Xi. One display line is constituted by the pixels G(i,j) aligned in line along a row electrode Yj. Scanning voltages are supplied to the row electrodes from a scanning electrode driving circuit, while image data signal voltages are supplied to the column electrodes from a data electrode driving circuit in synchronism with the scanning voltages. The scanning voltages are combined with the data signal voltages, and the combined voltages are imposed on the pixels.

The pixels G(i,j) aligned in line along a row electrode Yj are connected alternatively to Yj and the next row electrode Y(j+1) in a zigzag manner. The row electrodes are scanned in an interlaced manner by jumping one electrode, i.e., in the order of Y1, Y3, Y5 . . . Yn. In this manner, a flicker frequency becomes two times of the driving frequency, or a frame frequency. For example, when the panel is driven by 30 Hz, the flicker frequency becomes 60 Hz which is invisible. The line-scroll is also made invisible at the same time.

Alternatively, the pixels G(i,j) aligned in line along the row electrode Yj are connected to three row electrodes Yj, Y(j+1) and Y(j+2), i.e., connecting a pixel G(i,j) to Yj, a pixel G(i+1,j) to Y(j+1), and a pixel G(i+2,j) to Y(j+2). The following pixels are connected to the same three row electrodes in a reversed order, making a zigzag connection as a whole. In this case, the interlaced scanning is performed by jumping two row electrodes every time. In this manner, the flicker frequency becomes three times of the frame frequency, e.g., when the frame frequency is 20 Hz, the flicker frequency becomes 60 Hz which is invisible to a viewer. At the same time, the line-scroll becomes invisible.

The pixels G(i,j) may be replaced with pixels that are switched by a transistor connected to each pixel. In this case, gate electrodes of transistors connected to the pixels aligned in line along the row electrode Yj are alternately connected to neighboring two electrodes Yj and Y(j+1), and the interlaced scanning is performed by jumping one row electrode. Alternatively, the pixels aligned in line along the row electrode Yj are connected to three neighboring electrodes Yj, Y(j+1) and Y(j+2) in a zigzag manner, and the interlaced scanning is performed by jumping two row electrodes every time. The flicker frequency becomes two times or three times of the frame frequency according to the respective arrangements.

Each pixel may be divided into two sub pixels or three pixels each corresponding to respective colors red, green and blue, and neighboring pixels may be driven by alternating polarities, thereby further reducing the flicker on the displayed images.

Other objects and features of the present invention will become more readily apparent from a better understanding of the preferred embodiments described below with reference to the following drawings.

BRIEF DESCRIPTION OF THE DRAWINGS

FIG. 10 is a chart showing data to be written in the frame memory circuit;

FIG. 11 is a chart showing data to be written in line memories of an image data signal conversion circuit;

FIG. 25 is a chart showing data to be written in a frame memory circuit;

FIG. 26 is a chart showing data to be written in line memories of an image data conversion circuit;

FIG. 38 is a chart showing data to be written in a frame memory;

FIG. 39 is a chart showing data to be written in line memories of an image data conversion circuit;

DETAILED DESCRIPTION OF THE PREFERRED EMBODIMENTS

First Embodiment

Figure 1:
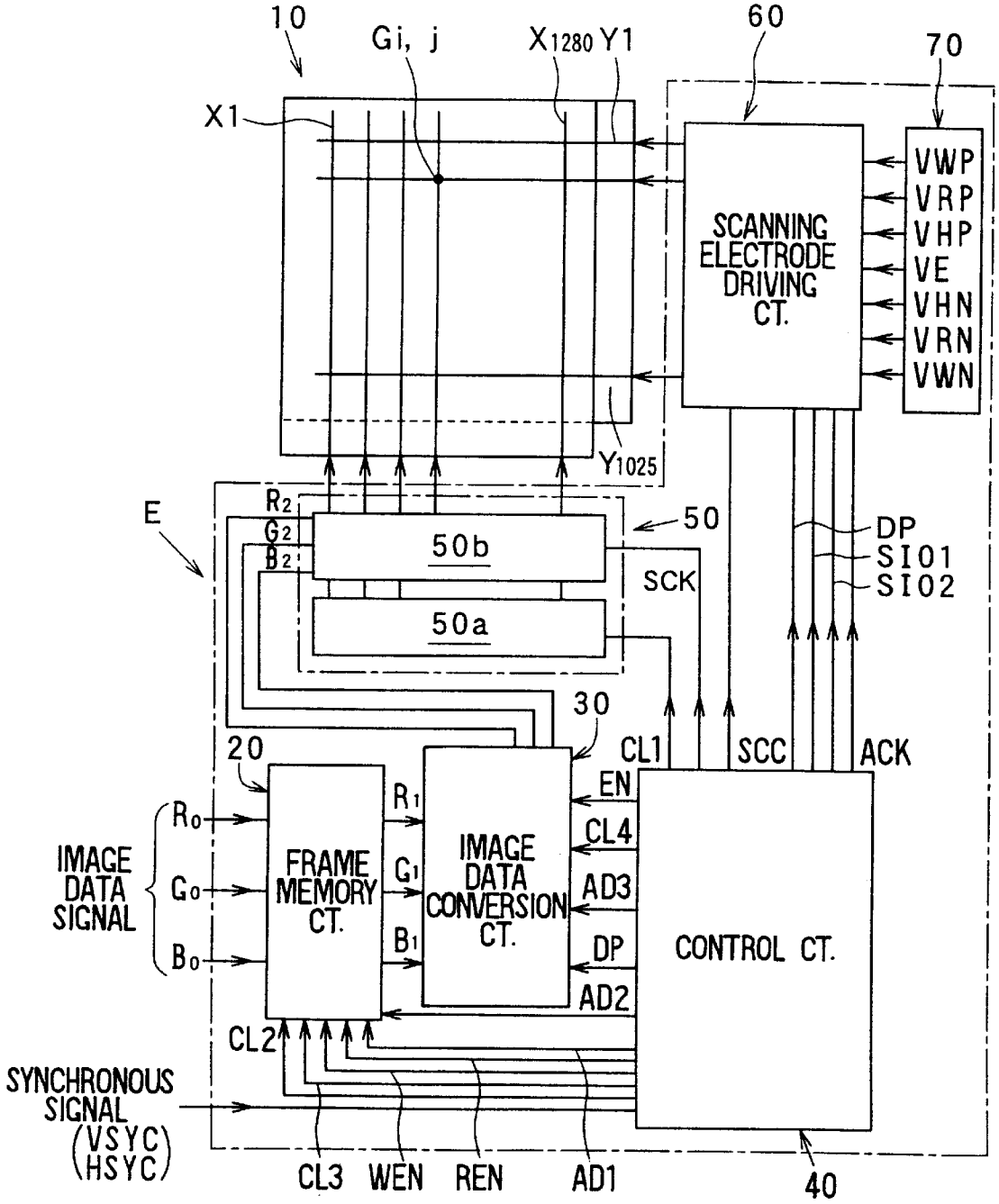
FIG. 1 is a block diagram showing a matrix-display device as a first embodiment of the present invention, details of which are shown in the following drawings, FIGS. 2–19.

A first embodiment of the present invention will be described in reference to FIGS. 1–19. As shown in FIG. 1, a liquid crystal matrix-display device is composed of a liquid crystal display panel 10 and a driver device E. The driver device E includes a frame memory circuit 20, an image data conversion circuit 30, a control circuit 40, a data electrode driving circuit 50, a scanning electrode driving circuit 60, and a power source circuit 70, all of which are interconnected as shown in FIG. 1. Details of those components will be described in reference to respective drawings.

Figure 2:
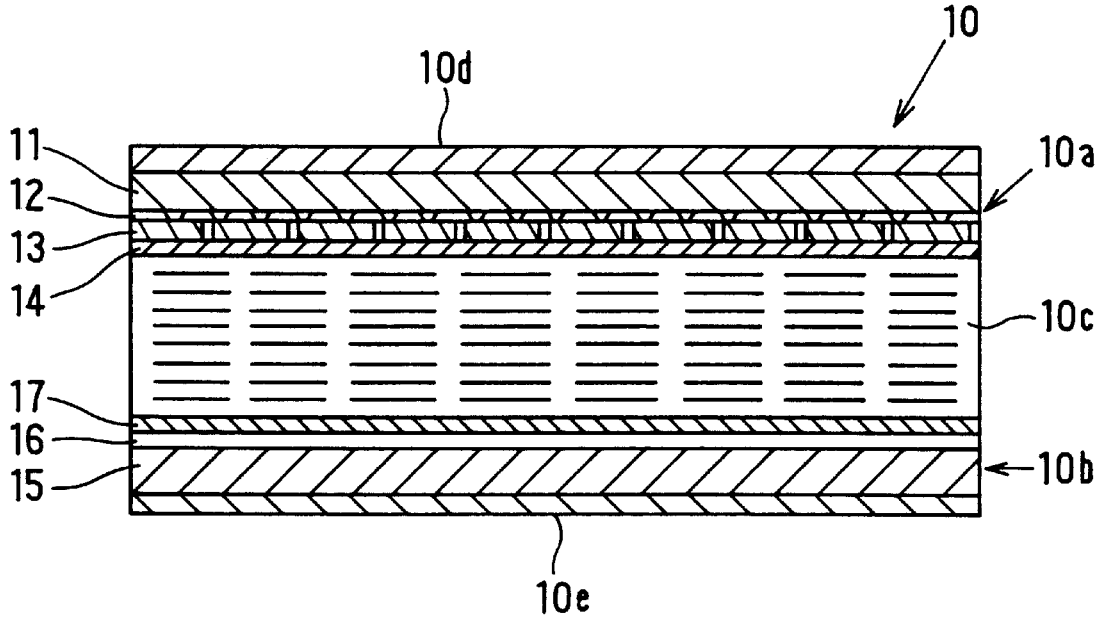
FIG. 2 is a cross-sectional view showing a liquid crystal display panel.

FIG. 2 shows a cross-sectional view of the display panel 10. The display panel 10 is composed of a first electrode substrate 10*a*, a second electrode substrate 10*b*, antiferroelectric liquid crystal 10*c* filling the space between both substrates, and polarizer layers 10*d* and 10*e* disposed outside of both substrates 10*a* and 10*b*. The first electrode substrate 10*a* includes a glass substrate 11, a color filter layer 12 having m color filter stripes, a transparent electrode layer 13 having m electrode stripes, an orientation layer 14, all of which are laminated in this order form the top in FIG. 2. The second electrode substrate 10*b* includes a glass substrate 15, a transparent electrode layer 16 having n electrode stripes and an orientation layer 17, all of which are laminated in this order from the bottom. The color filter layer 12 is composed of three layers, i.e., red, green and blue color filter layers (referred to as R, G and B color filters).

The transparent electrode layer 13 corresponds to m data electrodes Xm shown in FIG. 1, and the transparent electrode layer 16 corresponds to n scanning electrodes Yn. In this particular embodiment, the number of the data electrodes is 1280 and that of the scanning electrodes is 1025 as shown in FIG. 1. The scanning electrodes are sometimes referred to as row electrodes and the data electrodes as column electrodes. Each data electrode Xm is composed of three stripes so that each strip corresponds to each of R, G, B color filter layers.

Now, referring to FIG. 3, the layout of the scanning and data electrodes will be described. Since all the scanning electrodes Y1–Yn are identical, the following description will be made, taking Y1 as an example. The scanning electrode Y1 is composed of a common connecting portion 16*a* formed in a stripe shape and plural rectangular electrode portions 16*b* and 16*c*. The electrode portions 16*c* extend upward from the connecting portion 16*a*, while the electrode portions 16*b* extend downward from the connecting portion 16*a*. In other words, the electrode portions 16*b* and 16*c* are formed in a zigzag shape with the connecting portion being placed between 16*b* and 16*c*. Each electrode portion 16*b*, 16*c* is located to correspond to each data electrode Xm. Since one data electrode includes three stripes, each corresponding to each of R, G, B color filters, three stripes are covered by one rectangular electrode portion, 16*b* or 16*c*. For example, the first electrode portion 16*b* (located at the left end in FIG. 3) overlaps three data electrode stripes constituting the data electrode X1. Similarly, the second electrode portion 16*c* overlaps three data electrode stripes constituting the data electrode X2.

The scanning electrode Y2 located next to Y1 has the same structure as Y1, and the first rectangular electrode portion 16*b* projected downwardly from the common connecting portion 16*a* covers the three stripes of the data electrode X1. Similarly, the upwardly projected electrode portion 16*c* covers the data electrode X2. In other words, the electrode portion 16*c* of Y2 is located between two electrode portions 16*b* of Y1 as shown in FIG. 3. This means that downwardly projected electrode portions 16*b* of Y1 and the upwardly projected electrode portions 16*c* of Y2 are all aligned on the same horizontal display line S1. All other scanning electrodes up to Y1025 have the same structure, and the downwardly projected electrode portions 16*b* of Yn and the upwardly projected electrode portions 16*c* of Y(n+1) are located on the same horizontal display line Sn. In this manner, the horizontal display lines form S1 to S1024 are similarly formed.

The horizontal scanning electrodes Yn (n=1–1025) and the vertical data electrodes Xm (m=1–1280) form pixels G(m,n) at each intersection thereof, together with the liquid crystal 10*c* interposed between Yn and Xm. For example, G(1,1) corresponds to the downwardly projected electrode portion 16*b* of Y1, and G(2,1) corresponds to the upwardly projected electrode portion 16*c* of Y2. Similarly, all the pixels G(m,n) correspond to electrode portions of respective scanning electrodes Yn.

Referring to FIG. 2 again, both polarizer layers 10*d* and 10*e* are placed to form a cross-Nicol position, so that the antiferroelectric liquid crystal 10*c* becomes non-transparent (dark) when a voltage lower than a threshold level is imposed, and it becomes transparent (bright) when a voltage higher than the threshold level is imposed. The degree of the transparency changes depending on the level of voltage that exceeds the threshold level. The antiferroelectric liquid crystal 10*c* has two transparency states, a positive transparency state occurring with a positive voltage imposition and a negative transparency state occurring with a negative voltage imposition. Both electrode substrates 10*a* and 10*b* are supported by a number of spacers (not shown) to make a uniform space, e.g., 2 $\mu$m, therebetween.

The space between both electrode plate 10*a* and 10*b* is filled with antiferroelectric liquid crystal, such as the one disclosed in JP-A-5-119746: 4-(1-trifluoromethylheptoxycarbonylphenyl)-4'-octyloxycarbonylphenyl-4-carboxylate As the liquid crystal 10*c*, several antiferroelectric liquid crystals may be mixed, or a mixed material that includes at least one antiferroelectric liquid crystal may be used.

Referring to FIG. 1 again, the matrix-display device includes the control circuit 40 to which a vertical synchronous signal VSYC and a horizontal synchronous signal HSYC are input from outside circuits. The control circuit 40 outputs various signals, DP, SI01, SI02, SCC, SCK, EN, AD3, ACK, CL1, CL2, CL3, CL4, WEN, REN, AD1 and AD2. Of those signals, DP, SI01, SI02, SCC and ACK signals are fed to the scanning electrode driving circuit 60, and CL1 and SCK signals are fed to the data electrode driving circuit 50. CL2, CL3, WEN, REN, AD1 and AD2 signals are fed to the frame memory circuit 20. DP, CL4, AD3 and EN signals are fed to the image data conversion circuit 30. SI01 and SI02 signals determine the states of the scanning electrodes Yn. In this first embodiment, when both SI01 and SI02 signals are low levels (referred to as L), the scanning electrodes Yn are in an eliminating period. When both SI01 and SI02 are high (referred to as H), Yn are in a selecting period. When SI01 is H and SI02 is L, Yn are in a holding period. When SI01 is L and SI02 is H, Yn are in an eliminating pulse imposition period.

The power source circuit 70 outputs seven voltages, each having a different level, i.e., VWP, VRP, VHP, VE, VHN, VRN AND VWN. Image data signals $R_0$, $G_0$ and $B_0$ (representing red, green and blue image signals, respectively) are supplied from an outside circuit to the frame memory circuit 20 and temporarily stored therein.

Figure 4:
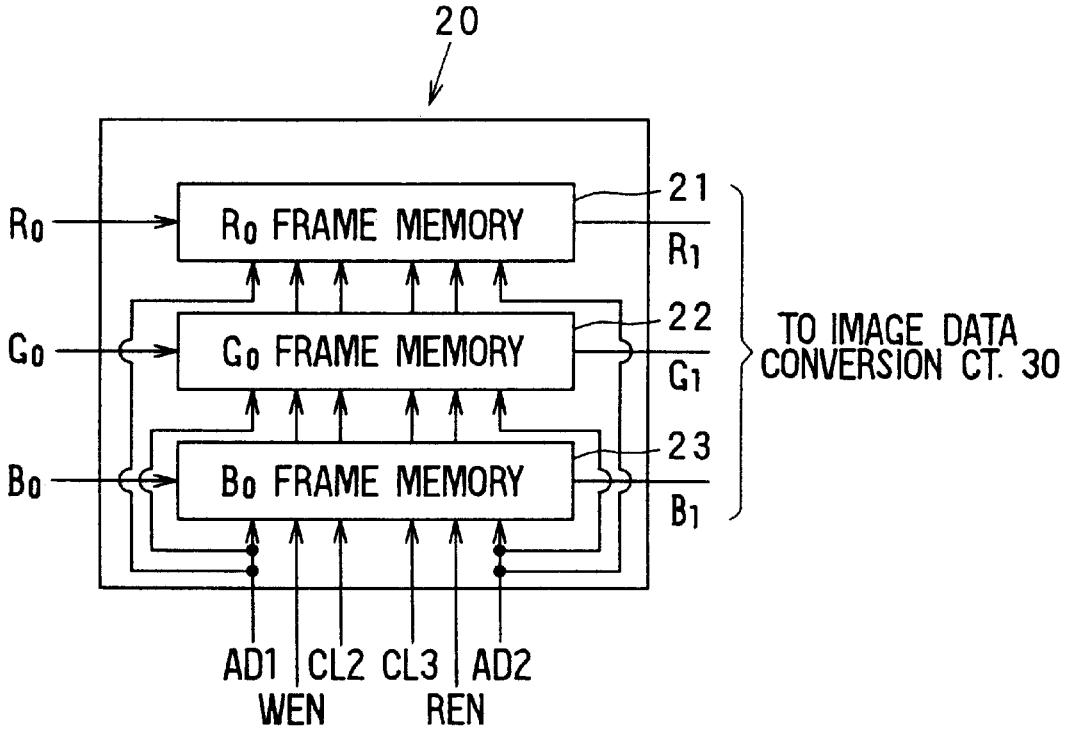
FIG. 4 is a block diagram showing a frame memory circuit.

Referring to FIG. 4, the frame memory circuit 20 will be described. The frame memory circuit 20 is composed of three frame memories, i.e., an $R_0$ frame memory 21, $G_0$ frame memory 22 and $B_0$ frame memory 23. The frame memory circuit 20 stores the image data signals $R_0$, $G_0$ and $B_0$ in respective frame memories 21, 22 and 23 in synchronism with the vertical synchronous signal VSYC and the horizontal synchronous signal HSYC (refer to FIGS. 5A and 5B). More particularly, when the WEN signal (write-in signal) fed from the control circuit 40 is H, the frame memories 21, 22 and 23 receive image data signals $R_0$, $G_0$ and $B_0$, and stores those signals, in synchronism with the clock signal CL2 fed from the control circuit 40, in respective addresses designated by the address signal AD1. The image data signals $R_0$, $G_0$ and $B_0$ are stored in the frame memory circuit 20 frame by frame.

In this particular embodiment, there are 1024 horizontal display lines S1 to S1024, and the data to be stored in the frame memory circuit 20 correspond to data covering 1026 lines. The image data stored in the frame memory circuit 20 are shown in FIG. 10, in which H and V denote horizontal and vertical directions, respectively. Lines H0 and H1025 are additional 2 lines located at the upper end and the lower end of the display area, respectively. The data to be stored in the frame memory circuit are expressed in hexadecimal numbers. The data for H0 and H1025 are always zero as a hexadecimal number, and the data D(i,j) for H1 to H1024 are stored in the frame memory circuit 20 as shown in FIG. 10. The data to be stored in the frame memory circuit are expressed in hexadecimal numbers. The data for H0 and H1025 are always zero as a hexadecimal number, and the data D(i,j) for Hi to H1024 are stored in the frame memory circuit 20 as shown in FIG. 10.

Figure 5A:
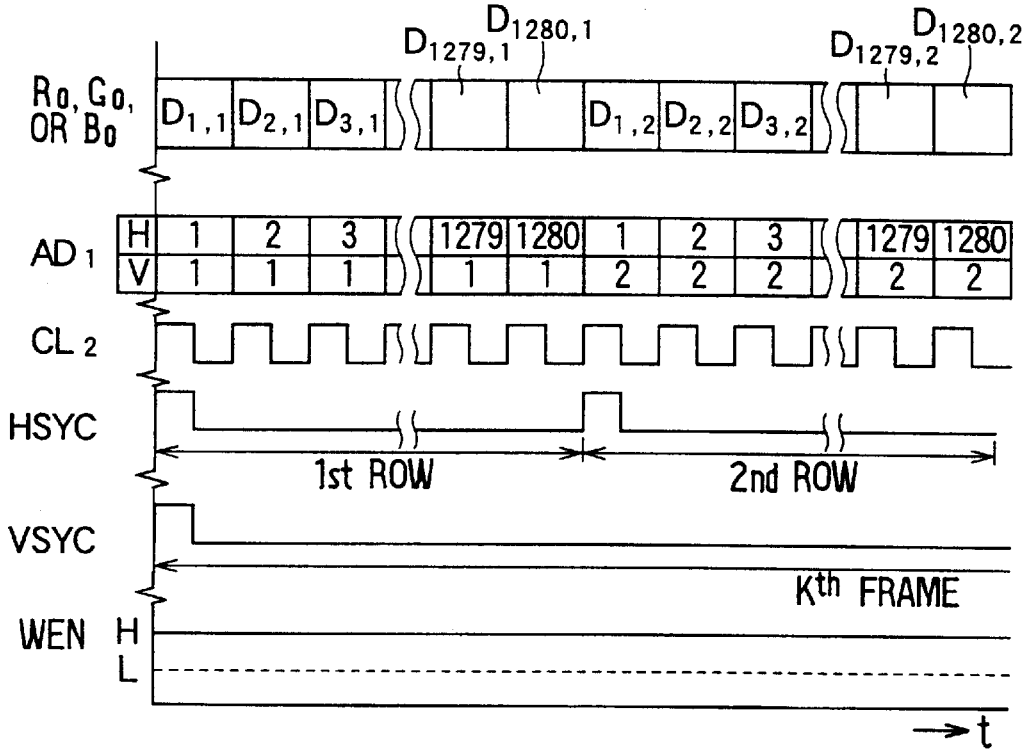
FIGS. 5A and 5B are charts showing timing to write data signals in a frame memory circuit.
Figure 5B:
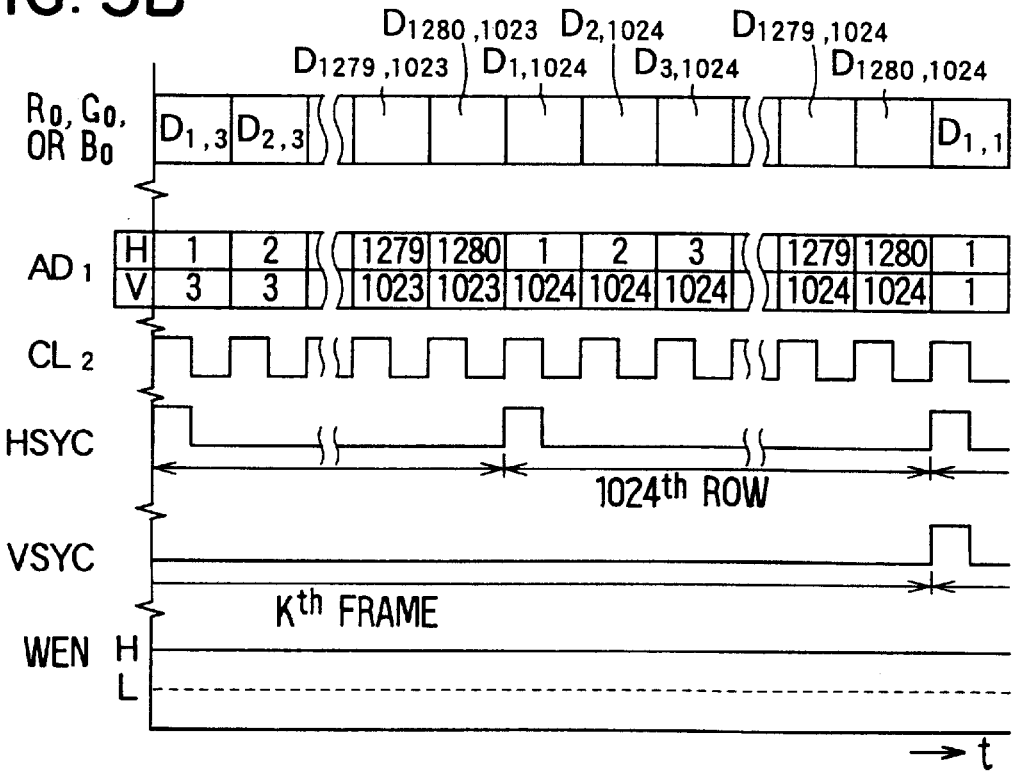

Referring to FIGS. 5A and 5B, timing for writing the image data in the frame memory circuit 20 will be explained, taking $K^{th}$ frame as an example. The data for $K^{th}$ frame starts in synchronism with the VSYC signal and continues until the next VSYC signal rises. The respective image data signal $R_0$, $G_0$ or $B_0$ for each pixels G(i,j) is sent to the frame memories 21, 22 and 23 as data D(i,j) in the following order: G(1,1), G(2,1), G(3,1) . . . G(1280,1); G(1,2), G(2,2), G(3,2) . . . G(1280,2); G(1,3), G(2,3), G(3,3) . . . G(1280,3); . . . G(1,1024), G(2,1024), G(3,1024) . . . G(1280,1024). The data D(i,j) are sequentially stored in the frame memories 21, 22 or 23 in the region designated by the address signal AD1 in synchronism with the clock signal CL2.

Figure 7A:
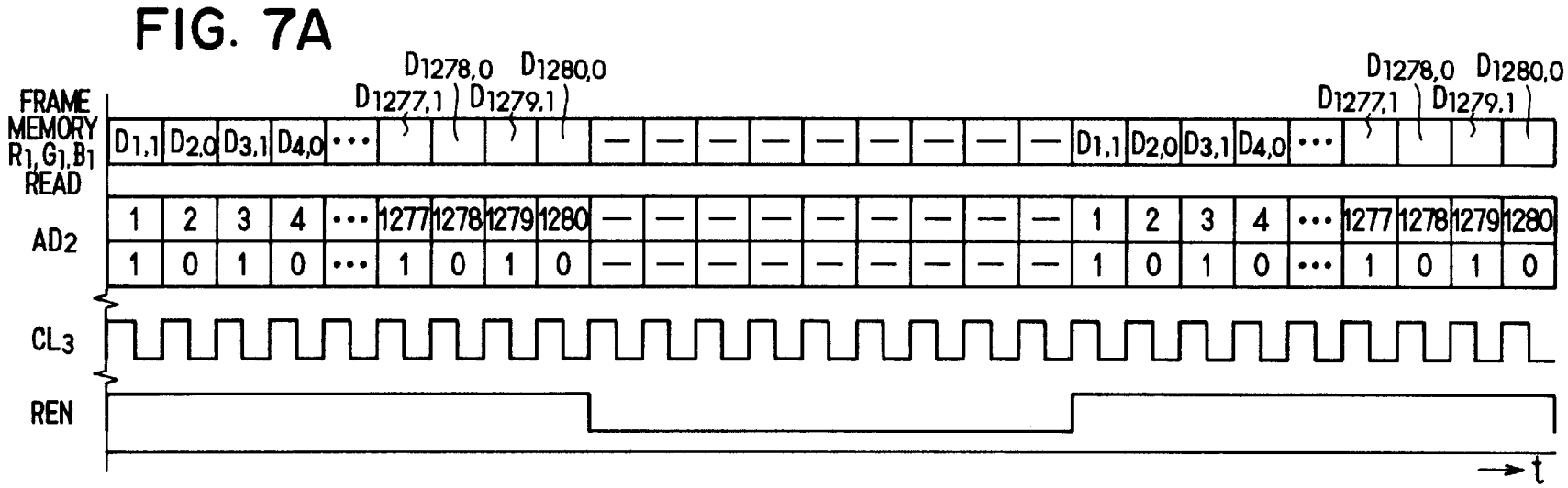
FIGS. 7A, 7B and 7C are charts showing timing to read out data from the frame memory circuit.
Figure 7B:
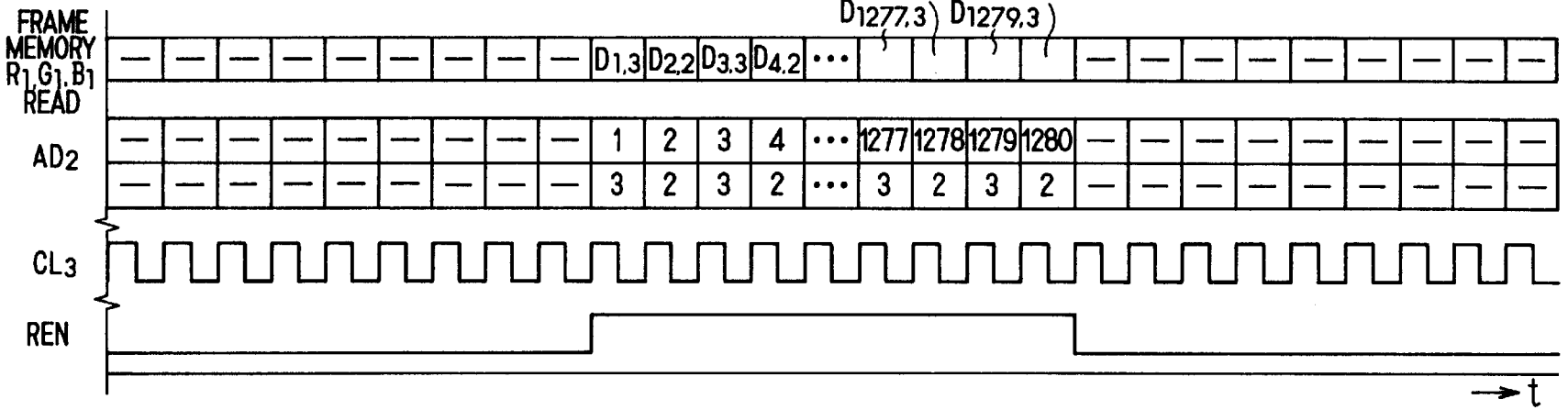
Figure 7C:
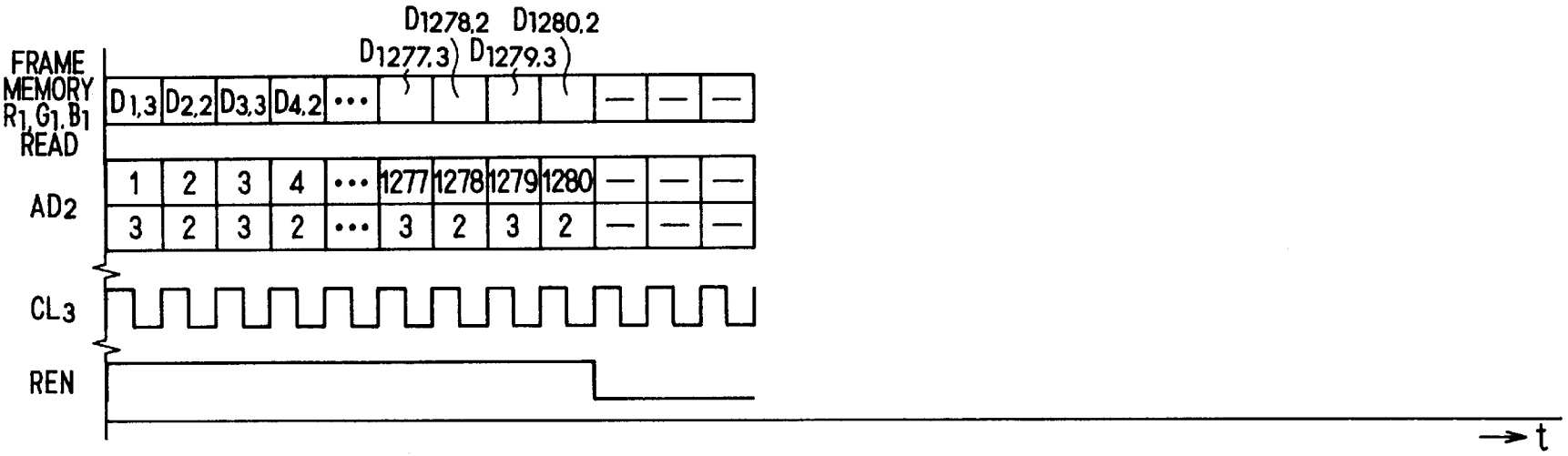
Figure 8A:
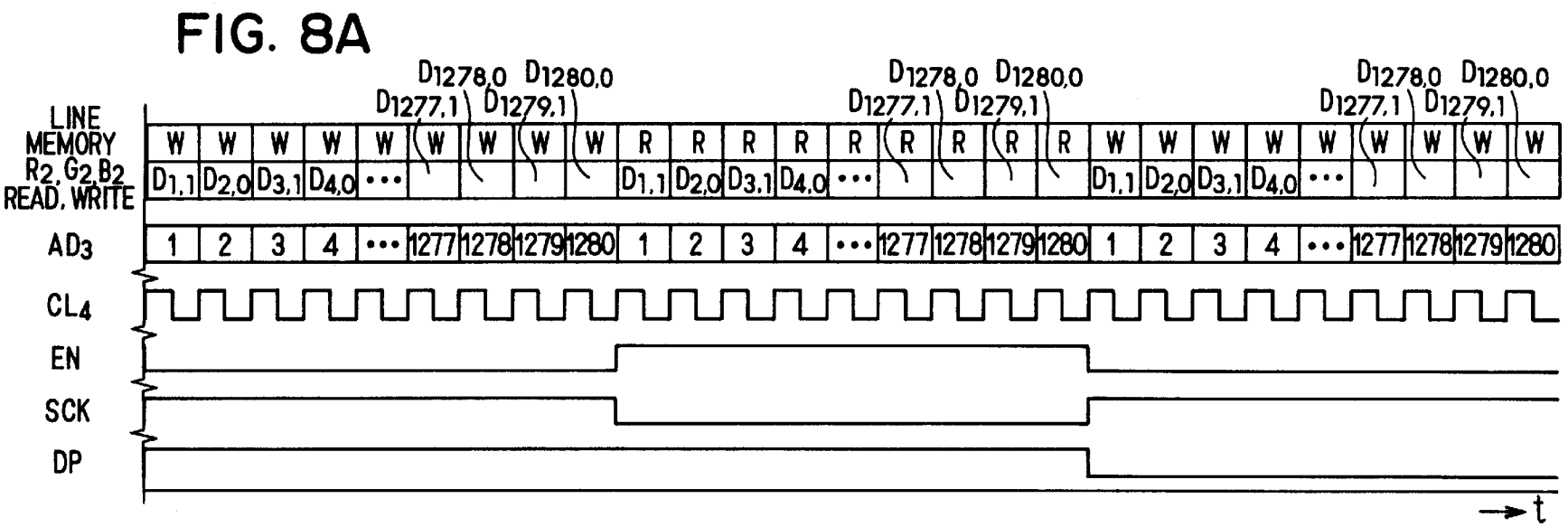
FIGS. 8A, 8B and 8C are charts, showing timing to write data in line memories of the image data conversion circuit or to read out the data therefrom.
Figure 8B:
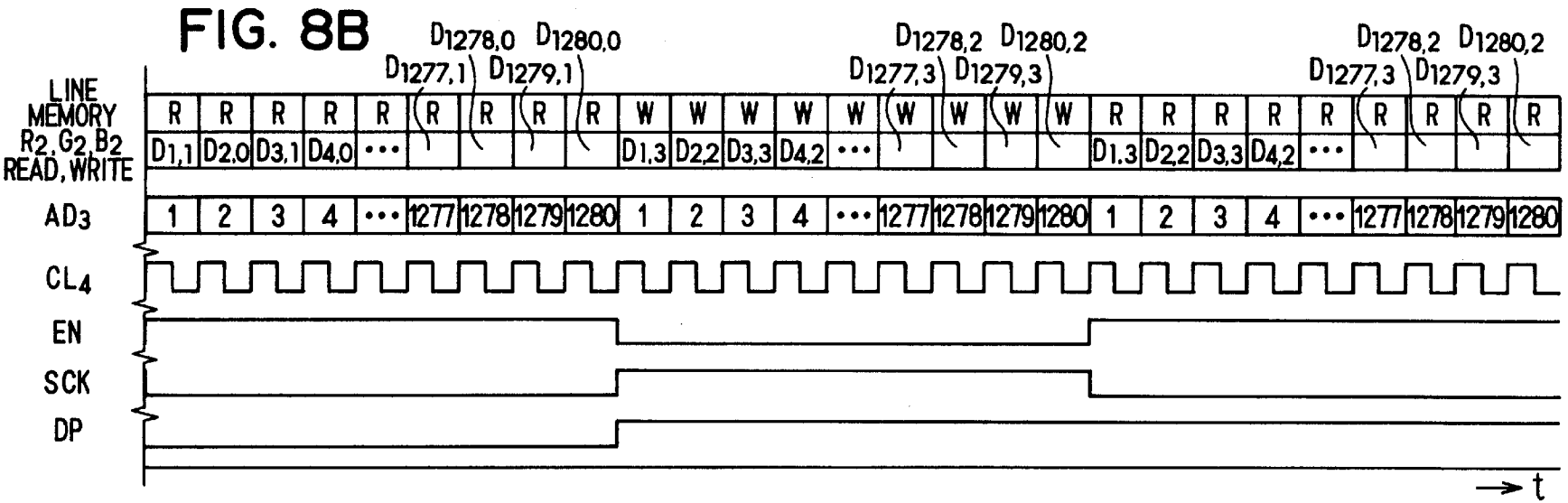
Figure 8C:
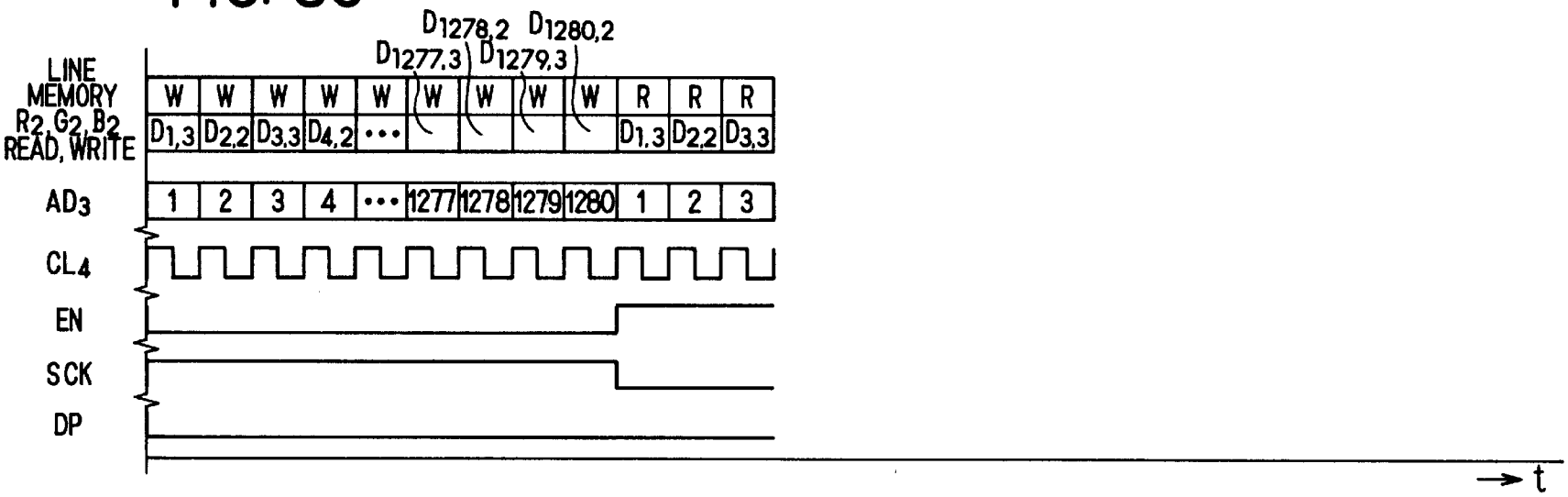

The data D(i,j) stored in the designated addresses are read out from the frame memories 21, 22 or 23 in synchronism with the clock signal CL3 when the REN signal is H, as shown in FIG. 7. As shown in FIG. 8, the data D(i,j) thus read out are written in respective line memories 31*a*, 32*a*, 33*a* for $R_1$, $G_1$ or $B_1$ in the image data conversion circuit 30, in synchronism with the clock signal CL4. When the REN signal is H, the EN signal is L, because both are synchronized in this manner. Accordingly, the data are written in the predetermined addresses in the line memories 31*a*, 32*a* and 33*a* simultaneously with their being read out from the frame memories 21, 22 and 23.

Figure 3:
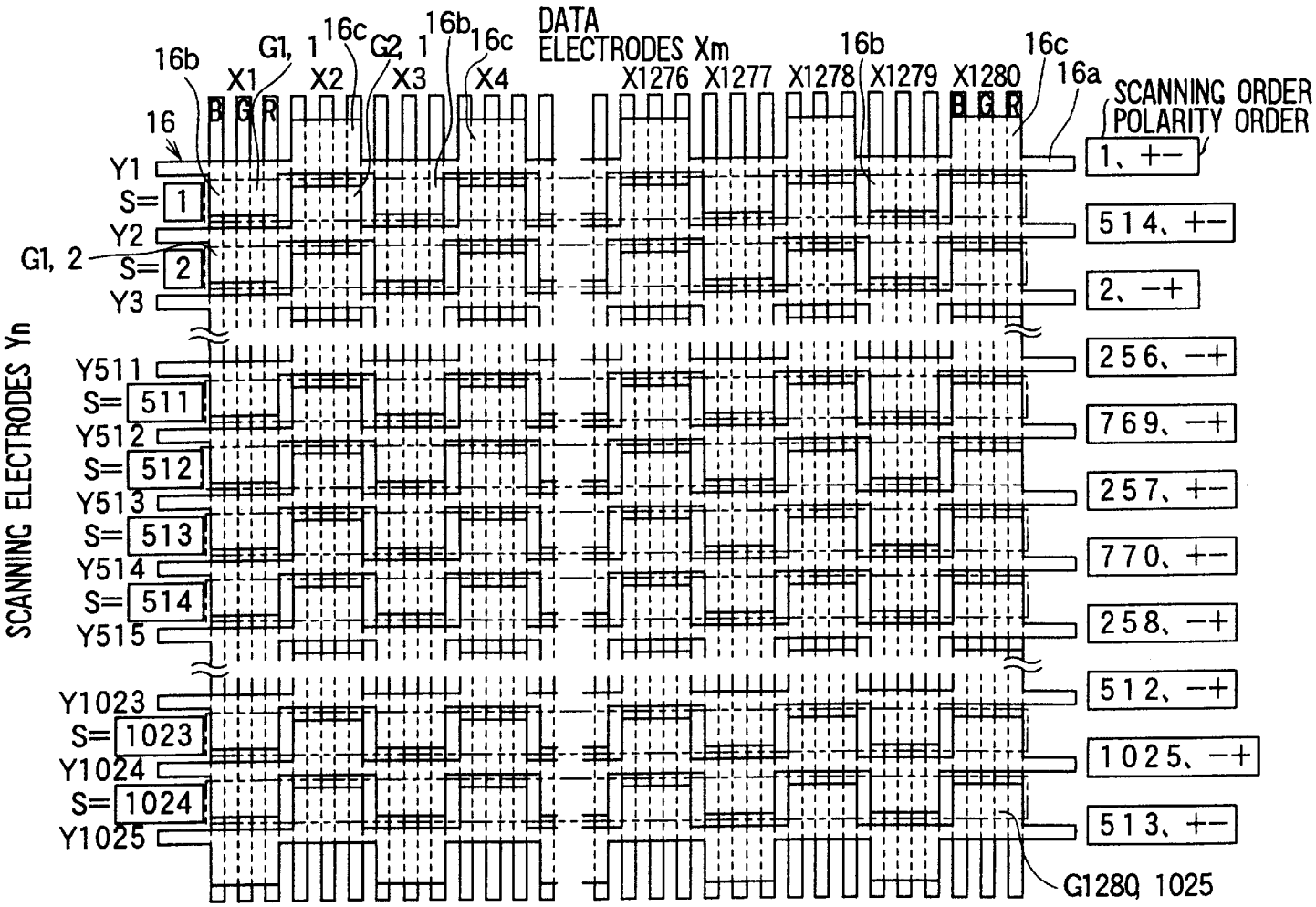
FIG. 3 is a diagram showing a layout of scanning and data electrodes in the display panel, together with a scanning order and a polarity order.

Since the pixels are aligned on the horizontal display lines S as shown in FIG. 3, the data D(i,j) have to be read out in the following order: D(1,j), D(2,j+1), D(3,j), D(4,j+1) . . . D(1279,j), D(1280,j+1). In other words, data corresponding to $j^{th}$ line and $(j+1)^{th}$ line have to be alternately read out. The data read out in this order from the frame memories are stored in the addresses 1 to 1280 of the line memories 31*a*, 32*a* and 32*c*. The data written in the frame memories 21, 22 and 23 are shown in FIG. 10 in a map form, and the data written in the line memories 31*a*, 32*a* and 33*a* are shown in FIG. 11 in a map form. The data for the lines H0 and H1025 shown in FIG. 10 are always zero as a hexadecimal number throughout the vertical lines V1 to V1280.

Figure 6:
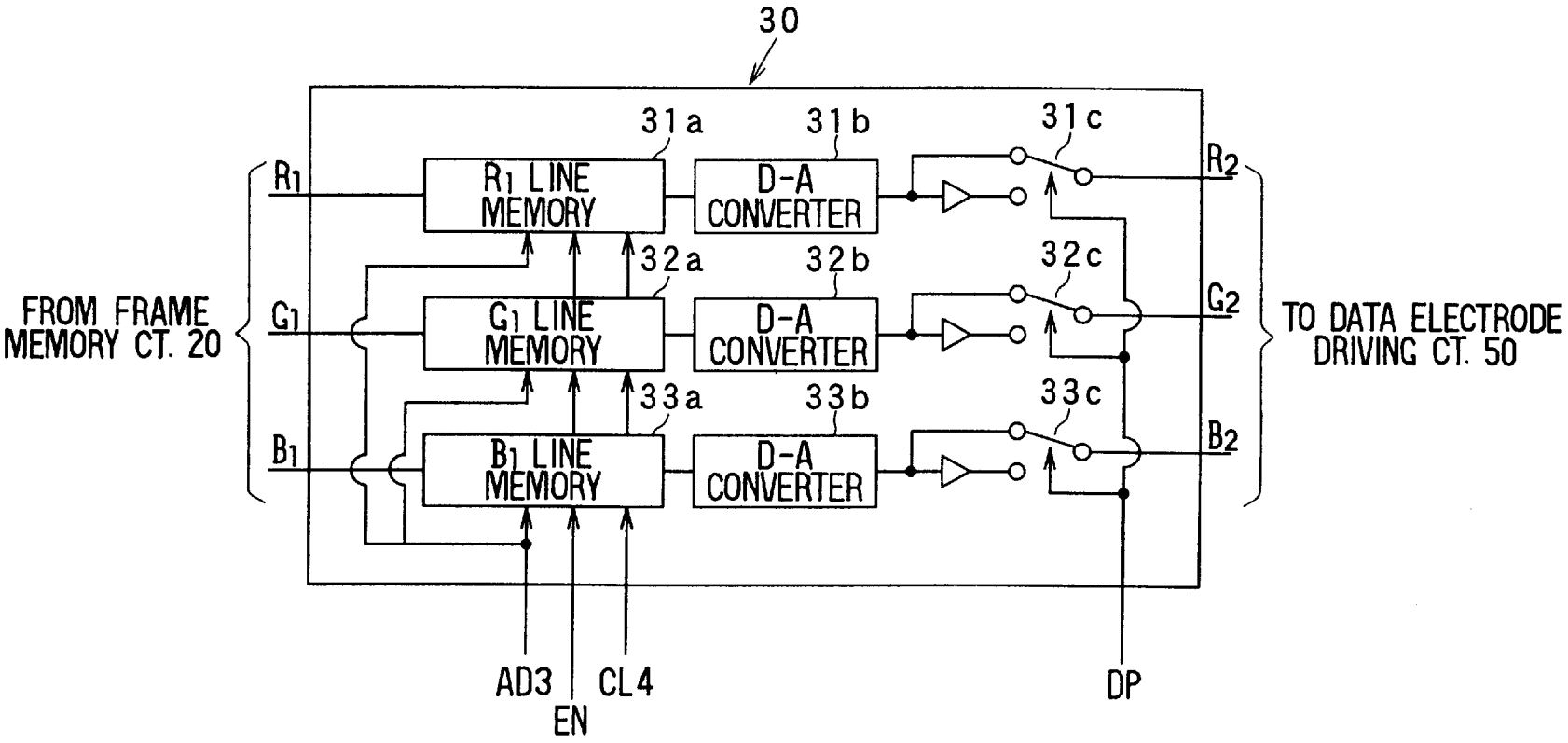
FIG. 6 is a block diagram showing an image data conversion circuit.
Figure 9:
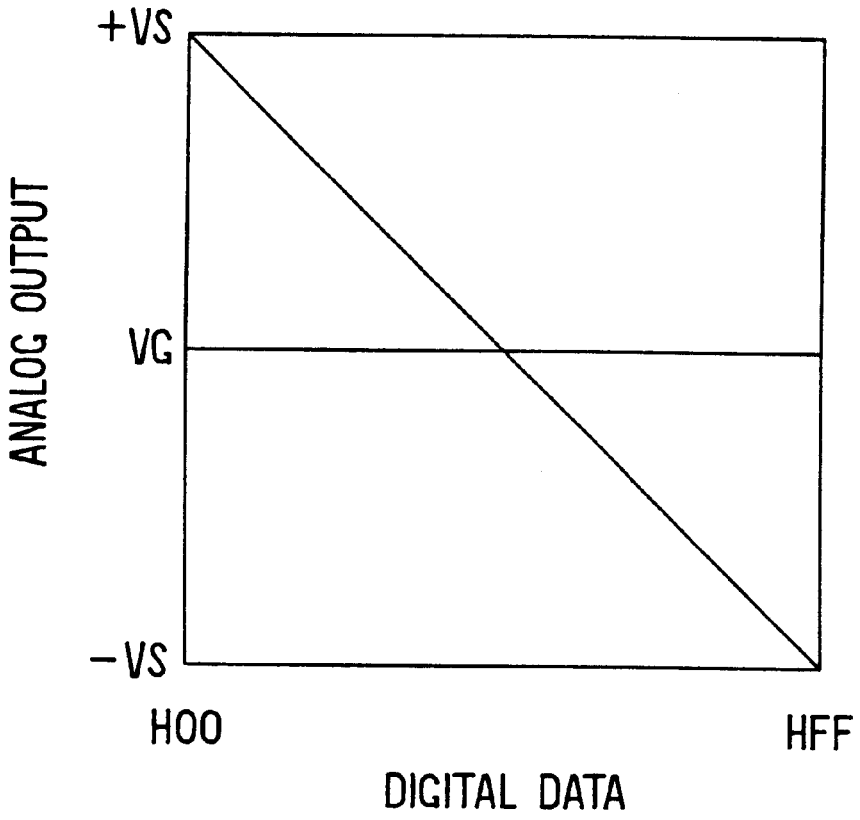
FIG. 9 is a graph showing a relation between digital data and analog outputs converted by a D-A converter.

As shown in FIG. 6 data stored in line memories 31*a*, 32*a* and 33*a* are sequentially fed to the D-A converters 31*b*, 32*b* and 33*b* in synchronism with the clock signal CL4 during a period in which the EN signal is H. The SKC signal is L during the period in which the EN signal is H. Two pulses of the SCK signal are supplied every time when one pulse of SCC signal is imposed. The digital data fed to the D-A converters 31*b*, 32*b* and 33*b* are converted into analog data $R_2$, $G_2$ and $B_2$ (shown in FIG. 1) having predetermined levels. The predetermined levels of the analog data linearly vary according to the digital data as shown in FIG. 9. The analog outputs from the D-A converters 31*b*, 31*b* and 33*b* are fed to the data electrode driving circuit 50 through respective analog switches 31*c*, 32*c* and 33*c*. Each analog switch directly outputs the analog data to the data electrode driving circuit 50 when the DP signal is L, while it reverses the analog data and then outputs the reversed data to the data electrode driving circuit 50 when the DP signal is H.

Figure 12:
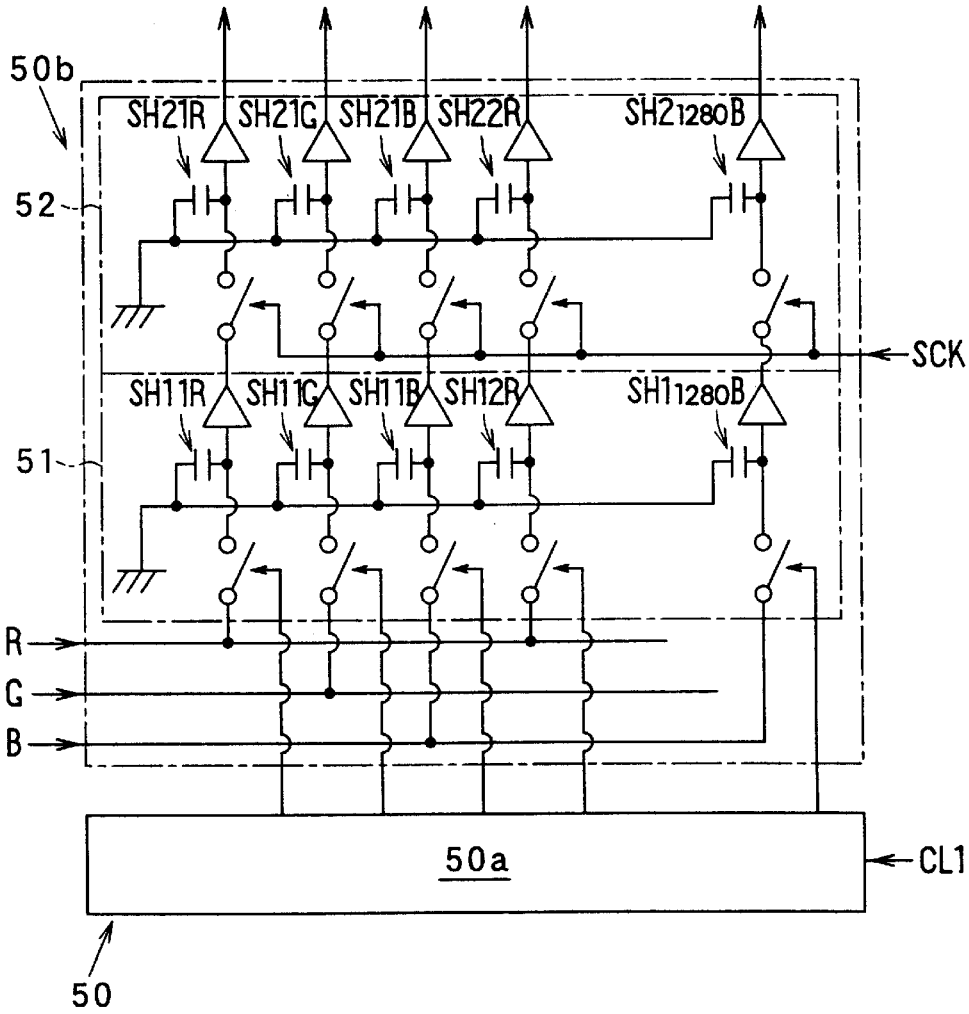
FIG. 12 is a circuit diagram showing a data electrode driving circuit.
Figure 13:
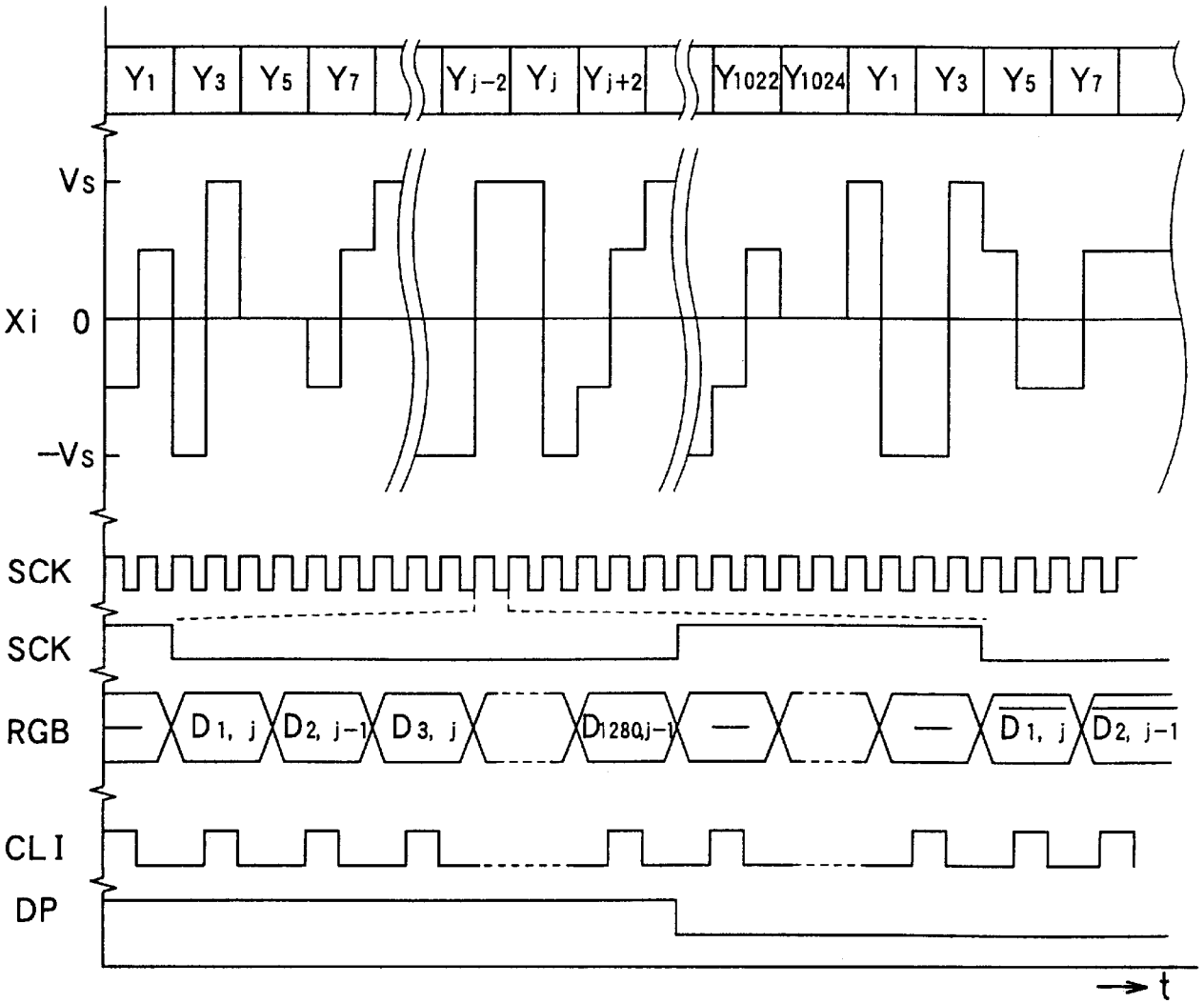
FIG. 13 is a timing chart showing voltage waveforms of the data electrode driving circuit.

Referring to FIG. 12, the data electrode driving circuit 50 will be described. The data electrode driving circuit 50 is composed of a shift register 50*a* and a sample-hold circuit 50*b* consisting of a first sample-hold circuit 51 and a second sample-hold circuit 52. The analog image data $R_2$, $G_2$ and $B_2$ are fed to the sample-hold circuit 50*b* from the image data conversion circuit 30. The analog image data are latched by sample-holders SH11R, SH11G, SH11B . . . SHLmB (m=1280) in the first sample-hold circuit 51, in synchronism with the clock signal CL1, when the SCK signal is L, and are held as data signals for one line. The data signals held in the first sample-hold circuit 51 are latched, in synchronism with the rising of SCK signal, by sample-holders SH21R, SH21G, SH21B, SH22R . . . SH2mB (m=1280) in the second sample-hold circuit 52, and are fed to the data electrodes Xm as image data signals. The data electrode driving circuit 50 repeats the above operation and thereby generates voltages having waveforms shown in FIG. 13. This means that the data electrode driving circuit 50 outputs RGB data signals that correspond to image data signals $R_0$, $G_0$ and $B_0$ in synchronism with the SCK signal.

The scanning electrode driving circuit 60 selects voltages corresponding to the eliminating period, the selecting period, the holding period and elimination voltage imposition period, respectively, from the seven voltages fed from the power source circuit 70, based on the signals DP, SI01, SI02, SCC and ACK fed-from the control circuit 40. The selected voltages are sequentially supplied to the scanning electrodes Yn in the interlaced fashion with one scanning electrode being jumped. The polarities of the voltages supplied to the scanning electrodes are switched every selecting period to drive the electrodes with alternating polarities.

Figure 17:
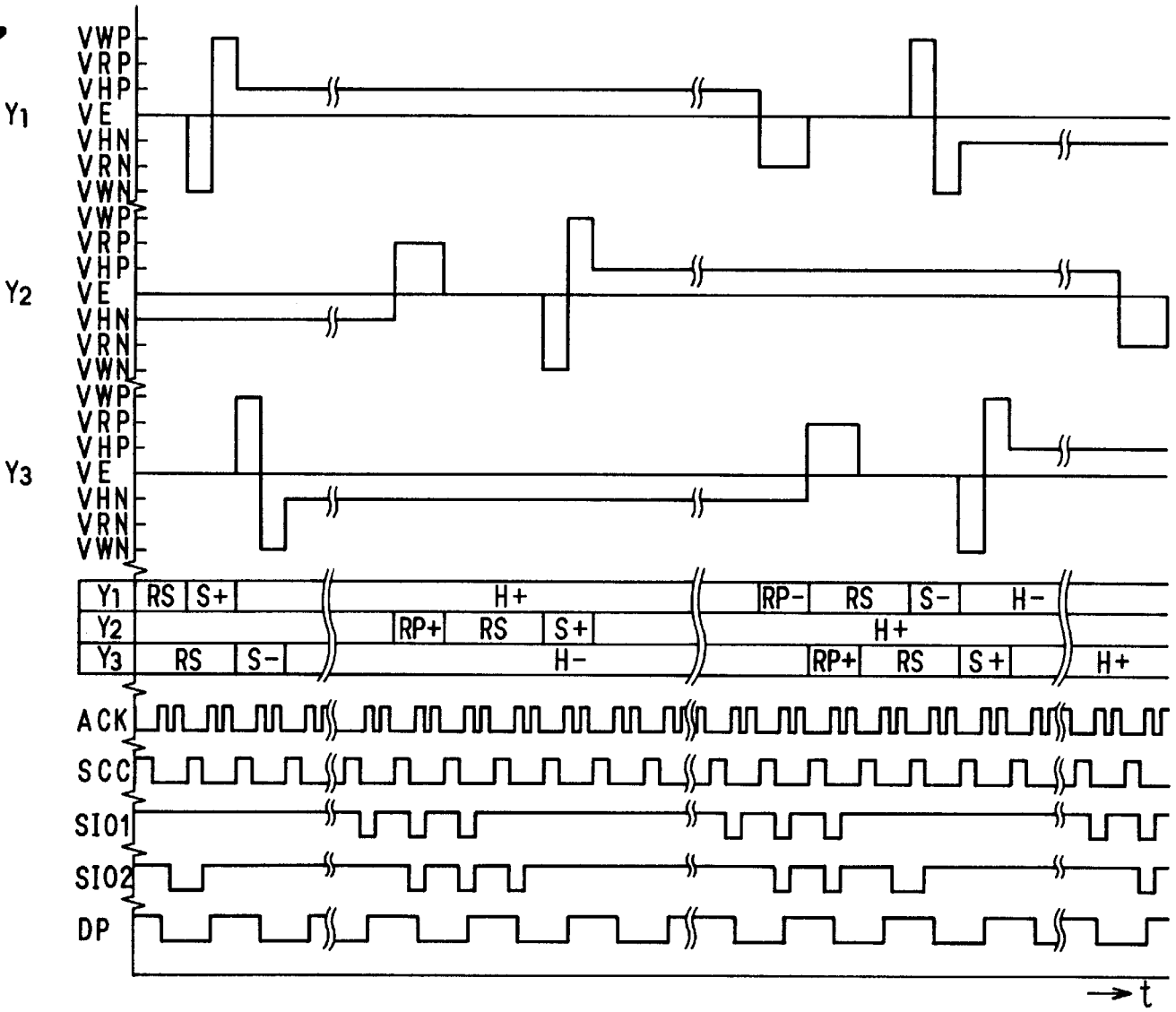
FIG. 17 is a timing chart showing operation of the scanning electrode driving circuit.

Referring to FIG. 17, operation of the scanning electrode driving circuit 60 will be described, taking the scanning electrode Y1 as an example. In FIG. 17, S+ is a positive selecting period, S− is a negative selecting period, R+ is a positive eliminating pulse imposition period, R− is a negative eliminating pulse imposition period, H+ is a positive holding period, H− is a negative holding period, RP+ is a positive eliminating pulse imposition period, RP− is a negative eliminating pulse imposition period, and RS is an eliminating period. In the eliminating period, voltage VE is supplied to the scanning electrode Y1 thereby to eliminate all the data on pixels located on the scanning electrode Y1. The selecting period is divided into two periods, a first and a second period. In the positive selecting period, a negative selecting voltage VWN is supplied to Y1 in the first period and a positive selecting voltage VWP is supplied in the second period. Image data are written on the pixels located on Y1 by composite voltages of the image data signals and the selecting voltages. In the positive holding period, a voltage VHP is supplied to Y1 thereby to hold image data written on the pixels. After the end of the positive holding period, a negative eliminating pulse VRN is supplied to Y1 in the negative eliminating pulse imposition period. The eliminating period RS follows the negative eliminating pulse imposition period RP−.

After the eliminating period RS, negative selecting period S− begins, in which the selecting voltages having a polarity opposite to the selecting voltages supplied in the positive selecting period S+ are supplied to Y1 to drive the display panel in the alternating polarity fashion. In the first period of the negative selecting period, the positive voltage VWP is supplied to Y1, and the negative selecting voltage VWN is supplied in the second period. In the negative selecting period S−, the image data are written on the pixels located on Y1 in the same manner as in the positive selecting period. In the negative holding period H−, a negative holding voltage VHN is supplied to Y1 thereby to hold the image data written on the pixels. After the negative holding period H−, a positive eliminating pulse VRP is supplied to Y1 in the positive eliminating pulse imposition period PR+.

The scanning voltages are supplied to scanning electrodes in the interlaced fashion, jumping one scanning electrode. That is, the scanning electrodes are scanned in the order of: Y1, Y3, Y5, Y7 . . . Y1023, Y1025; Y2, Y4, Y6 . . . Y1022, Y1024. The phase of the scanning voltages is shifted by the selecting period for each scanning. That is, Y3 is scanned with a delay of the selecting period S+ or S−, compared with Y1. This applies to all other scanning electrodes. To suppress the flicker on the display, the polarities of the scanning voltages are alternated electrode by electrode. That is: positive scanning for Y1, negative scanning for Y3, positive for Y5 . . . negative for Y1023, positive for Y1025, negative for Y2, positive for Y4 . . . negative for Y1022, positive for Y1024, negative for Y1 . . . and so on.

Figure 14:
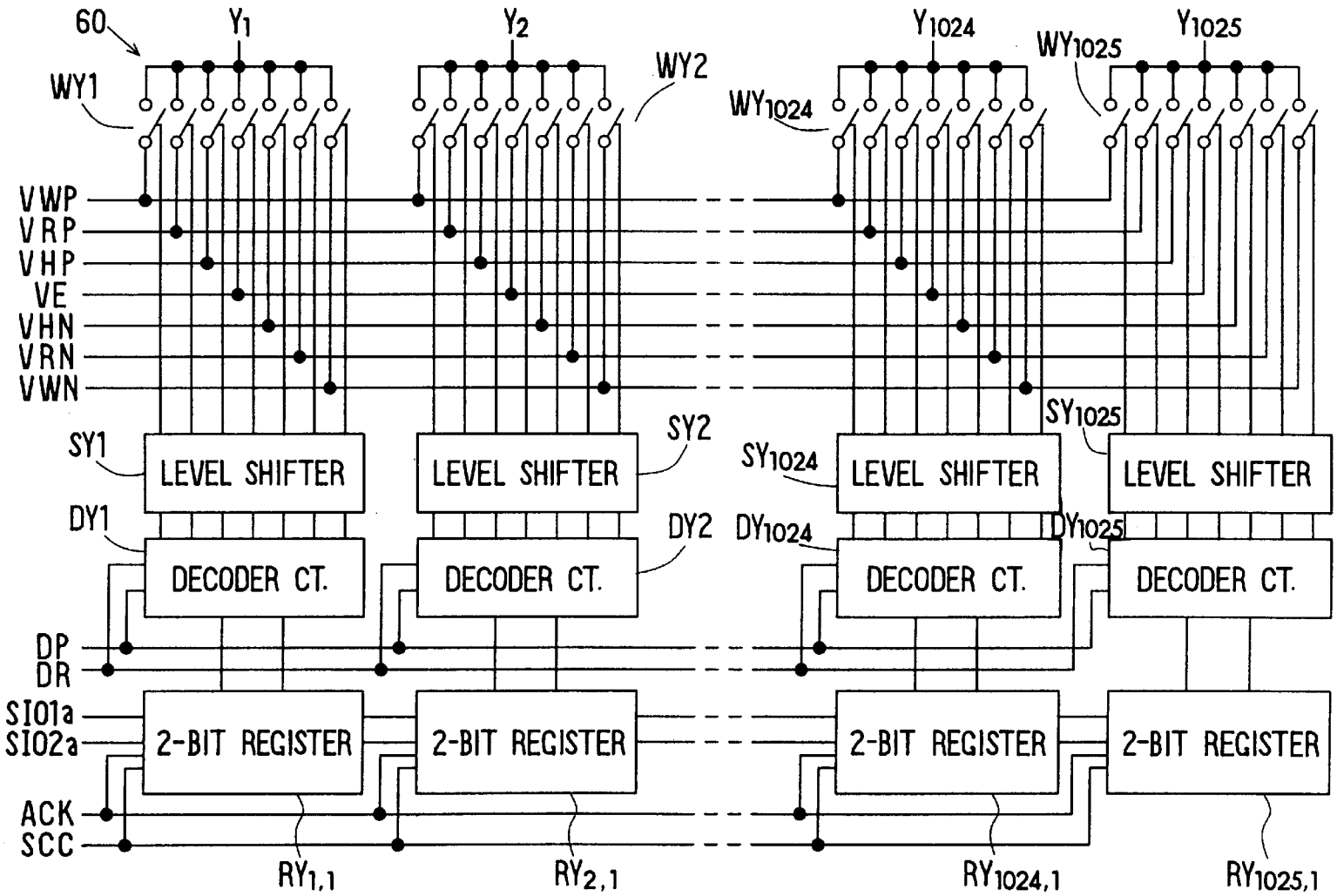
FIG. 14 is a circuit diagram showing a scanning electrode driving circuit.

Referring to FIG. 14, the structure of the scanning electrode driving circuit 60 will be described. The scanning electrode driving circuit 60 is composed of: 1025 2-bit registers RY(1,1), RY(2,1) . . . RY(1025,1); 1025 decoder circuits DY1, DY2, DY3 . . . DY1025; 1025 level shifters SY1, SY2, SY3 . . . SY1025; and 1025 analog switch circuits WY1, WY2, WY3 . . . WY1025. The scanning electrode driving circuit 60 is controlled by five signals fed from the control circuit 40. The SI01 and SI02 signals are sequentially fed to the 2-bit registers in synchronism with the rising of ACK signal, and the 2-bit data (bit-1 and bit-2) are output to the decoder circuits DY1 to DYn.

Figure 15:
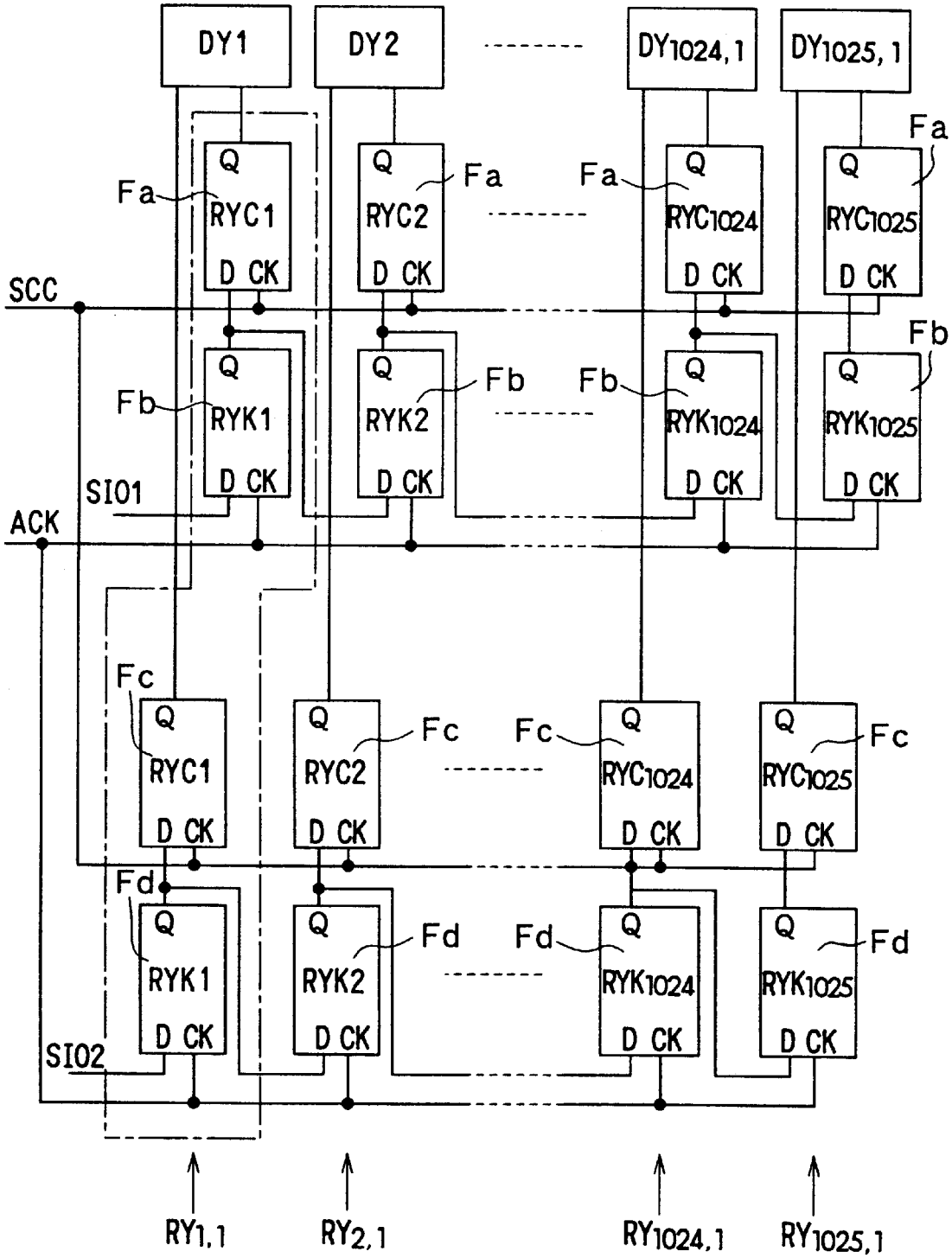
FIG. 15 is a block diagram showing 2-bit registers.

Referring to FIG. 15, the structure of the 2-bit registers RY(1,1) to RY(1025,1) will be explained, taking RY(1,1) and RY(2,1) as examples. The 2-bit register RY(1,1) is composed of a pair of D-type flip-flops Fa and Fb constituting one bit and another pair of D-type flip-flops Fc and Fd constituting another bit. The flip-flops Fb and Fd receive the SI01 and SI02 signals in synchronism with the rising of the ACK signal, and feed outputs to the flip-flops Fa and Fc from their respective Q terminals in synchronism with the rising of the SCC signal. The flip-flops Fa and Fc receive the outputs from the Q terminals of the flip-flops Fb and Fd, and output 2-bit data (bit-1 and bit-2) to the decoder circuit DY1.

Similarly, the 2-bit register RY(2,1) is composed of one pair of D-type flip-flops Fa, Fb, and another pair of D-type flip-flops Fc, Fd. In the 2-bit register RY(2,1), the outputs from the Q terminals of the flip-flops Fb, Fd of the 2-bit register RY(1,1) are fed to the flip-flops Fb, Fd in synchronism with the rising of the ACK signal, and the outputs of the flip-flops Fb, Fd are fed to the flip-flops Fa, Fc from their respective Q terminals. The flip-flops Fa, Fc receive the outputs from the Q terminals of the flip-flops Fb, Fd in synchronism with the rising of the SCC signal, and output 2-bit data (bit-1 and bit-2) to the decoder circuit DY2. Other 2-bit registers RY(3,1) to RY(1025,1) have the same structure as the 2-bit register RY(2,1) and operate in the same manner. The decoder circuits DY1 to DY1025 generate seven signals for switching the analog switch circuits WY1 to WY1025, based on the 2-bit data fed from the 2-bit registers RY(1,1) to RY(1025,1) and the first DP signal fed from the control circuit 40.

Figure 16:
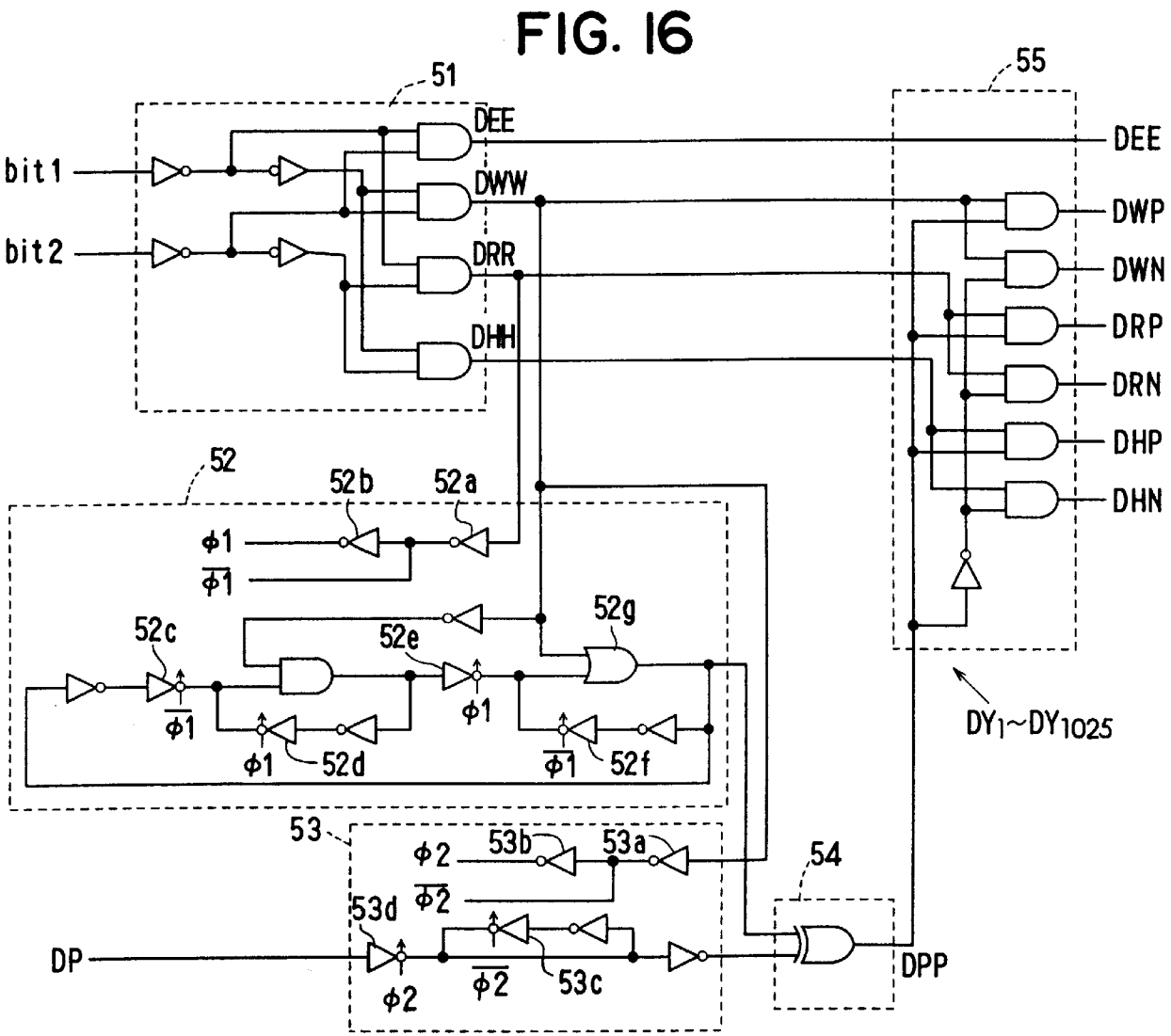
FIG. 16 is a circuit diagram showing a decoder circuit.

Referring to FIG. 16, the structure and operation of the decoder circuits DY1 to DY1025 will be described, taking the decoder circuit DY1 as an example. The decoder circuit is composed of five logic circuits 51, 52, 53, 54 and 55. The logic circuit 51 having plural logic gates decodes the bit-1 and bit-2 data from the 2-bit register RY(1,1) and converts those into switching signals DEE, DWW, DRR and DHH. Only the DEE signal becomes H (high level) in the eliminating period (both the SI01 and SI02 signals are L). Only the DWW signal becomes H in the selecting period (SI01 is H and SI02 is L). Only the DRR signal becomes H in the eliminating pulse imposition period (SI01 is L and SI02 is H). Only the DHH signal becomes H in the holding period (both SI01 and SI02 are H).

The logic circuit 52 is composed of plural logic gate elements 52*a* to 52*f*. The logic circuit 52 is reset when the DWW signal is H and inverts the output of an OR-gate 52*g* in synchronism with the rising of the DRR signal. The logic circuit 53 is composed of plural logic gate elements 53*a* to 53*d* and controls the logic circuit 54 based on the DWW signal from the logic circuit 51 and the first DP signal. The logic circuit 54 directly outputs the first DP signal received from the logic circuit 53 when the DWW signal is H, while it latches the first DP signal received from the logic circuit 53 when the DWW signal is L.

Of the seven signals thus synthesized, the DEE signal controls the analog switches connected to the output terminal VE of the power source circuit 70 through the level shifters. The DWP signal controls the analog switches connected to the output terminal VWP of the power source circuit 70 through the level shifters. Similarly, the DWN signal controls the analog switches connected to the VWN terminal, the DRP signal controls the analog switches connected to the VRP terminal, the DRN signal controls the analog switches connected to the VRN terminal, the DHP signal controls the analog switches connected to the VHP terminal, and the DHN signal controls the analog switches connected to the VHN terminal. When the level of those signals is H, the analog switches corresponding to the respective signals are turned on thereby to output the respective power source voltages through the analog switches.

The logic circuit 54 outputs an exclusive logical sum of both logic circuits 52 and 53 as a DPP signal to the logic circuit 55. The DPP signal coincides with the first DP signal and its polarity is controlled by the first DP signal, because the logic circuit 52 is reset and its output becomes L and the logic circuit 53 directly outputs the output of the logic circuit 52 during the period in which the DWW signal is H. When the DWW signal turns to L, the DPP signal becomes independent from the first DP signal, because the logic circuit performs a latching function. The DPP signal is inverted every time the DRR signal rises and its polarities are inverted when the eliminating pulse is imposed, because the output of the logic circuit 52 is inverted in synchronism with the rising of the DRR signal.

The logic circuit 55 switches voltage polarities according to the signals from the logic circuit 51 and the DPP signal from the logic circuit 54. That is, the DWP signal becomes H when both the DPP and DWW signals are H; the DWN signal becomes H when DWW is H and DPP is L; the DRP signal becomes H when both DRR and DPP are H; the DRN signal becomes H when DRR is H and DPP is L; the DHP signal becomes H when both DHH and DPP are H; and the DHN signal becomes H when DHH is H and DPP is L.

Thus, the scanning voltages shown in FIG. 17 are supplied to the scanning electrodes Yn according to various signals, ACK, SCC, SI01, SI02 and the first DP. In this first embodiment, the scanning is performed in an interlaced manner, jumping one scanning electrode, because the two pulses of the ACK signal correspond to one pulse of the SCC signal.

The operation of the first embodiment will be further explained as to a particular example designed as follows. A frame-display frequency: 30 Hz (a time period for displaying one frame is 33.333 ms, and a time period for scanning one horizontal line 1H=32.5 $\mu$s); the number of the scanning electrodes: 1025; the number of the data electrodes: 1280 (the number of data electrode stripes is 3840); a scanning duty: 1/N (N=1025); a time period for imposing the eliminating pulse: 32.5 $\mu$s (=1H); and the eliminating period: 1951.2 $\mu$s (=60H).

Figure 18:
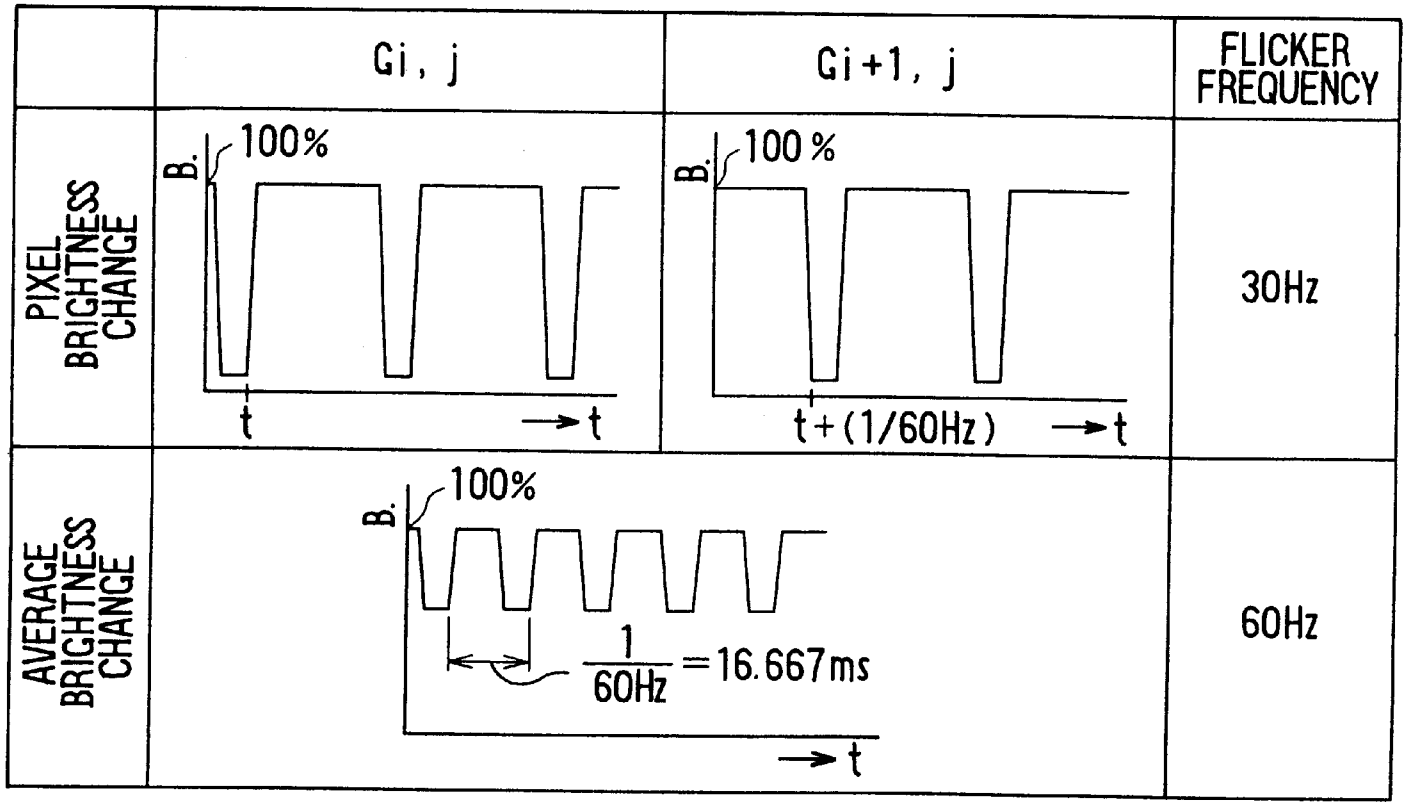
FIG. 18 is a chart showing brightness changes of neighboring two pixels and average brightness changes.
Figure 19:
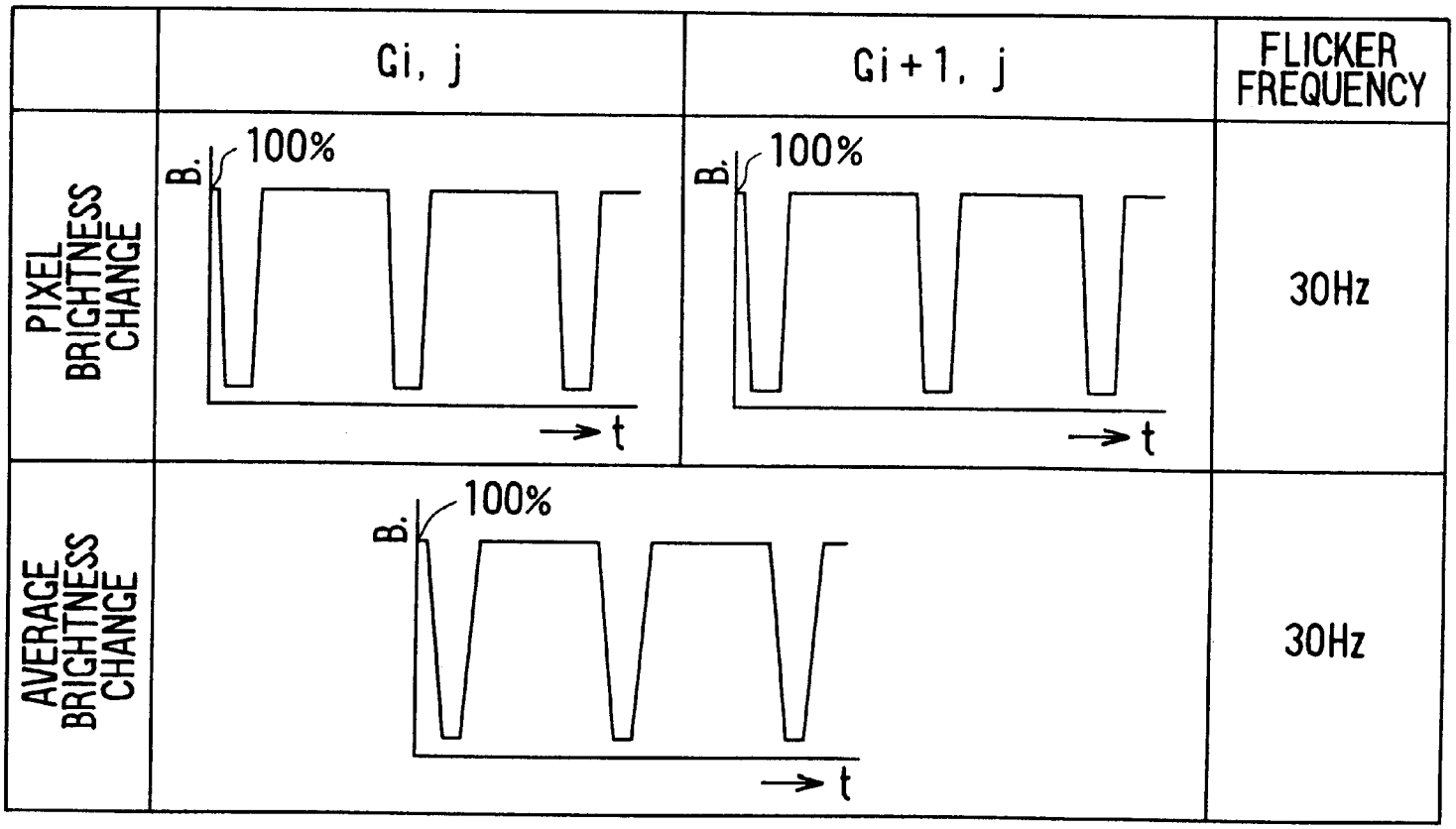
FIG. 19 is a chart showing the same as in FIG. 18, being plotted under different condition for comparison purpose.

When a display device having a conventional pixel structure is scanned under the sequential scanning, brightness changes of a pixel G(i,j) and a neighboring pixel G(i+1,j) are the same because both pixels are scanned at the same time, as shown in FIG. 19. Accordingly, the average brightness changes of both pixels are the same as those of the individual pixel, changing with a frequency of 30 Hz and having a flicker frequency of the same 30 Hz. In contrast, when the display device of the present invention having a pixel structure as described above is scanned under the interlaced scanning by jumping one scanning electrode, the brightness changes of two neighboring pixels G(i,j) and G(i+1,j) are different from each other, because the scanning timing of the pixel G(i+1,j) is shifted by 1/60 Hz (i.e. half a cycle) from that of the former pixel G(i,j), as shown in FIG. 18. Accordingly, the average brightness changes of both pixels become as shown in the bottom graph of FIG. 18. That is, the brightness change frequency and the flicker frequency are doubled to 60 Hz.

Human eye sensitivity to the flicker frequency of 30 Hz is high, and therefore such a flicker frequency is highly detrimental to display quality. However, the sensitivity decreases as the frequency increases. When the flicker frequency reaches a level of 60 Hz, the flicker becomes almost invisible. Since the flicker frequency of the first embodiment of the present invention is 60 Hz that is twice higher than the driving frequency, the flicker is almost invisible, and as a result the scroll phenomenon is also disappears. In addition, since the brightness of the display is the average brightness of two neighboring pixels G(i,j) and G(i+1,j) in the first embodiment, the flicker and the scroll are further suppressed, and these advantages are maintained even if a viewer comes pretty close to the display panel. Moreover, since the three stripes R, G and B of color filter layer 12 correspond to one pixel which is scanned in a manner shifted from its neighboring pixel, a color shift does not occur when a moving image is displayed on the panel.

Figure 20:
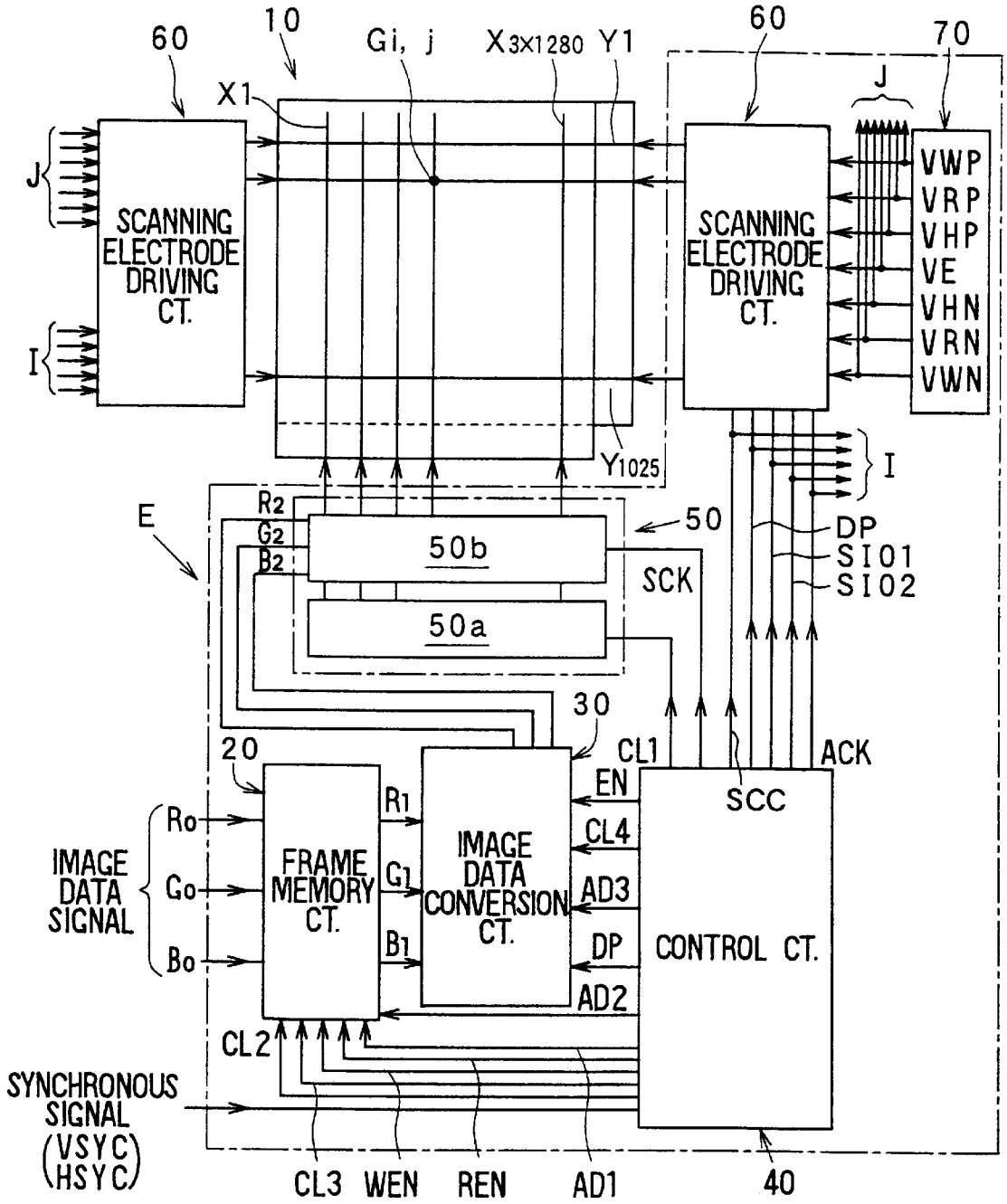
FIG. 20 is a block diagram showing a matrix-display device as a modified form of the first embodiment, details of which are shown in the following drawings, FIGS. 21–22C.
Figure 21:
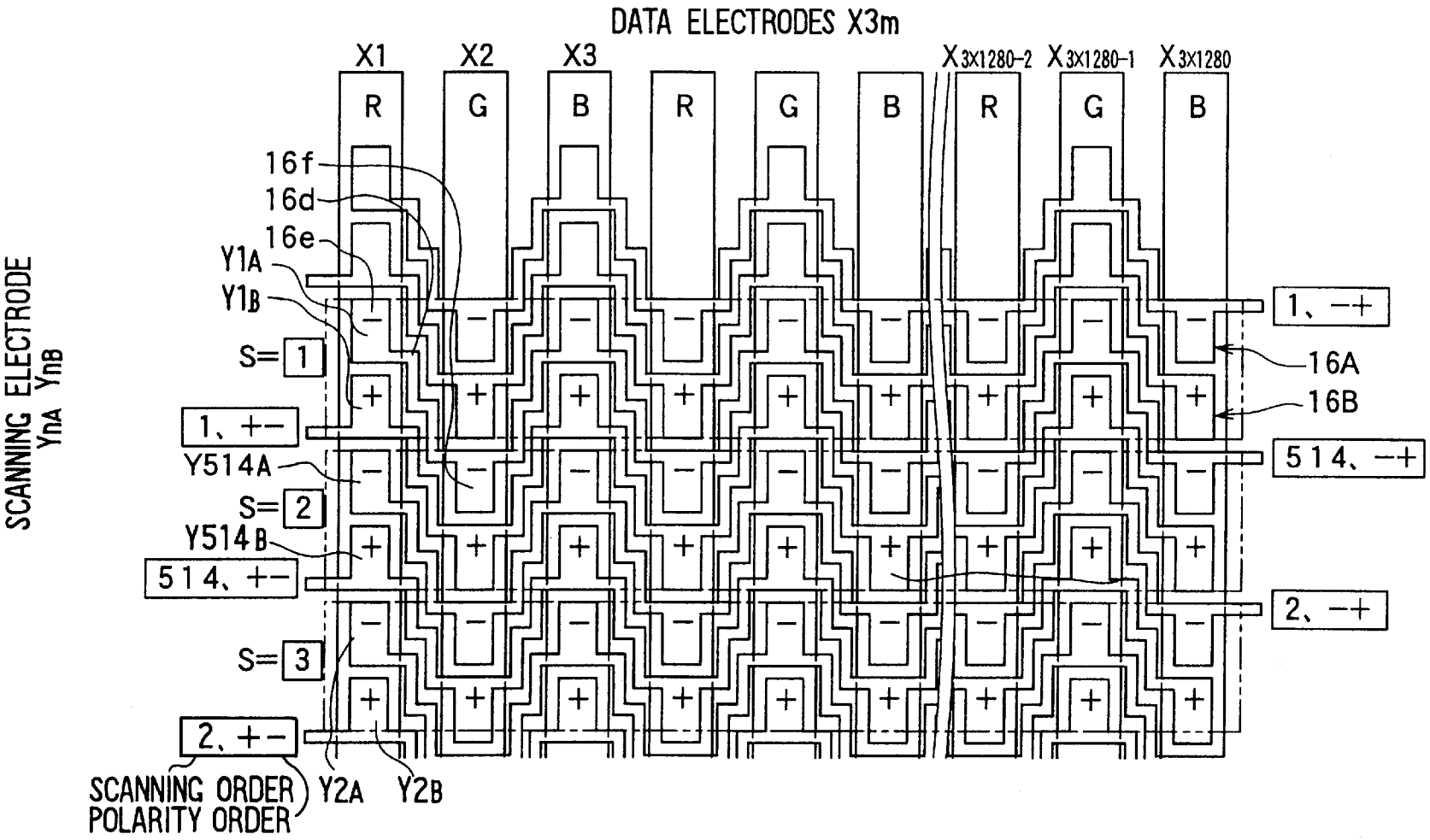
FIG. 21 is a diagram showing a layout of scanning and data electrodes, together with a scanning order and a polarity order, in the device shown in FIG. 20.

Now, referring to FIGS. 20 to 22C, a modified form of the first embodiment will be described. In this modification, another scanning electrode driving circuit 60 is additionally used to drive the scanning electrode as shown in FIG. 20, compared with the first embodiment shown in FIG. 1. The added scanning electrode driving circuit 60 operates in the same manner as the scanning electrode driving circuit 60 connected to the right side of the panel 10 in FIG. 20. Further, in this modification, each of the three color filters R, G and B corresponds to each data electrode, and therefore the number of the data electrodes is three times of that of the first embodiment, i.e., 3×1280. Accordingly, the data electrodes are denoted by X3m instead of Xm. Further, as shown in FIG. 21, each scanning electrode Yn is divided into two electrodes $Yn_A$ and $Yn_B$, each being driven under a polarity different from each other. The scanning electrodes $Yn_A$ are connected to and driven by the scanning electrode driving circuit 60 connected to the right side of the panel 10 (FIG. 20), and the scanning electrodes $Yn_B$ are connected to and driven by the scanning electrode driving circuit 60 connected to the left side of the panel 10.

The structure of the scanning and data electrodes will be described in reference to FIG. 21, taking the scanning electrodes $Y1_A$ and $Y1_B$, and data electrodes X1, X2 and X3 as examples. The scanning electrode $Y1_A$ is composed of a common connecting portion 16*f* and rectangular electrode portions 16*e* and 16*f*. The electrode portion 16*e* is projected upward from the connecting portion 16*d*, while the electrode portion 16*f* is projected downward from the connecting portion 16*d*, as shown in FIG. 21. The connecting portion 16*d* may be made of a material having a lower resistance if necessary. The scanning electrode $Y1_B$ has the same structure as $Y1_A$. Both $Y1_A$ and $Y1_B$ are formed by separate electrode layers $16_A$ and $16_B$, respectively. Both of the electrode portions 16*e* of $Y1_A$ and $Y1_B$ are located on the horizontal display line S1 to cover the data electrode X1 that corresponds to the color filter R, while both the electrode portions 16*f* of $Y1_A$ and $Y1_B$ are located on the horizontal display line S2 to cover the data electrode X2 that corresponds to the color filter G. This structure is repeated up to the data electrode X3×1280. All other scanning electrodes $Yn_A$ and $Yn_B$ are formed in the same manner as $Y1_A$ and $Y1_B$.

Figure 22A:
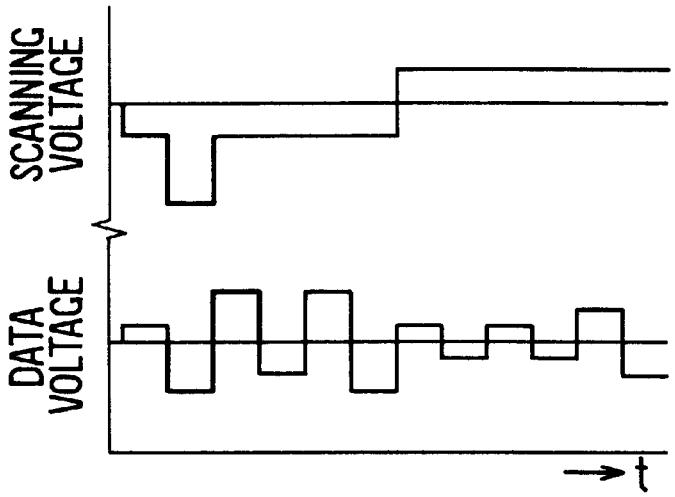
FIG. 22A is a timing chart showing scanning and data voltages in a positive side.
Figure 22B:
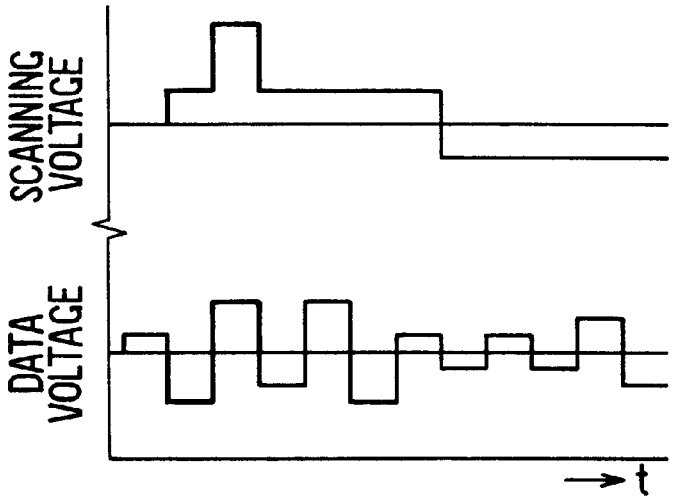
FIG. 22B is a timing chart showing scanning and data voltages in a negative side.
Figure 22C:
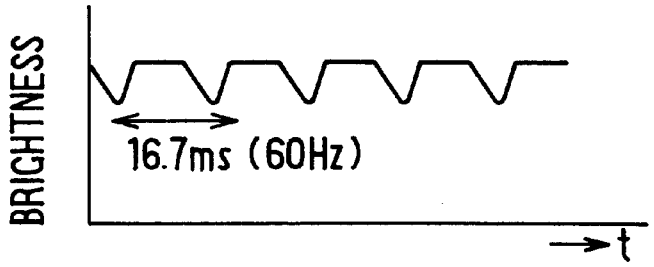
FIG. 22C is a graph showing brightness of pixels.

The scanning voltages supplied to the scanning electrode $Y1_A$ which is driven under the negative polarity and the data voltages are shown in FIG. 22A. The scanning voltages supplied to the scanning electrode $Y1_B$ which is driven under the positive polarity and the data voltages are shown in FIG. 22B. Other structures of this modification are the same as those of the first embodiment.

Since each color filter R, G and B separately corresponds to the respective data electrode X3m in this modified form, as opposed to the first embodiment, a pixel unit is smaller than that of the first embodiment. Therefore, the flicker and the scroll on the display can be further suppressed. This modified form is more advantageous if it is used for the purpose where the moving image quality is not so important. Also, this modified form is advantageous in displaying monochromatic images. Since one pixel is divided into two sections as shown in FIG. 21, and each section is driven by a voltage having the polarity different from each other, the flicker due to the characteristic difference between positive and negative states of the antiferroelectric liquid crystal 10*c* and due to the spectral transparency difference between positive and negative transparent states of the liquid crystal when the image is viewed with a slanted angle is also suppressed. This flicker suppression effect is further enhanced by combining the effect of averaging the brightness of two neighboring pixels located in the horizontal direction in the same manner as in the first embodiment.

Second Embodiment

Figure 23:
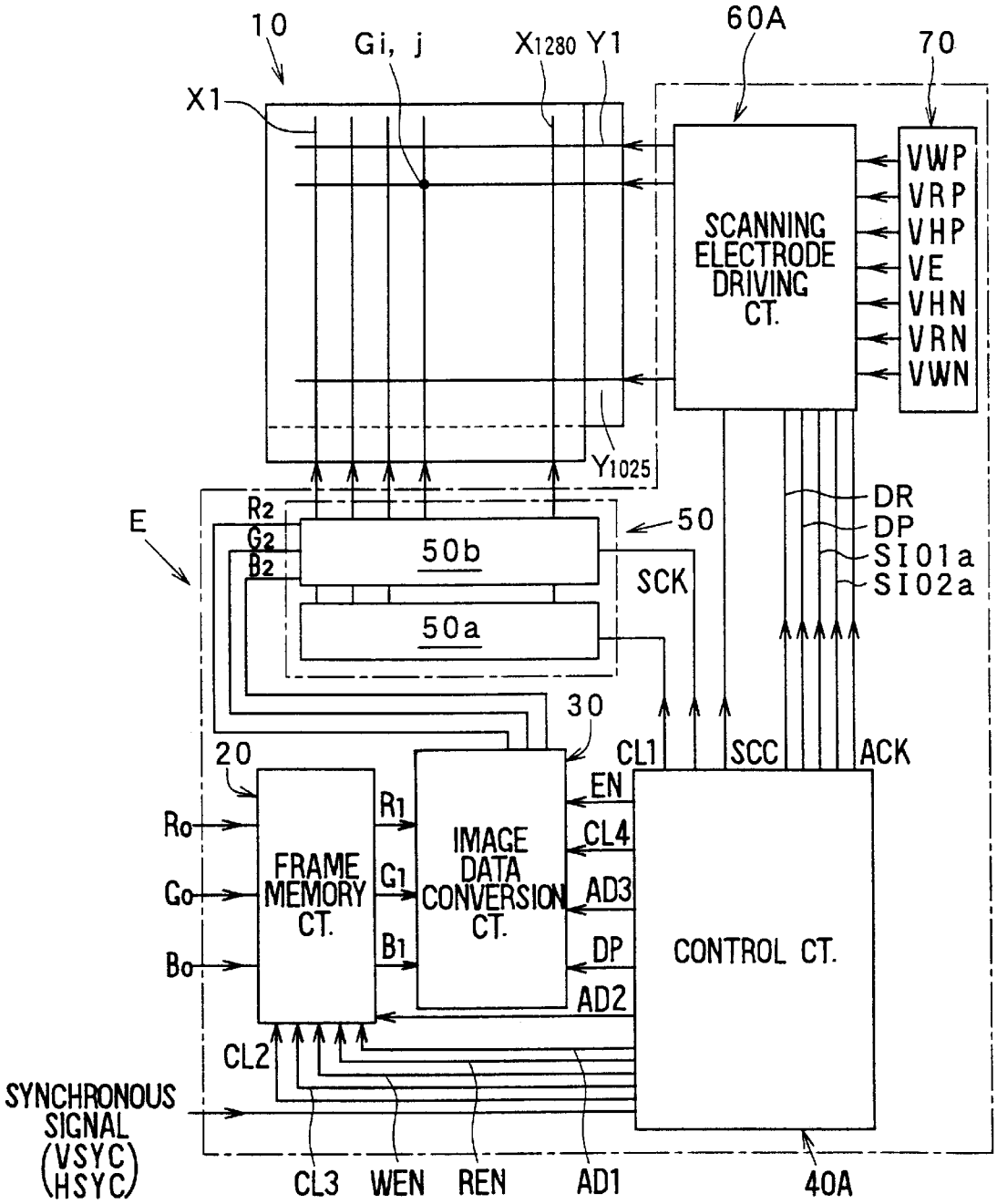
FIG. 23 is a block diagram showing a matrix-display device as a second embodiment of the present invention, details of which are shown in the following drawings, FIGS. 24–35.

A second embodiment of the present invention will be described in reference to FIGS. 23 to 35. As shown in FIG. 23, the control circuit 40 and the scanning electrode driving circuit 60 of the first embodiment shown in FIG. 1 are replaced with 40A and 60A, respectively. The control circuit 40A outputs signals SI01*a* and SI02*a* in place of the signals SI01 and SI02 of the control circuit 40. The control circuit 40A also outputs a DR signal in addition to the outputs of the control circuit 40.

Figure 29:
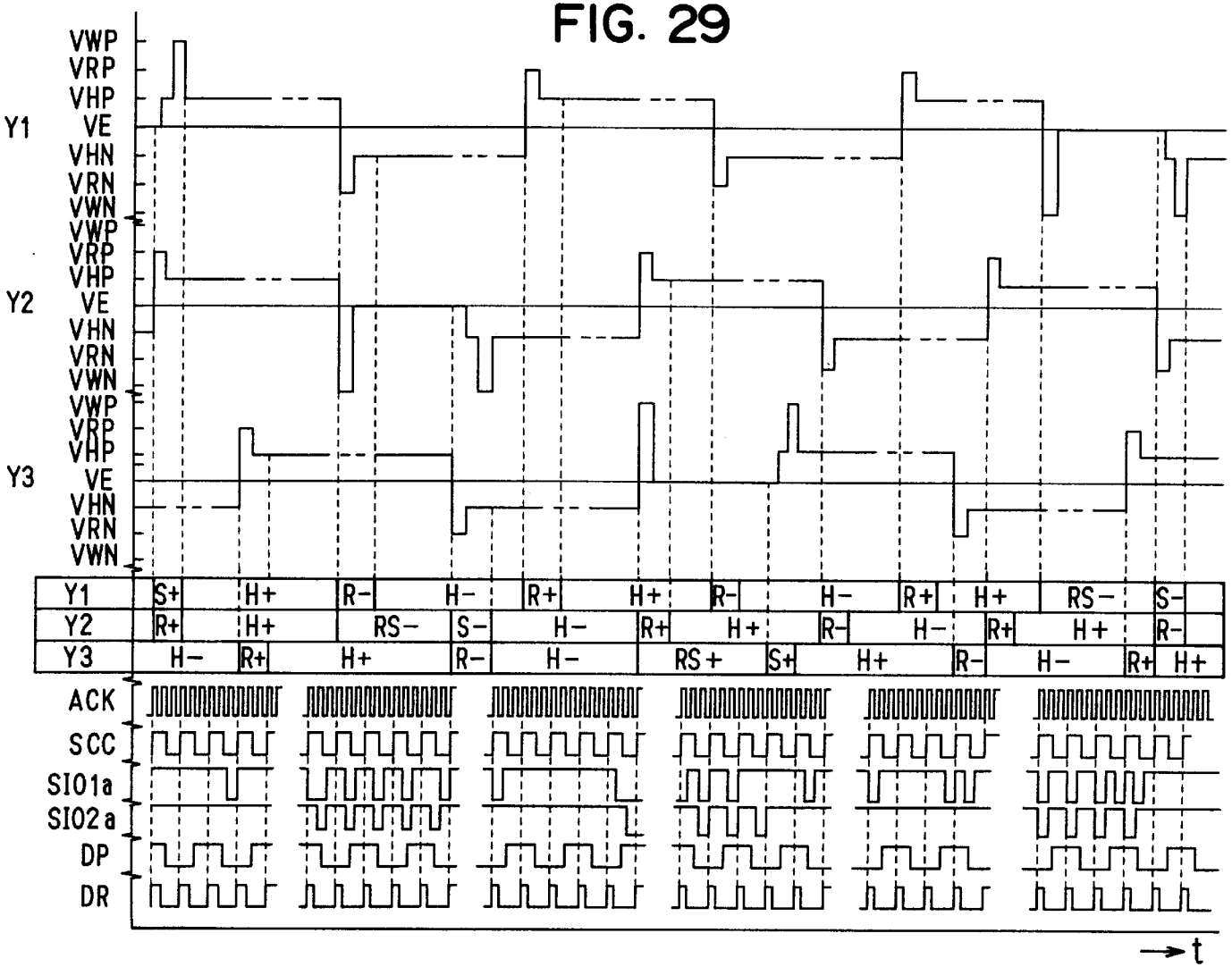
FIG. 29 is a timing chart showing operation of the scanning electrode driving circuit.

More particularly, the control circuit 40A receives a vertical synchronous signal VSYC and a horizontal synchronous signal HSYC from outside circuits and outputs signals, DP, DR, SI01*a*, SI02*a*, SCC, ACK, CL1, CL2, CL3, CL4, WEN, REN, AD1 and AD2. The signals, DP, DR, SI01*a*, SI02*a*, SCC and ACK, are fed to the scanning electrode driving circuit 60A. The CL1 and SCK signals are fed to the data electrode driving circuit 50. The signals, CL2, CL3, WEN, REN and AD1, are supplied to the frame memory circuit 20. The DP, CL4 and AD3 signals are fed to the image data conversion circuit 30. The SI01*a* and SI02*a* signals determine the states of the scanning electrodes Yn in the similar manner as in the first embodiment though their waveforms are different from those of SI01 and SI02, as shown in FIG. 29. In this second embodiment, a period when both SI01*a* and SI02*a* are L corresponds to the eliminating period, a period when SI01*a* is H and SI02*a* is L corresponds to the selecting period, a period when both SI01*a* and SI02*a* are H corresponds to the holding period, and a period when SI01*a* is L and SI02*a* is H corresponds to a refreshing period.

The scanning electrode driving circuit 60A receives seven voltages, VWP, VRP, VHP, VE, VHN, VRN, VWN, from the power source circuit 70 and selects either one from them, according to signals, DP, DR, SI01*a*, SI02*a*, ACK and SCC fed from the control circuit 40. The scanning electrode driving circuit 60A supplies respective voltages, each corresponding to the eliminating, selecting, holding or refreshing period, respectively, to the scanning electrodes Yn. The scanning electrodes Yn are scanned in the interlaced manner, jumping two electrodes in this embodiment. The polarities of the scanning voltages are alternated every selecting period to drive the scanning electrodes Yn with alternating polarities (refer to FIG. 29).

The operation of the scanning electrode driving circuit 60A will be described in reference to FIG. 29, taking the scanning electrode Y1 as an example. The selecting period is divided into three periods. In the positive selecting period (S+), the voltage VE is supplied to Y1 in the first period, the voltage VHP is supplied in the second period, and the voltage VWP is supplied in the third period. By combining those selecting voltages with the data signal voltages, image data are written on the pixels located on Y1. In the positive holding period (H+), the voltage VHP is supplied to Y1 to hold the written image data on the pixels. The refreshing period is divided into two periods. In the negative refreshing period (R−), the voltage VRN is supplied in the first period to invert the polarities while keeping the written image data. This first period coincides with a period in which a voltage VG is output from the data electrode driving circuit 50 as described later. Then, in the second period of the refreshing period (R−), the voltage VHN is supplied. In the negative holding period (H−), the voltage VHN is supplied to hold the written image data. Then, a positive refreshing period (R+) follows, in which the voltage VRP is supplied to invert the polarities while keeping the written image data in its first period and the voltage VHP is supplied in its second period. The first period in the positive refreshing period (R+) also coincides with the period in which the voltage VG is output from the data electrode driving circuit 50. Then, the positive holding period (H+) follows, in which the voltage VHP is supplied to hold the written image data.

In the negative eliminating period (RS−), the voltage VWN is supplied in its first period and then the voltage VE in its second period to eliminate the image data on all the pixels on Y1. Then, the negative selecting period (S−) follows the negative eliminating period (RS−) to drive the scanning electrode Y1 under the polarity opposite to the positive selecting period (S+). The voltage VE is applied to Y1 in the first period of the negative selecting period (S−), the voltage VHN in the second period, and the voltage VWN in the third period. By combining those selecting voltages with the data voltages, the image data is written on the pixels on Y1. In the negative holding period (H−) following the negative selecting period (S−), the voltage VHN is applied to hold the written image data.

Then, the positive refreshing period (R+), the positive holding period (H+), the negative refreshing period (R−), and the negative holding period (H−) follow in this order. In the first period of the positive eliminating period, the voltage VWP is applied, and then the voltage VE is applied to eliminate the image data written on all the pixels on the scanning electrode.

Figure 30:
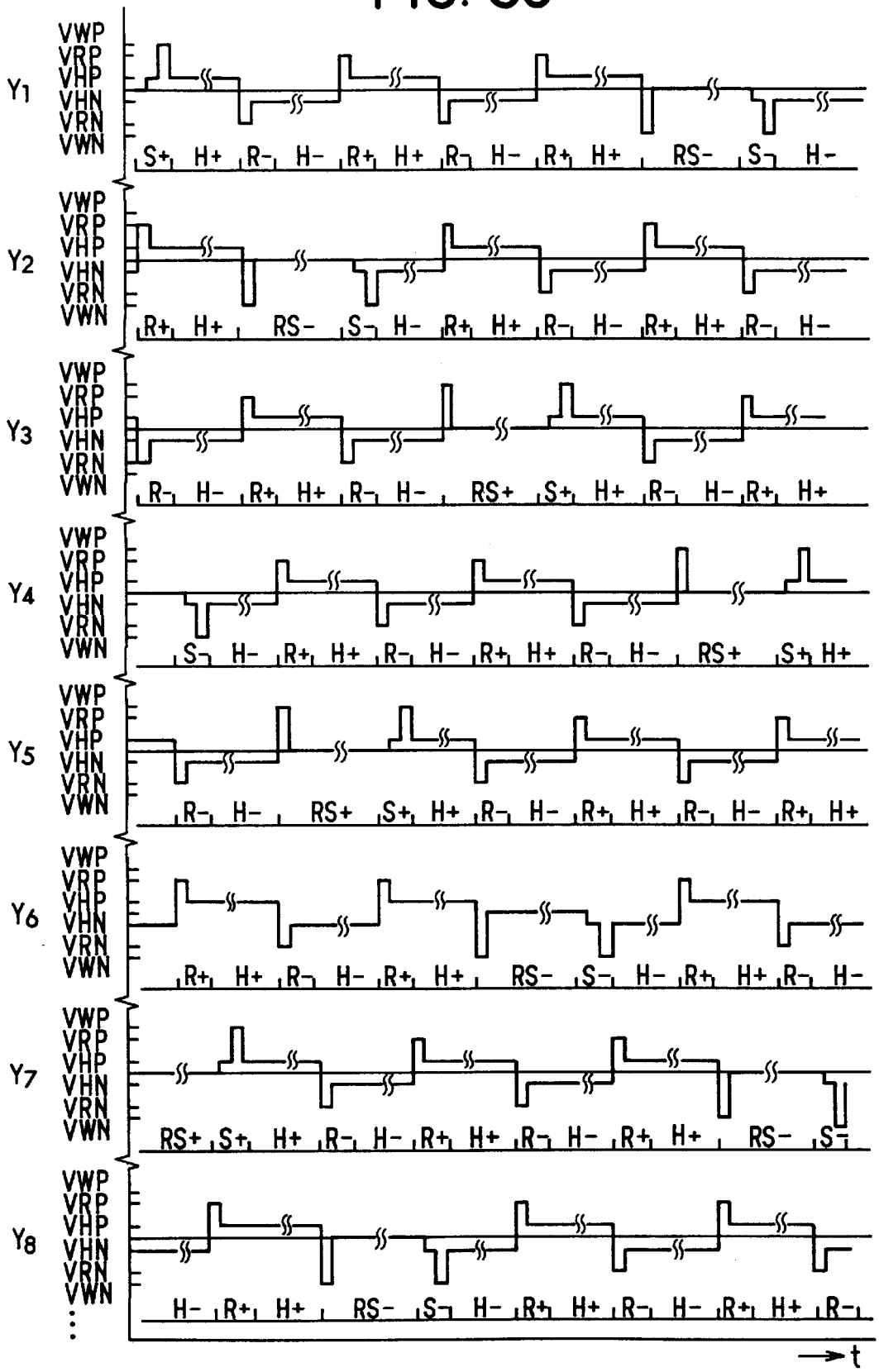
FIG. 30 is a timing chart showing interlaced scanning with two electrodes being jumped.
Figure 31:
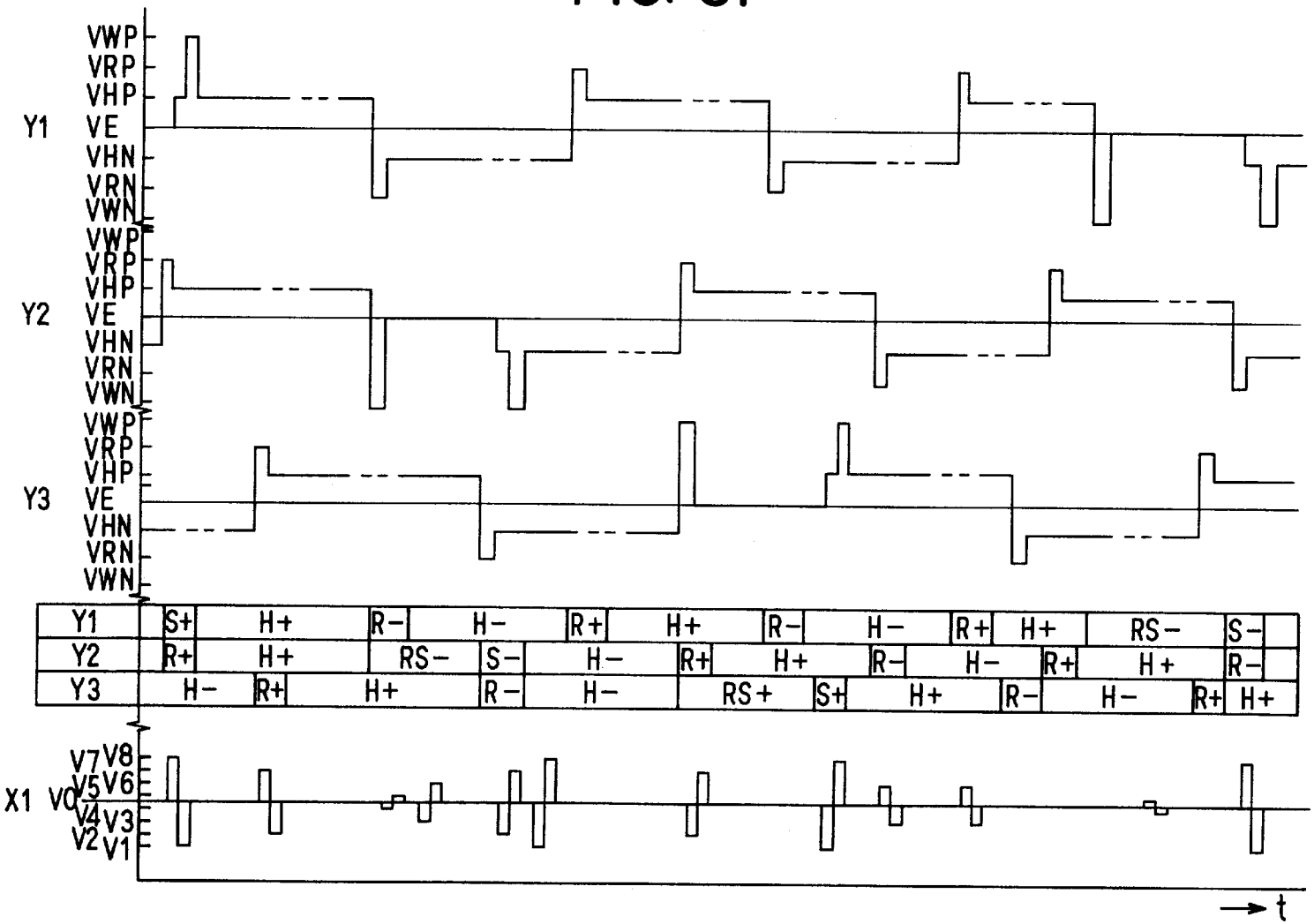
FIG. 31 is a timing chart showing operation of the scanning electrode driving circuit.

In the second embodiment, scanning is performed under the interlaced scanning with two scanning electrodes being jumped. Therefore, the scanning voltages are applied to the scanning electrodes Y1 to Y1025 in the following order: Y1, Y4, Y7 . . . and so on. The scanning voltages are shifted by a length of the selecting period electrode by electrode. The waveforms of the scanning voltages are shown in FIG. 30. After the scanning reaches the bottom of the panel, it returns to Y2 and is continued in order of: Y2, Y5, Y8 . . . and so on. Similarly, after the scanning reaches the bottom of the panel, it returns to Y3 and is continued in order of: Y3, Y6, Y9 . . . and so on. Thus, the scanning of one frame is completed. Then, the scanning for the next frame starts again from the scanning electrode Y1 with the reversed polarity. As shown in FIG. 30, the polarity of the scanning voltages are reversed electrode by electrode, i.e., positive for Y1, negative for Y2, positive for Y3 . . . and so on. This polarity reversal is employed to suppress the flicker on the display.

Figure 27:
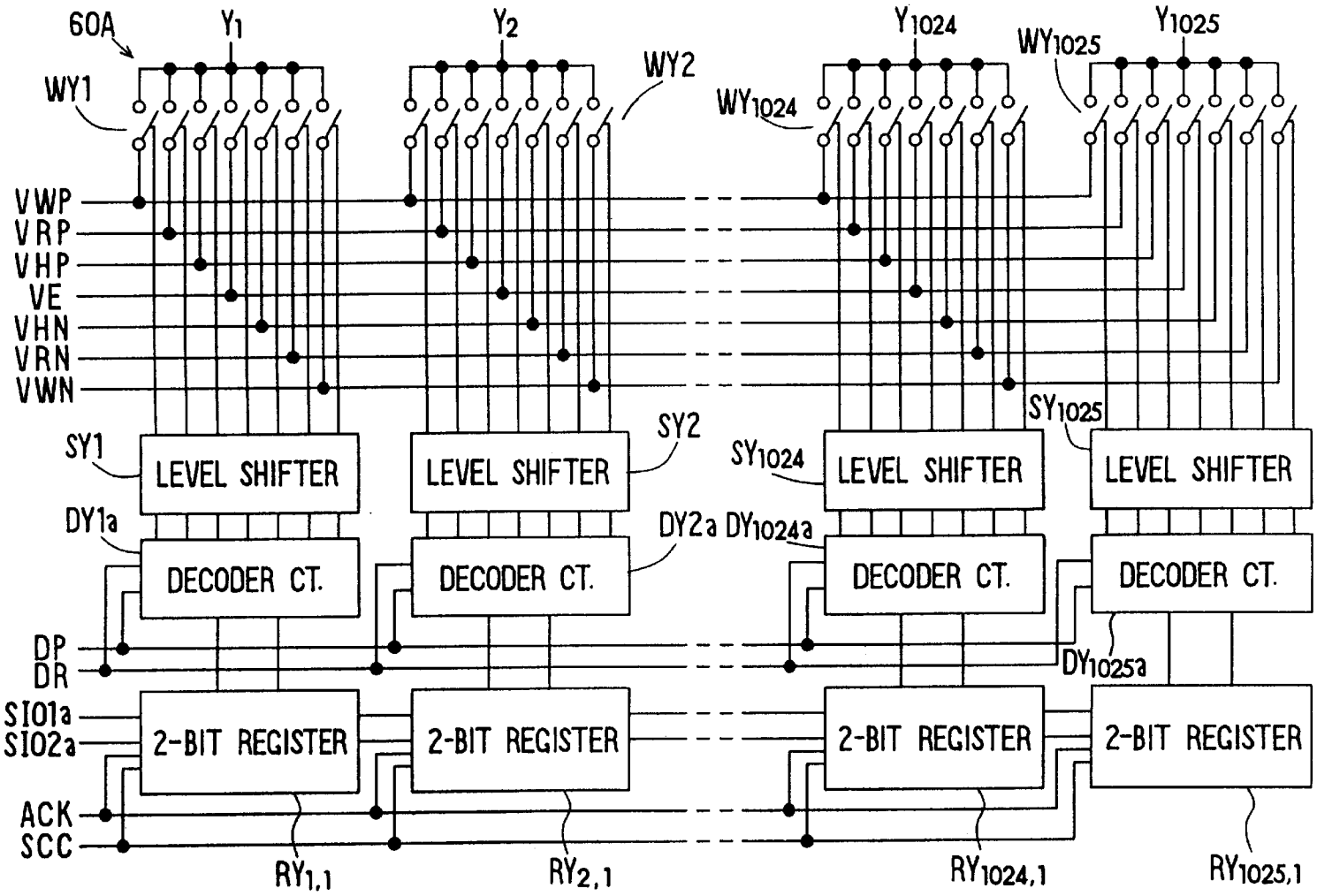
FIG. 27 is a circuit diagram showing a scanning electrode driving circuit.
Figure 28:
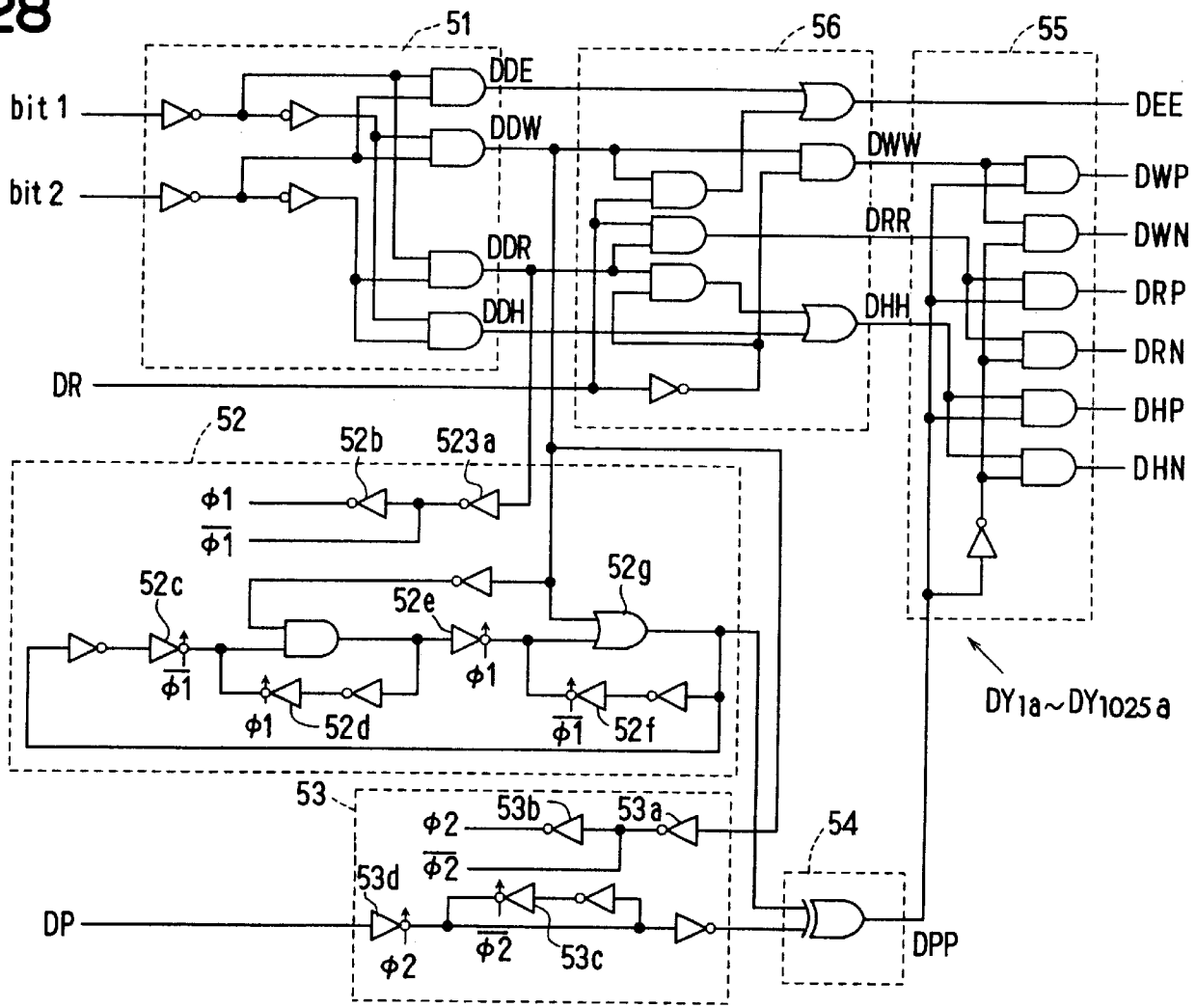
FIG. 28 is a circuit diagram showing a decoder circuit.

The structure of the scanning electrode driving circuit 60A will be described in reference to FIG. 27. Compared with the scanning electrode driving circuit 60 of the first embodiment, the SI01 and SI02 signals are replaced with the SI01*a* and SI02*a*, and the decoder circuits DY1 to DY1025 are replaced with the decoder circuits DY1*a* to DY1025*a* to which the DR signal is fed.

The 2-bit registers RY(1,1) to RY(1025,1) sequentially receive the SI01*a* and SI02*a* signals in synchronism with the rising of the ACK signal and output 2-bit data (bit-1 and bit-2) to the decoder circuits DY1*a* to DY1025*a* in synchronism with the rising of the SCC signal. The decoder circuits DY1*a* to DY1025*a* formulate seven signals for switching the analog switches WY1 to WY1025, based on the 2-bit data fed from the 2-bit registers RY(1,1) to RY(1025,1), and the first DP signal and the DR signal. The decoder circuits DY1*a* to DY1025*a* slightly modified from those used in the first embodiment will be described in reference to FIG. 28, taking the DY1*a* as an example. An additional logic circuit 56 is connected between the logic circuit 51 and the logic circuit 55. The logic circuit 51 operates in the same manner as in the first embodiment. Namely, only the DDE signal becomes H in the eliminating period (both SI01*a* and SI02*a* are L), only the DDW signal becomes H in the selecting period (SI01*a* is H and SI02*a* is L), only the DDR signal becomes H in the refreshing period (SI01*a* is L and SI02*a* is H), and only the DDH signal becomes H in the holding period (both SI01*a* and SI02*a* are H).

The logic circuit 56 outputs signals, DEE, DWW, DRR and DHH, by controlling signals generated in the logic circuit 51 in relation to SI01*a* and SI02*a* signals based on the DR signal. Namely, only DEE becomes H when DDE is H, only DEE becomes H when DDW is H and DR is H, only DWW becomes H when DDW is H and DR is L, only DRR becomes H when DDR is H and DR is H, only DHH becomes H when DDR is H and DR is L, and only DHH becomes H when DDH is H.

The logic circuits 52 and 54 are the same as those of the first embodiment. The logic circuit 55 switches voltage polarities based on the signals from the logic circuit 56 and the DPP signal from the logic circuit 54. Namely, DWP becomes H when DWW is H and DPP is H, DWN becomes H when DWW is H and DPP is L, DRP becomes H when DRR is H and DPP is H, DRN becomes H when DRR is H and DPP is L, DHP becomes H when DHH is H and DPP is H, and DHN becomes H when DHH is H and DPP is L. The scanning voltages shown in FIG. 29 are thus formulated and supplied to the scanning electrodes Yn according to the signals, ACK, SCC, SI01*a*, SI02*a*, the first DP and DR. Since three pulses of the ACK signal correspond to one pulse of the SCC signal, the selecting voltages are supplied in the interlaced manner with two scanning electrodes being jumped according to the SI01*a* and SI02*a* signals. As a result, the scanning voltages are supplied to each scanning electrode at the timing shown in FIG. 30.

The data electrode driving circuit 50 is controlled by the control circuit 40A with which the control circuit 40 of the first embodiment is replaced. In the first embodiment, two pulses each having the same amplitude and the opposite polarity are supplied to the data electrodes in the selecting period of one horizontal display line. In the second embodiment, three pulses are supplied in the selecting period of one horizontal display line. In the period of the first pulse, the voltage VE is supplied to the data electrodes and two pulses each having the same amplitude representing the image data and having the opposite polarity are supplied to the data electrodes in the periods of the second and third pulses. The AD2 signal fed from the control circuit 40A is different from that fed from the control circuit 40 of the first embodiment. That is, data D(0,0), D(1,0), D(2,0) . . . D(1279,0), D(1280,0) expressed in the hexadecimal number are output in the period of the first pulse. In the periods of the second and third pulses, data representing the respective image data signals are output.

Figure 24:
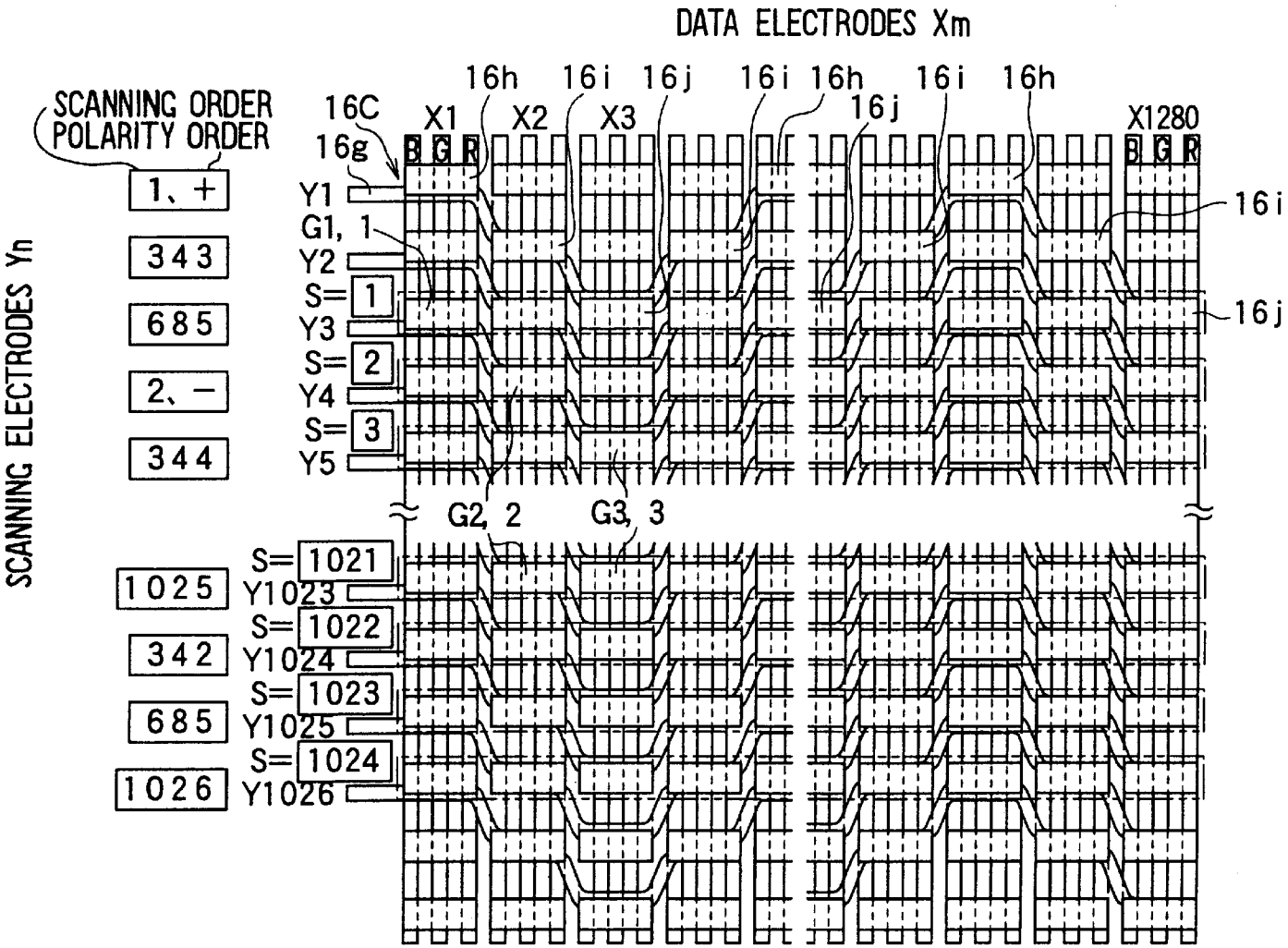
FIG. 24 is a diagram showing an layout of scanning and data electrodes together with a scanning order and a polarity order.

Referring to FIG. 24, the structure of the scanning and data electrodes in the second embodiment will be described, taking one scanning electrode as an example. The scanning electrode is formed by the transparent conductive layer 16C and includes a common connecting portion 16*g* and rectangular electrode portions 16*h*, 16*i* and 16*j* each projected from the common connecting portion 16*g*. The electrode portion 16*h* is projected upward from the common connecting portion 16*g*, the electrode portion 16*i* is projected both upward and downward from the common connecting portion 16*g*, and the electrode portion 16*j* is projected downward from the common connecting portion 16*g*. Referring to Y3 shown in FIG. 24, the electrode portion 16*h* is located to cover the three stripes of the data electrode X1 on the horizontal display line S1 and corresponds to the pixel G(1,1). The electrode portion 16*i* is located to cover the data electrode X2 on the horizontal display line S2 and corresponds to the pixel G(2,2). The electrode portion 16*j* is located to cover the data electrode X3 on the horizontal display line S3 and corresponds to the pixel G(3,3). This arrangement of the electrode portions 16*h*, 16*i* and 16*j* is repeated to cover all the data electrodes X1 to X1280. In other words, the scanning electrode Y3 runs downward with a slanted angle to cover three pixels G(1,1), G(2,2) and G(3,3) and runs upward with the same slanted angle to cover two pixels G(4,2) and G(5,1). Other scanning electrodes Yn are arranged in the same manner as Y3, so that they run on the panel in a zigzag manner.

The image data are written in the frame memory circuit 20 in the order shown in FIG. 25. The image data D(i,j) are written in each line memory in the image data conversion circuit 30 and read out therefrom in the order shown in FIG. 26. That is, the image data are read out in the following order: D(1,0), D(2,0), D(3,1), D(4,0), D(5,0), D(6,0), D(7,1), D(8,0) . . . D(1279,0), D(1280,1); D(1,2), D(2,3), D(3,4), D(4,3), D(5,2), D(6,3), D(7,4), D(8,3) . . . D(1279,3), D(1280,4); D(1,5), D(2,6), D(3,7), D(4,6), D(5,5), D(6,6), D(7,7), D(8,6) . . . D(1279,6), D(1280,7); D(1,1024), D(2,1025), D(3,1025), D(4,1025), D(5,1024), D(6,1625), D(7,1025), D(8,1025) . . . D(1279,1025), D(1280,1025). The image data thus read out are converted into analog signals having predetermined amplitudes through the D-A converters 31*b*, 31*b* and 33*b*, in the same manner as in the first embodiment. Then, those analog signals are output to the data electrode driving circuit 50 through the analog switches 31*c*, 32*c* and 33*c*. Other operations are the same as those in the first embodiment.

The operation of the second embodiment will be further explained as to a particular example designed as follows. A frame-display frequency: 20 Hz (a time period for displaying one frame is 50 ms); the number of the scanning electrodes: 1024; the number of the data electrodes: 3840; a scanning duty: 1/N (N=512); and a reset period: R (R=12). The voltages imposed on the pixels are composed of voltages in the selecting period (S+ or S−), the refreshing period (R+ or R−), the holding period (H+ or H−), and the eliminating period (RS+ or RS−), as shown in FIG. 29. The polarities in the refreshing and holding periods are alternated with a frequency higher than 30 Hz. Every time the polarities are alternated, the refreshing voltage, VRP or VRN, is supplied to recover brightness of the pixels.

In the positive selecting period (S+), the voltage VE having a pulse width t1 (t1=32.6 μs), the voltage VHP having a pulse width t2 (t2=32.6 μs) and the voltage VWP having a pulse width t2 are supplied in this order. In the positive holding period (H+) following the positive selecting period (S+), the holding voltage VHP is supplied. In the negative refreshing period (R−) that starts 9.7 ms (=99H) after the beginning of the positive selecting period (S+), the refresh voltage VRN having a pulse width t1 and the voltage VHN having a pulse width (2×t2) are supplied. In the negative holding period (H−) which ends at a time 9.7 ms (=99H) lapses counting from the beginning of the negative refreshing period (R−), the holding voltage VHN is supplied. 1H means a time period for scanning one scanning electrode, and it is 9.7/99 ms in this particular example. Similarly, in the positive refreshing period (R+), the voltage VRP having a pulse width t1 and the voltage VHP having a pulse width (2×t2) are supplied. In the positive holding period (H+) which ends at a time 9.7 ms (=99H) lapses counting from the beginning of the positive refreshing period (R+), the holding voltage VHP is supplied. Thereafter, the refreshing voltage and the holding voltaqe are supplied to the scanning electrode, the polarities being alternated every 9.8 ms, up to the $P^{th}$ (P=5) holding period that ends (N−R)×(t1+2×t2) after the positive selecting period (S+) has started. Then, the negative eliminating period (RS−) follows, in which the negative eliminating voltage VWN having a pulse width t1 is supplied and then the voltage VE is supplied for a time period of {R×(t1+2×t2)−t1}. The positive field described above is followed by a negative field that is composed of the same periods as in the positive field but the polarity of all the voltages are reversed.

Figure 33A:
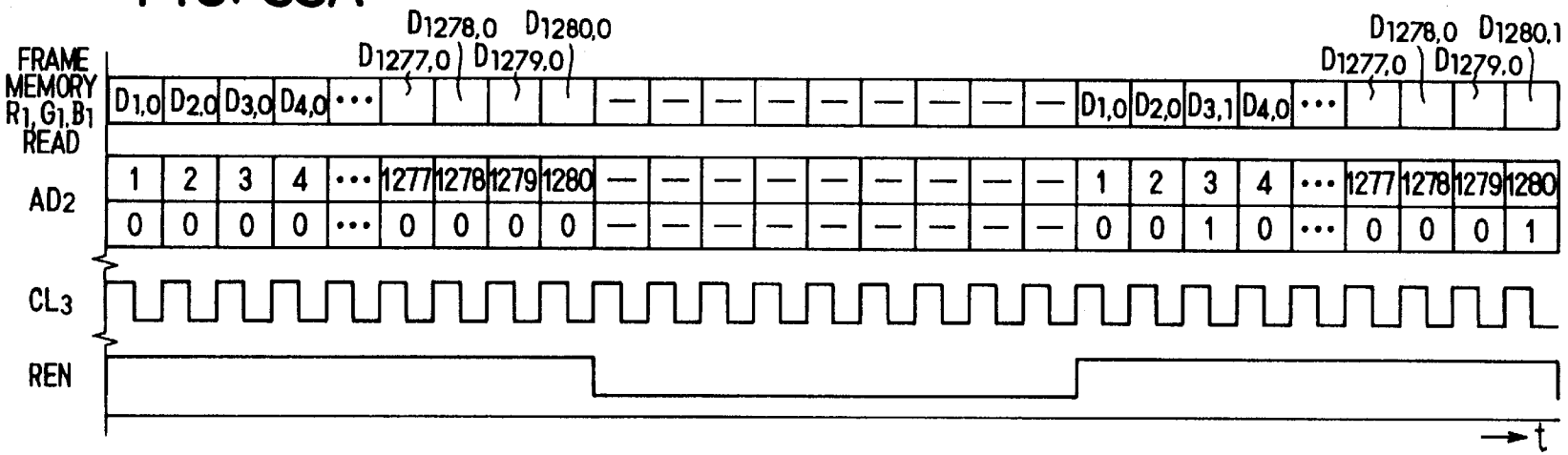
FIGS. 33A, 33B and 33C are timing charts showing data to be read out from a frame memory.
Figure 33B:
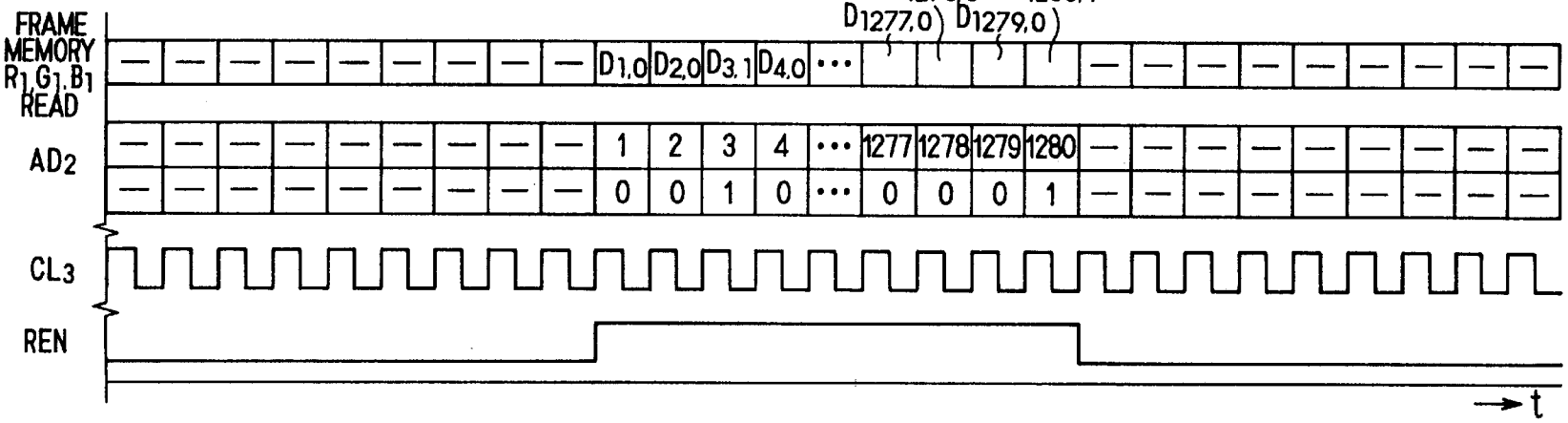
Figure 33C:
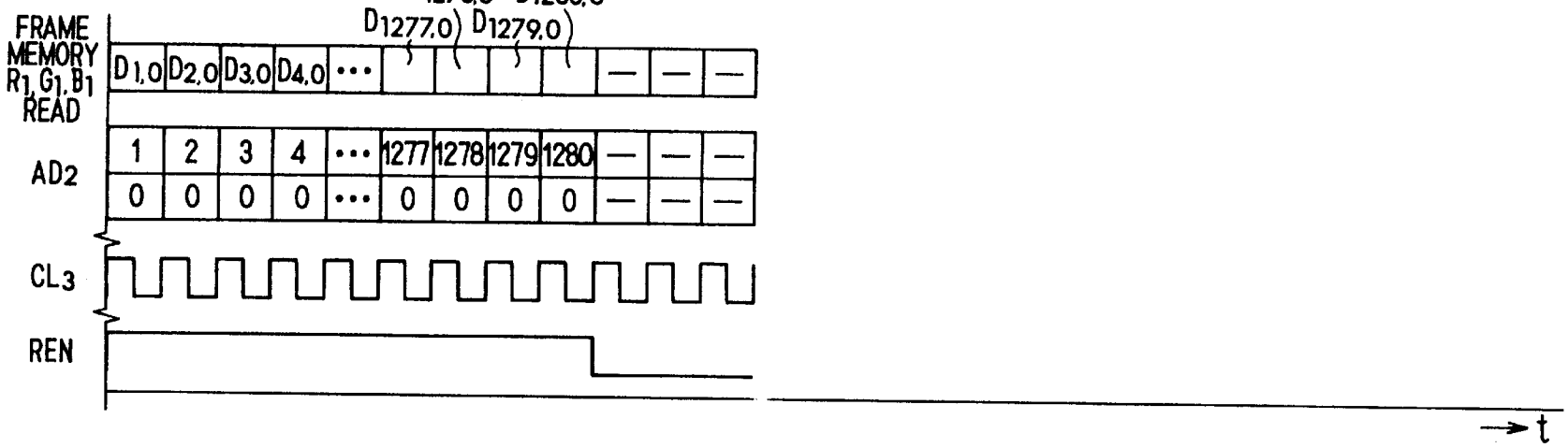
Figure 34A:
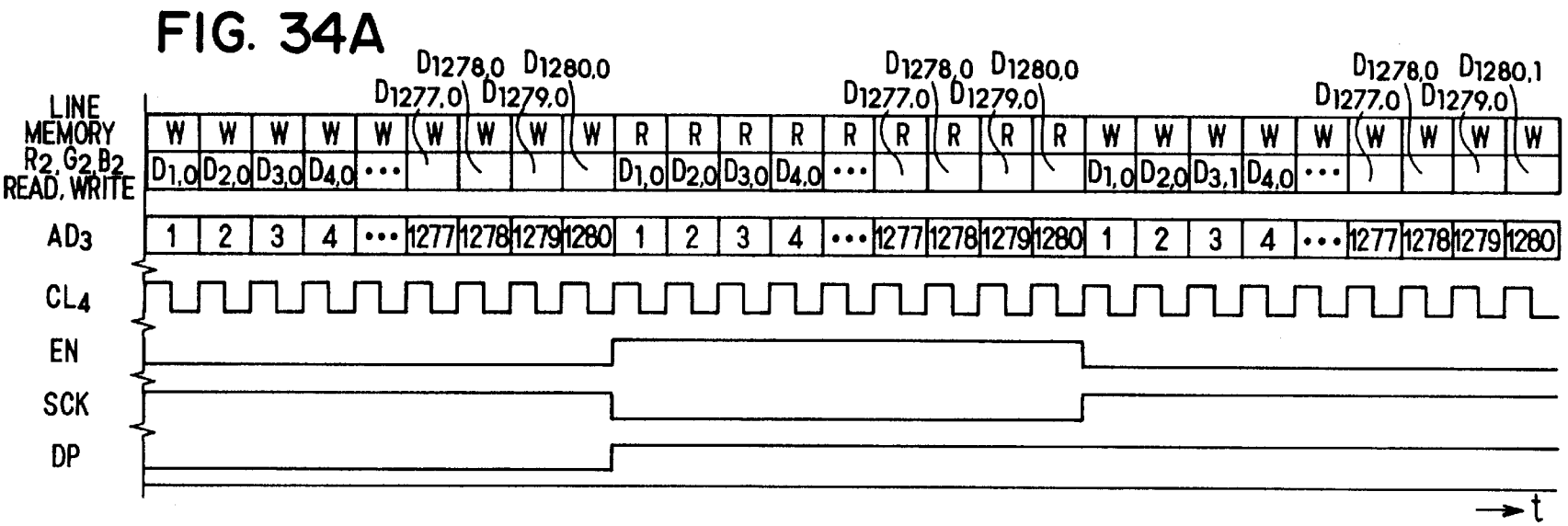
FIGS. 34A, 34B and 34C are timing charts showing data to be written in or read out from line memories of an image data conversion circuit.
Figure 34B:
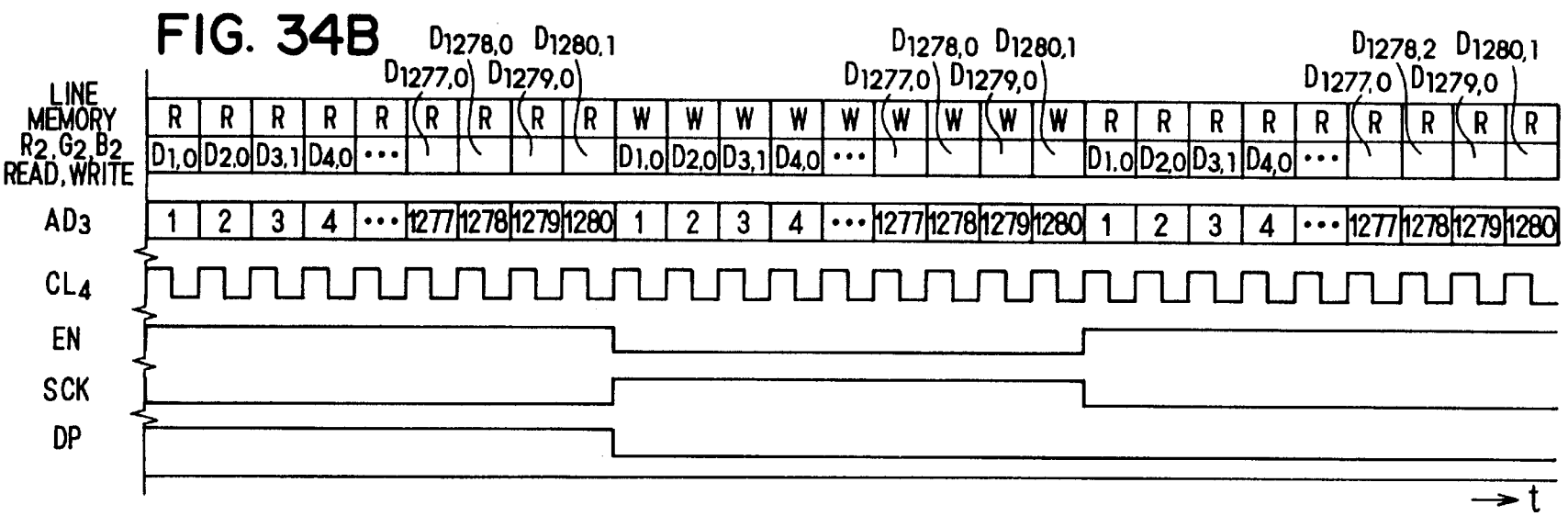
Figure 34C:
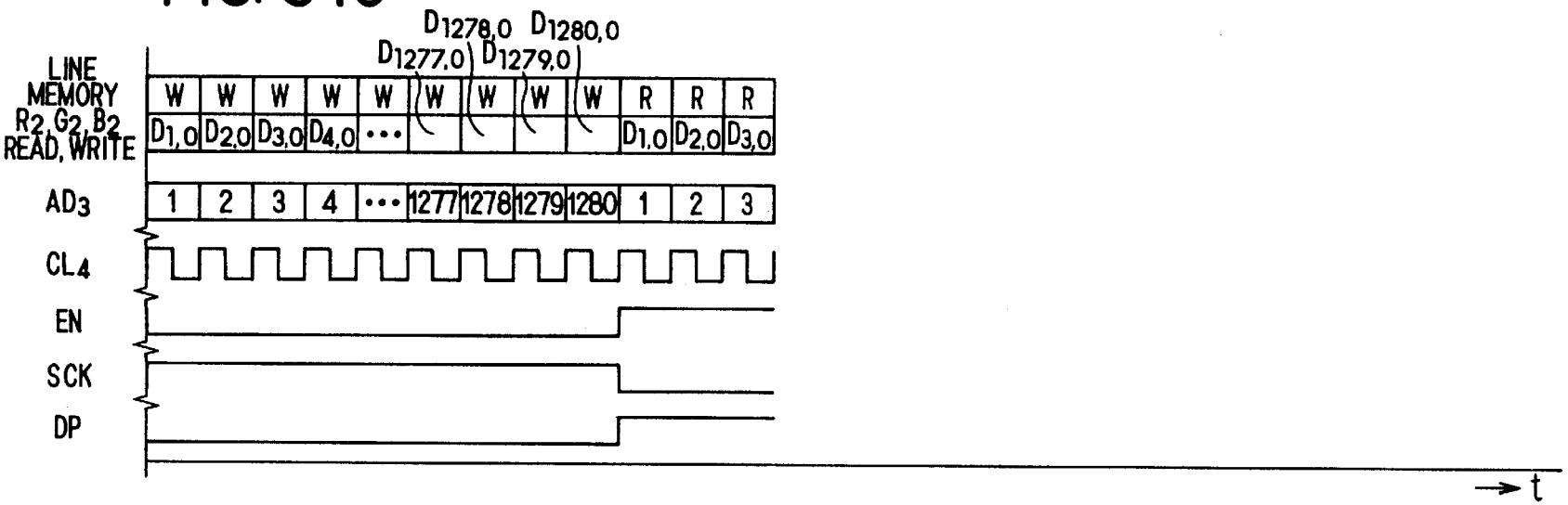
Figure 35:
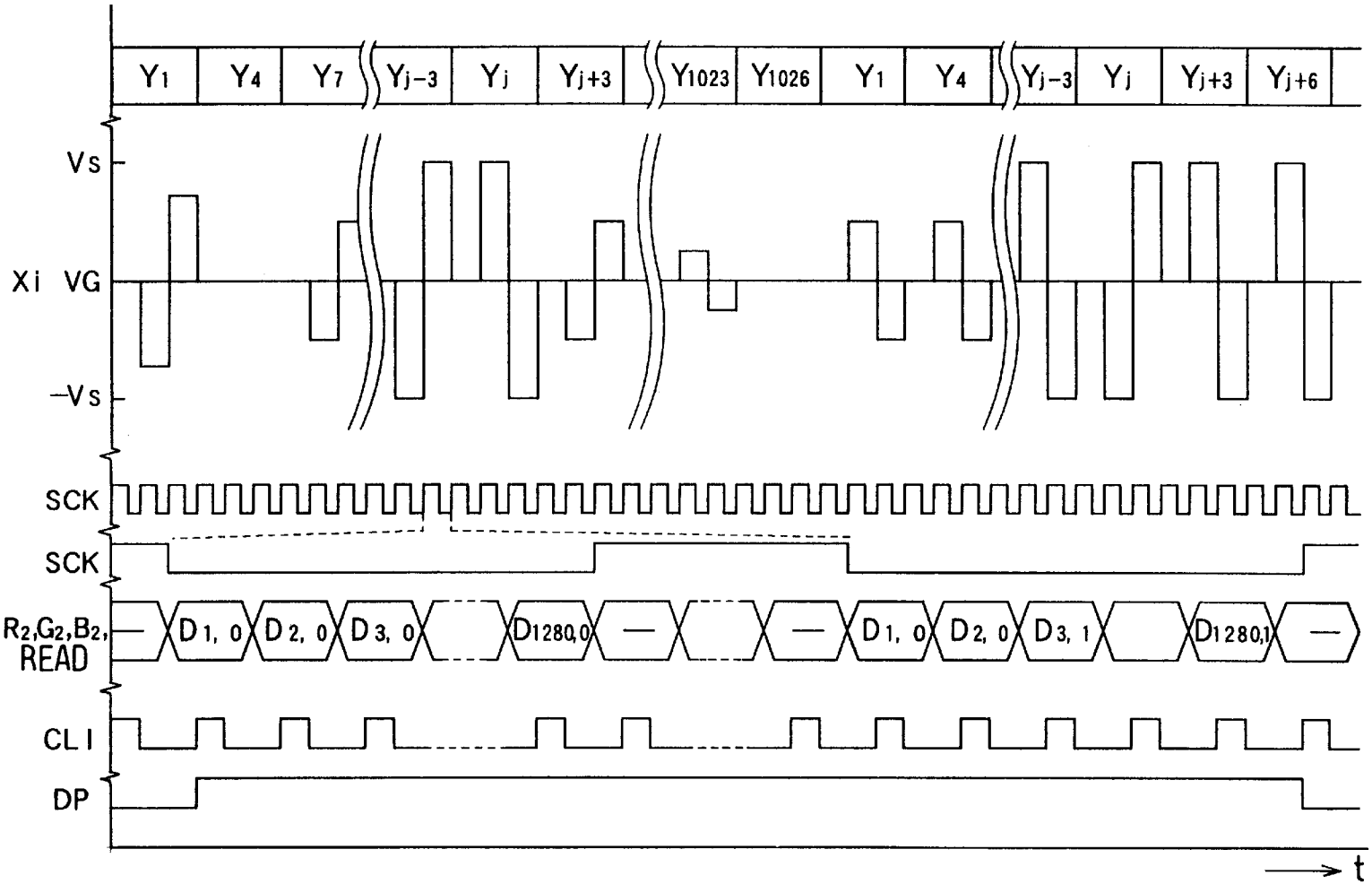
FIG. 35 is a timing chart showing waveforms of data electrode driving circuit.

The data signal voltage is composed of three pulses having t1, t2 and t3 pulse width, respectively, so that the data signal voltage structure corresponds to the selecting period divided into three periods. For formulating the three pulses, the SCK signal that is different from that of the first embodiment is used in the second embodiment. The timing for reading out the data from the frame memory circuit 20 is shown in FIGS. 33A–33C, and the timing for writing in or reading out the data from the line memories of the image data conversion circuit 30 is shown in FIGS. 34A–34C. In the second embodiment, three pulses of the SCK signal are imposed every time one pulse of the SCC signal is supplied. The data electrode driving circuit 50 operates in the similar manner as that of the first embodiment, as shown in FIG. 35. It reads out the data from the line memories in synchronism with the clock signal CL1 and temporarily holds them, and supplies the data to the data electrodes in synchronism with the rising of the SCK signal.

To display a bright image in the first field, the voltage VG having a pulse width t1, a voltage Vs having a pulse width t2 and a voltage −Vs having a pulse width t2 are supplied in this order to a data electrode. To display a dark image in the first field, the voltage VG having a pulse width t1, the voltage −Vs having a pulse width t2 and the voltage Vs having a pulse width t2 are supplied in this order to a data electrode. To display a bright image in the second field, the voltage VG having a pulse width t1, a voltage −Vs having a pulse width t2 and a voltage Vs having a pulse width t2 are supplied in this order to a data electrode. To display a dark image in the second field, the voltage VG having a pulse width t1, the voltage Vs having a pulse width t2 and the voltage −Vs having a pulse width t2 are supplied in this order to a data electrode. By combing the image data described above with the voltages in the selecting period, the state of the image to be displayed is determined.

To display an image having an intermediate brightness, an intermediate voltage between Vs and −Vs is supplied. The refreshing voltage described above is supplied to the scanning electrode in synchronism with a period in which the data voltage is VG. Accordingly, the refreshing voltage VRP or VRN is always imposed on the pixel in the refreshing period not depending on the level of the data voltages. Therefore, the image on the pixel to be refreshed is not affected by images on other pixels and is maintained at the same brightness with the polarity being reversed. A voltage which corresponds to a center level of amplitude variation of the data signals may be used in place of the voltage VG.

The eliminating period in the example described above is set to 1.2 ms (=12H). Generally, the brightness of displayed images change, in the eliminating period, from bright to dark, or from intermediate to dark. The degree of the brightness change is about 2% of an average brightness in one field. If the panel is sequentially scanned, this brightness change is visible as a flicker of 20 Hz. Since the panel is scanned, in this embodiment, under the interlaced scanning with two electrodes being jumped, the frequency of brightness change due to the elimination period is increased to 60 Hz. Accordingly, the flicker is invisible in this embodiment.

Figure 32A:
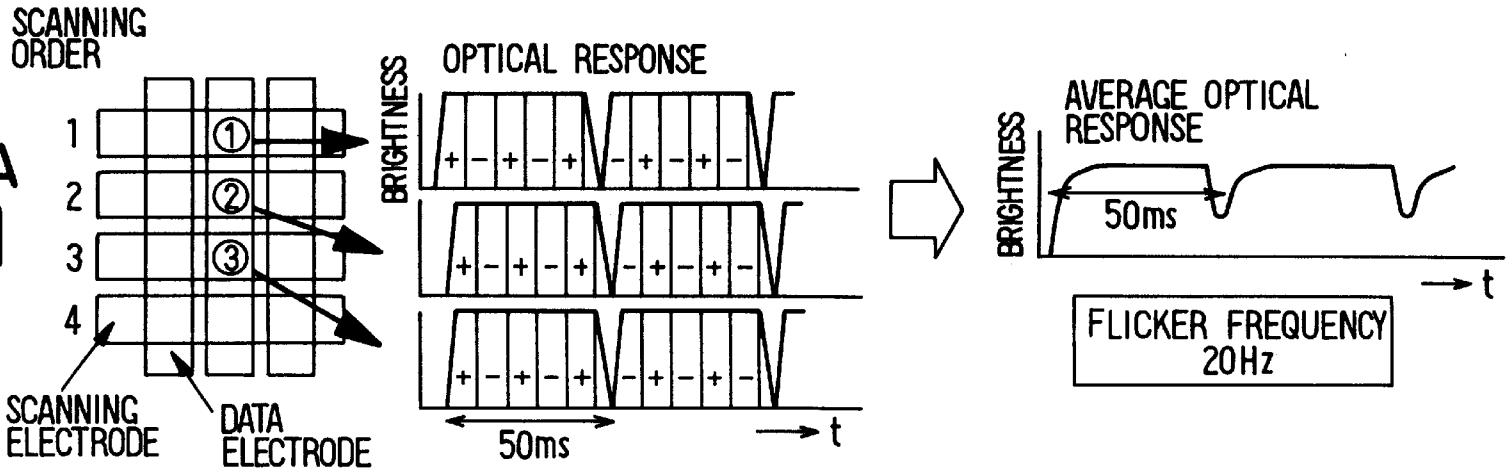
FIG. 32A is a chart showing optical responses of three pixels and their average optical response under sequential scanning.
Figure 32B:
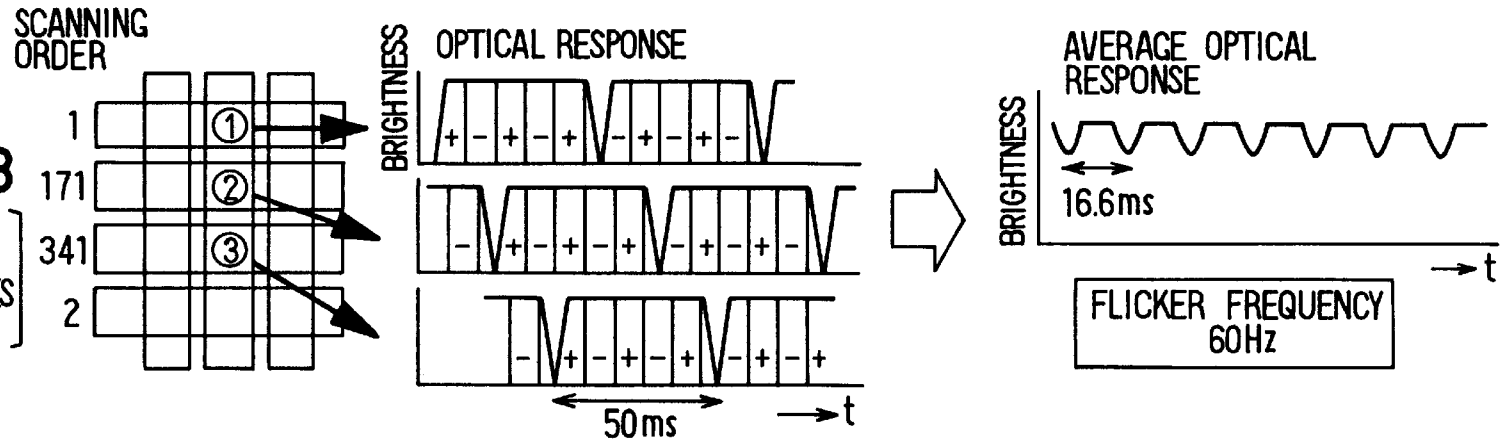
FIG. 32B is a chart showing optical responses of three pixels and their average optical response under interlaced scanning with two electrodes being jumped.

More particularly, the brightness changes of the pixels are explained in FIGS. 32A and 32B. As shown in FIG. 32A, if the panel is scanned under the conventional sequential scanning, an average brightness of three neighboring pixels changes with a frequency of 20 Hz that is the same as the frame frequency and visible as a flicker. In contrast, as illustrated in FIG. 32B, the frequency of the average brightness change in the present embodiment is 60 Hz that is three times of the frame frequency and is not visible. This is because the brightness of three pixels, i.e., a pixel on the first scanning line, a pixel on the $171^{st}$ scanning line and a pixel on the $341^{st}$ scanning line, is averaged, as illustrated in FIG. 32B. Moreover, since the polarities of the scanning voltage are alternated with a high frequency in the holding period, the flicker due to the spectral transparency difference between the positive and negative ferroelectric states of the liquid crystal appearing when viewed with a slanted angle is also suppressed.

In the second embodiment of the present invention, the display flicker and the line-scroll are made invisible, and thereby the display quality is greatly improved. Also, a high contrast higher than 40 is realized at 40° C. Though the interlaced scanning is performed by jumping two electrodes in the second embodiment, it is possible to increase the number of electrodes to be jumped to further reduce the flicker. The optimum number of the electrodes to be jumped may be determined according to the frame frequency or the number of the refreshing periods.

Third Embodiment

A third embodiment of the present invention will be described in reference to FIGS. 36–45. In this embodiment, the flicker due to the spectral transparency difference between positive and negative states of the antiferroelectric liquid crystal, the spectral transparency difference being recognized when the panel is viewed with a slanted angle, and the line-scroll are all made invisible. The structure of the scanning and data electrodes is the same as that of the first embodiment, but the panel is sequentially scanned with a higher frequency.

Figure 36:
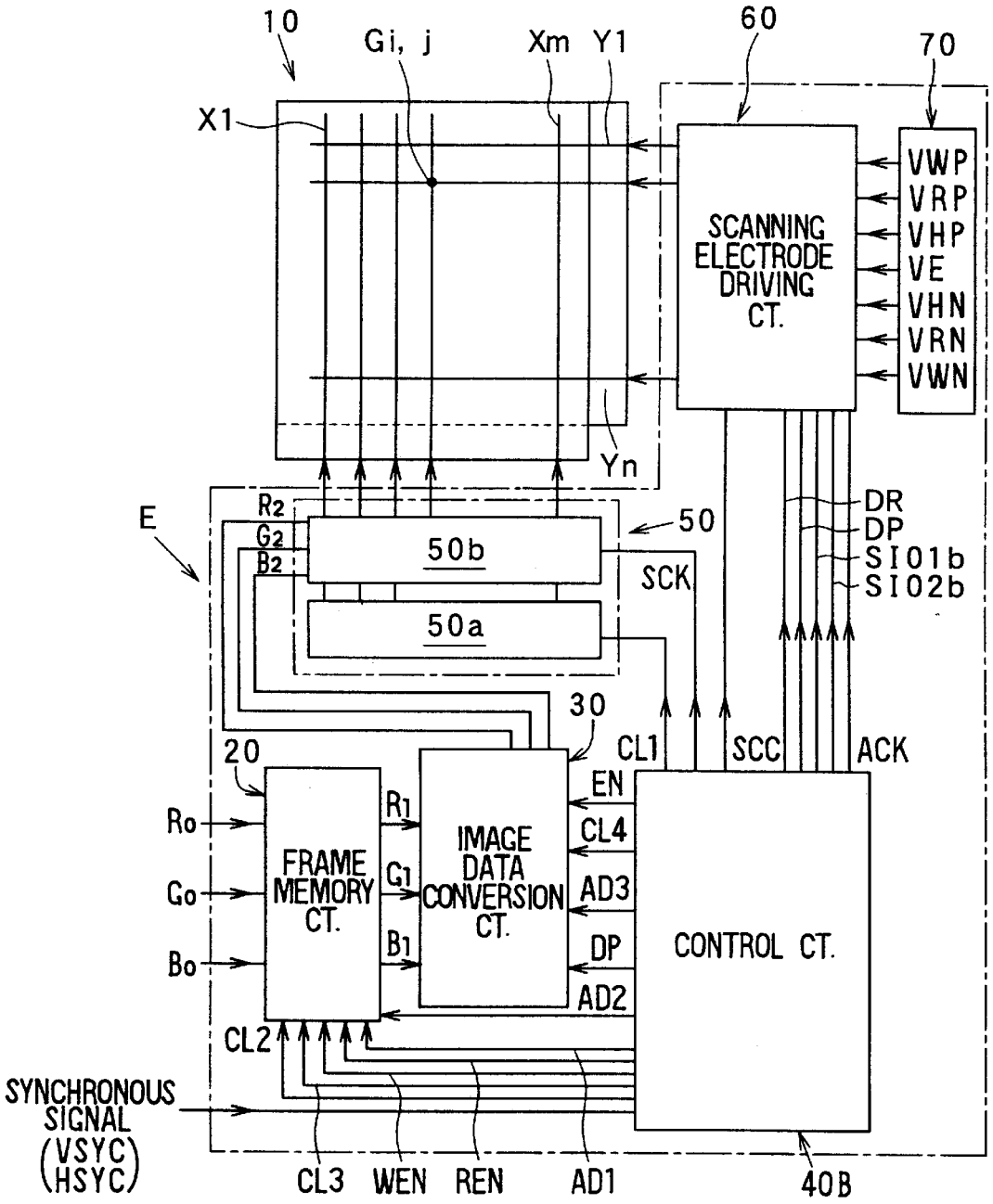
FIG. 36 is a block diagram showing a matrix-display device as a third embodiment of the present invention, details of which are shown in the following drawings, FIGS. 37–45.
Figure 43:
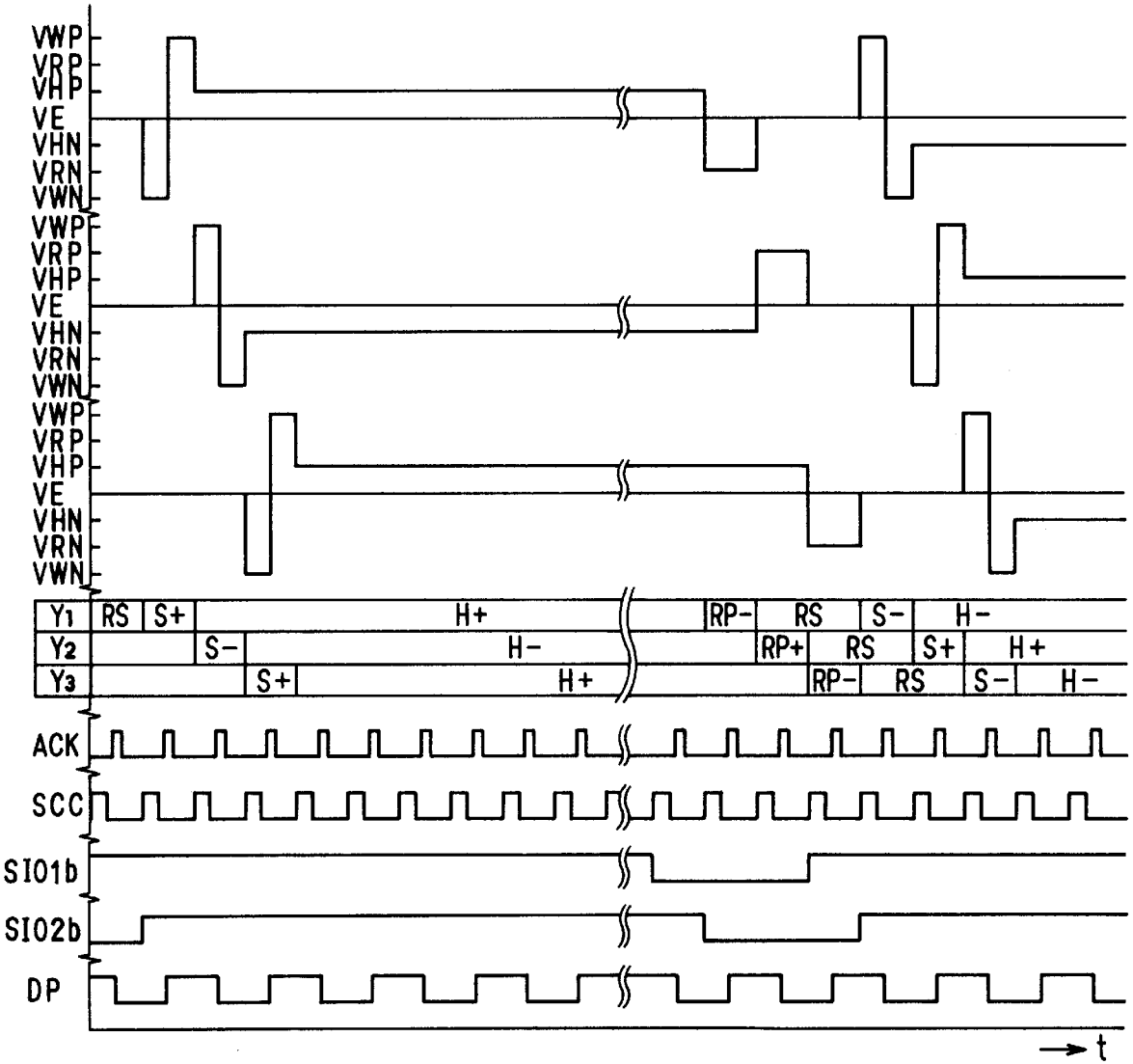
FIG. 43 is a timing chart showing operation of the scanning electrode driving circuit.

As shown in FIG. 36, the control circuit 40 of the first embodiment is replaced with a control circuit 40B which outputs SI01*b* and SI01*b* signals in place of SI01 and SI02 signals (refer to FIG. 43). The control circuit 40B receives the VSYC and VHYC signals from outside circuits and outputs following signals: a first DP, a second DP, SI01*b*, SI01*b*, SCC, SCK, ACK, CL1, CL2, CL3, CL4, WEN, REN, AD1, and AD2. The first DP, DR, SI01*b*, SI01*b*, SCC and ACK signals are fed to the scanning electrode driving circuit 60. The CL1 and the SCK signals are fed to the data electrode driving circuit 50. The signals, CL2, CL3, WEN, REN and AD1, are fed to the frame memory circuit 20. The second DP, CL4 and AD3 signals are fed to the image data conversion circuit 30.

The SI01*b* and SI01*b*, waveforms of which are different from those of SI01 and SI02 as shown in FIG. 43, determine the states of the scanning electrodes Yn. That is, according to the levels, H or L, of those signals, the scanning electrodes Yn are brought into respective states, i.e., the eliminating, selecting, holding and eliminating voltage imposition periods.

The scanning electrode driving circuit 60 operates in the same manner as in the first embodiment. It receives the signals, the first DP, DR, ACK, SCC, SI01*b* and SI01*b*, from the control circuit 40B, and selects voltages from the voltages VWP, VRP, VHP, VE, VHN, VRN and VWN supplied from the power source circuit 70, based on the received signals. The selected voltages are supplied to the scanning electrodes Yn according to the states of the scanning electrodes. The panel 10 is sequentially scanned in this embodiment, and the polarities of the scanning voltages are alternated electrode by electrode (refer to FIGS. 37 and 43).

Figure 37:
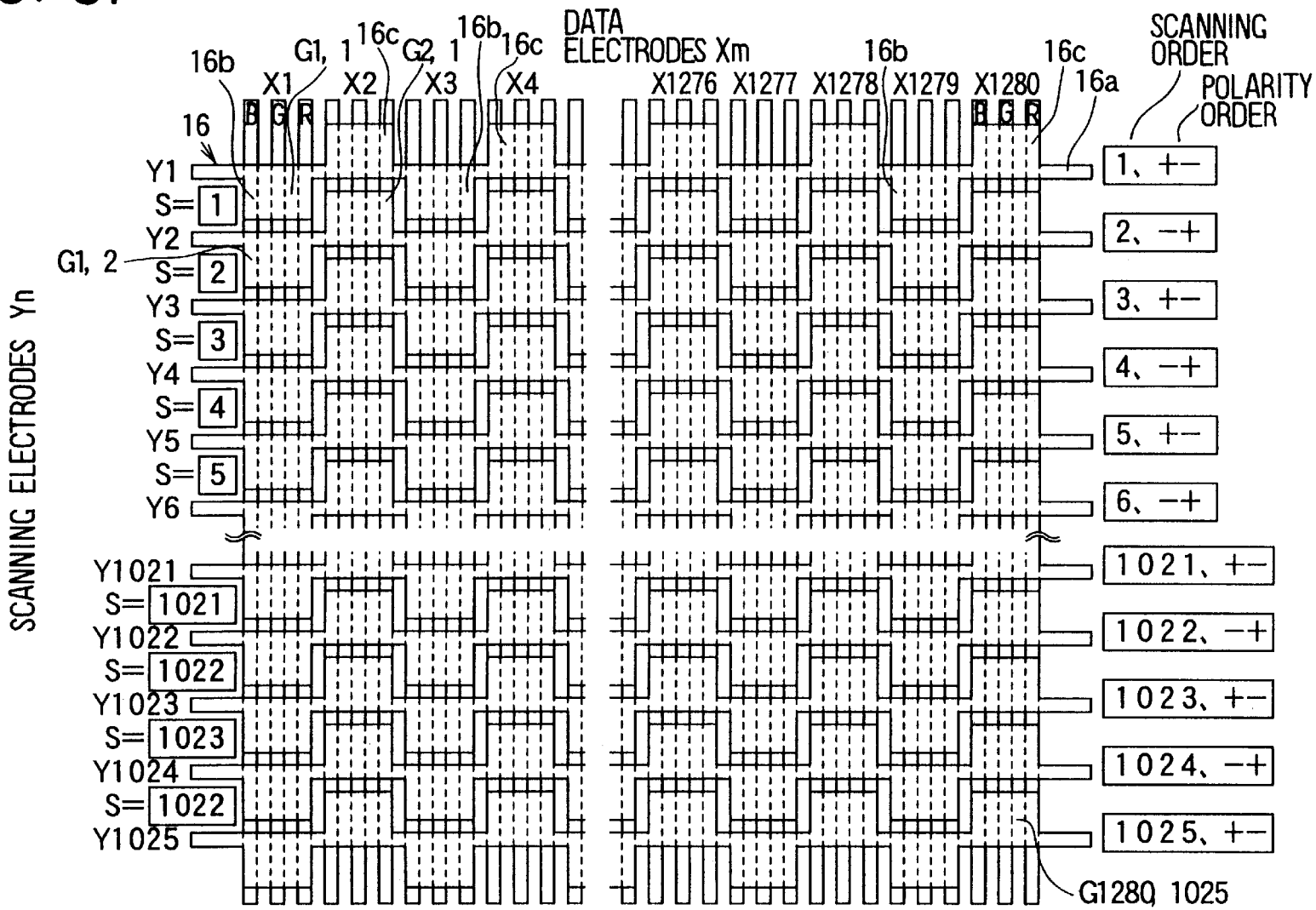
FIG. 37 is a diagram showing a layout of scanning and data electrodes together with a scanning order and a polarity order.
Figure 40A:
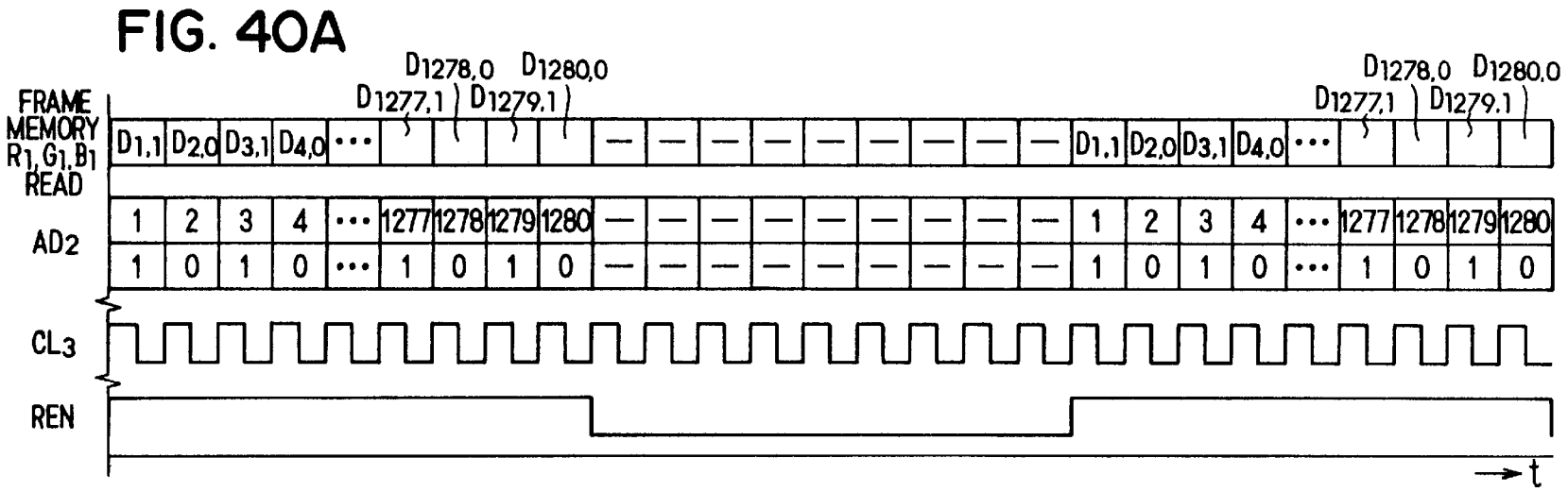
FIGS. 40A, 40B and 40C are timing charts showing data to be read out from the frame memory circuit.
Figure 40B:
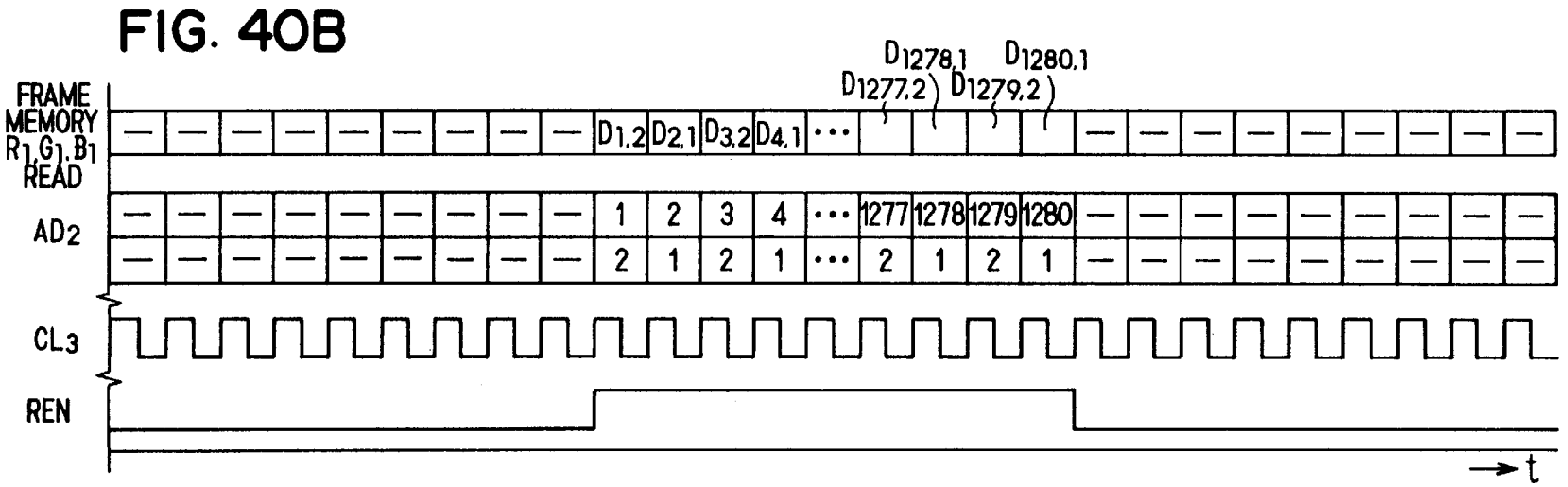
Figure 40C:
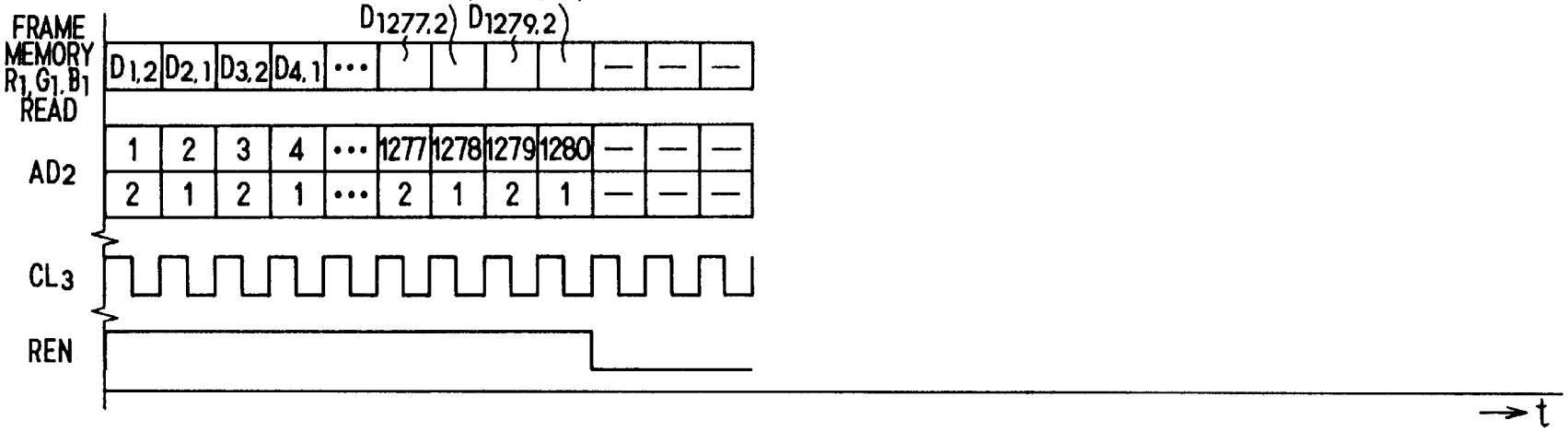
Figure 41A:
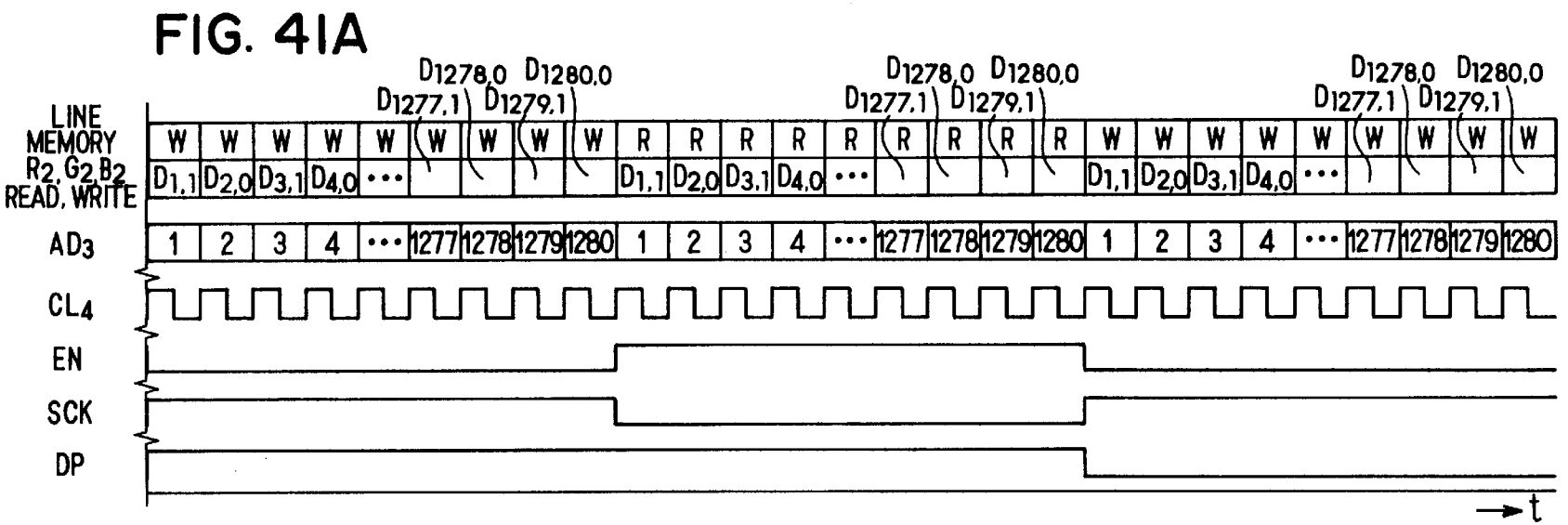
FIGS. 41A, 41B and 41C are timing charts showing data to be written in or read out from line memories of the image data conversion circuit.
Figure 41B:
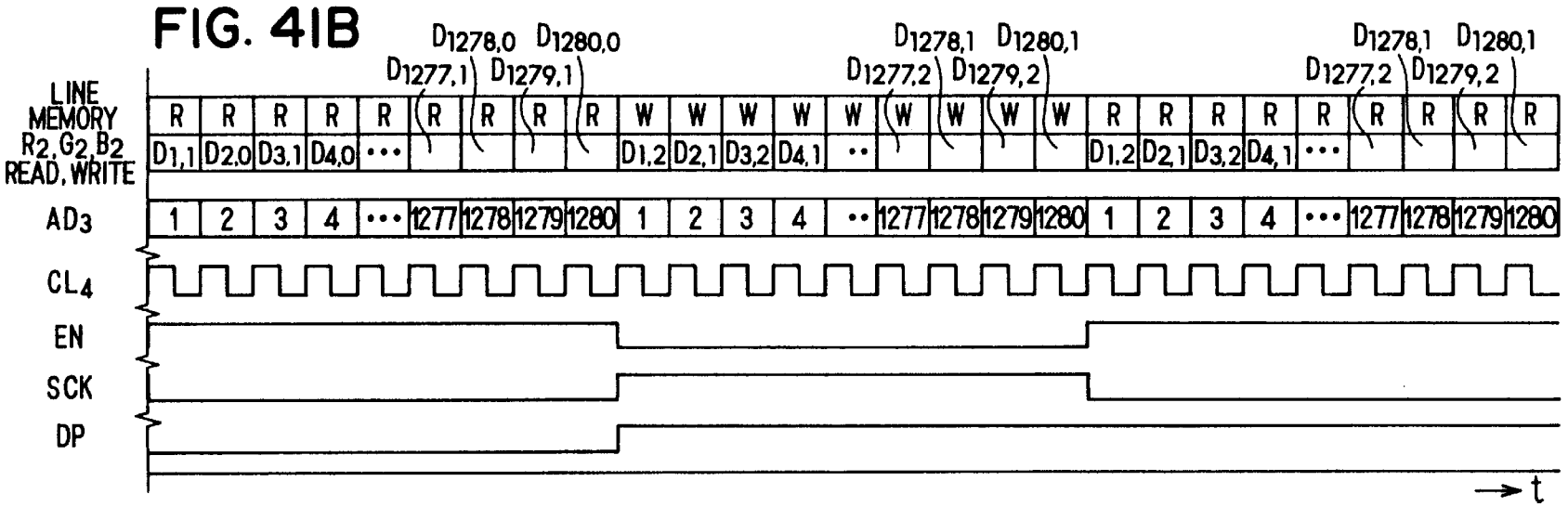
Figure 41C:
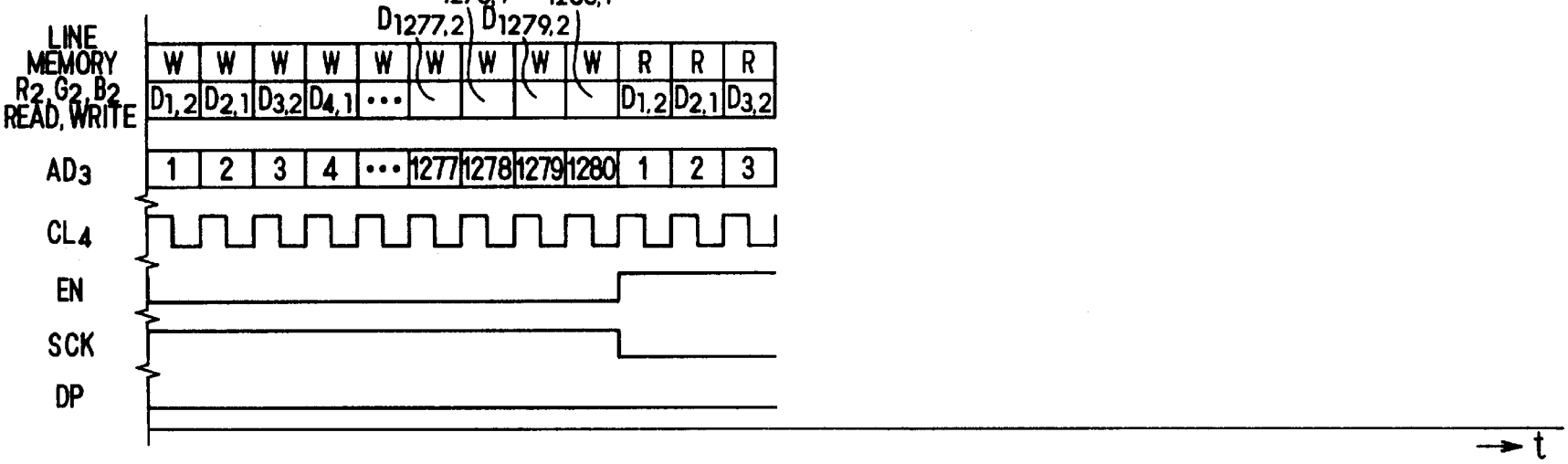

The image data supplied to the data electrodes Xm are composed of two pulses to accord with the selecting voltage composed of two pulses. As shown in FIG. 37, the structure of the scanning and data electrodes is the same as that of the first embodiment, but the order of scanning is different. The image data are written in the frame memory 20 in the order shown in FIG. 38. The image data are written in and read out from the line memories of the image data conversion circuit 30 in the order shown in FIG. 39.

Figure 42:
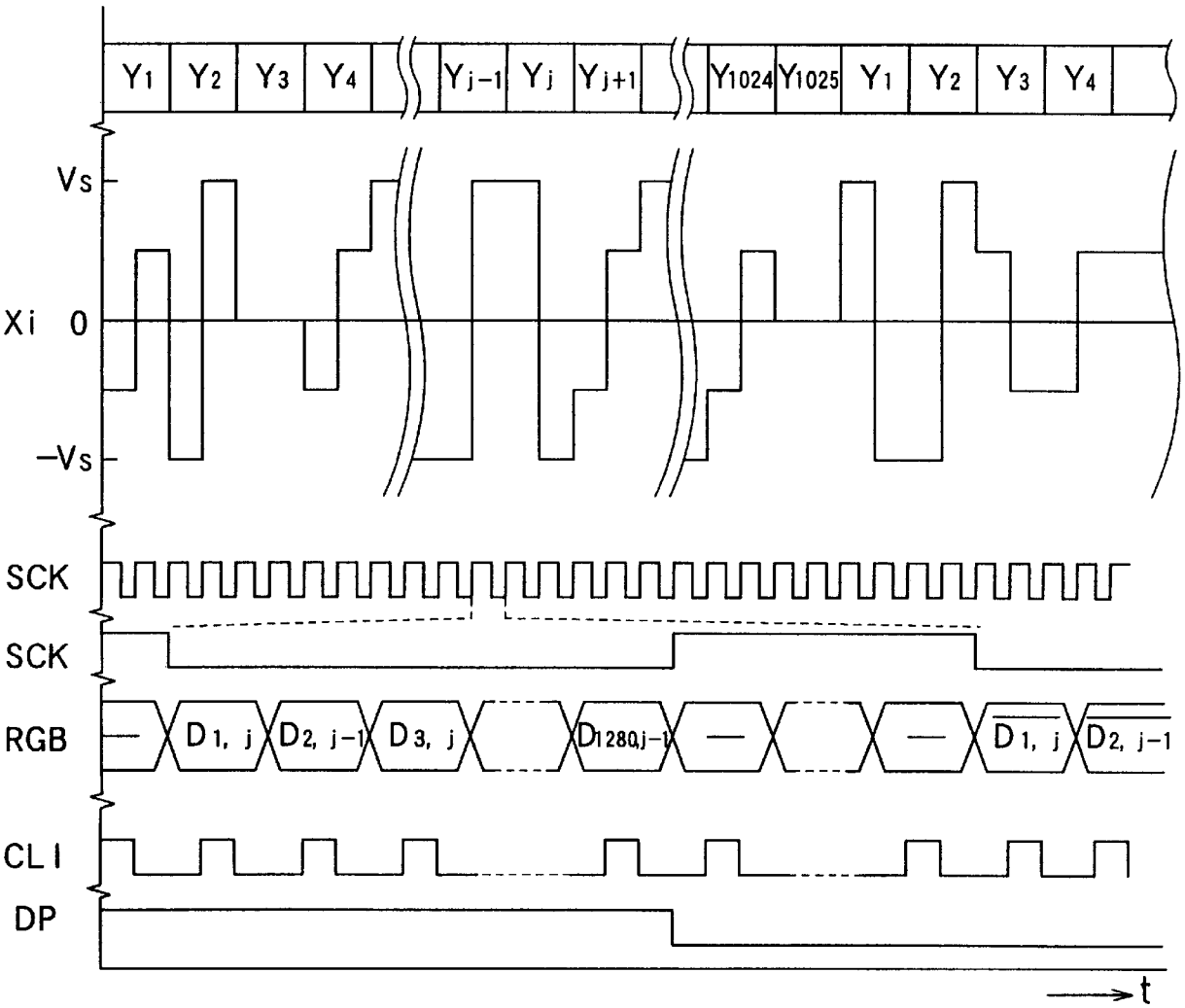
FIG. 42 is a timing chart showing waveforms of the data electrode driving circuit.

Two pulses of the SCK signal correspond to one pulse of the SCC signal as in the first embodiment. The data electrode driving circuit 50 operates in the same manner as in the first embodiment. It reads out the data from the line memories of the image data conversion circuit 30 in synchronism with the clock signal CL1 and holds the read out data, and feeds the data to the data electrodes Xm in synchronism with the rising of the SCK signal, as shown in FIG. 42.

As shown in FIG. 43, the scanning voltages are supplied to the scanning electrodes Y1, Y2, Y3 . . . Yn in this order, the phase being shifted by a length of the selecting period for each electrode and the polarities being alternated electrode by electrode.

The operation of the third embodiment will be further explained as to a particular example designed as follows. A frame-display frequency: 60 Hz (a time period for displaying one frame is 16.666 ms); the number of the scanning electrodes: 1025; a time period for scanning one horizontal line: 1H=16.26 $\mu$s; the number of the data electrodes: 1280; a scanning duty: 1/N (N=1025); a time period for imposing the eliminating voltage: 16.26 $\mu$s (=1H); and the eliminating period: 975.6 $\mu$s (=60H).

Figure 44:
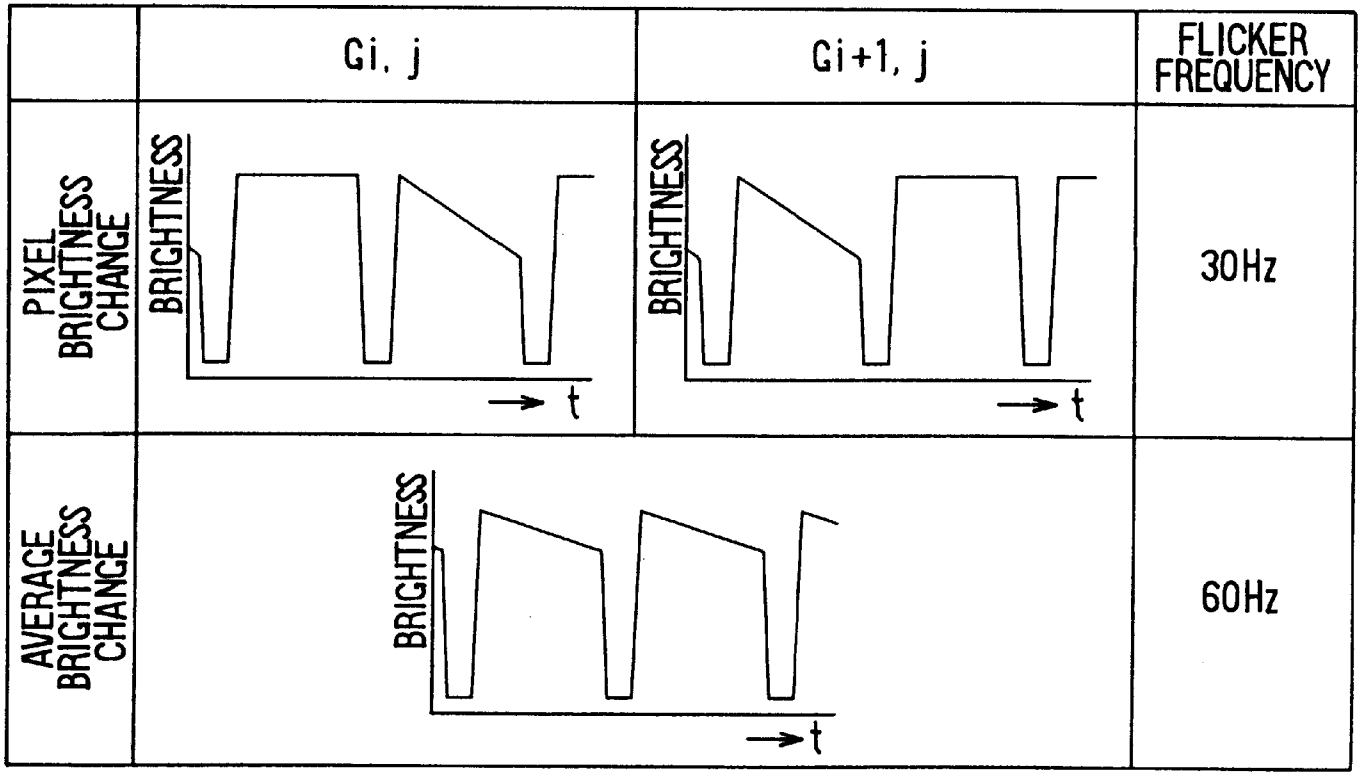
FIG. 44 is a chart showing brightness changes of neighboring two pixels and their average brightness change.
Figure 45:
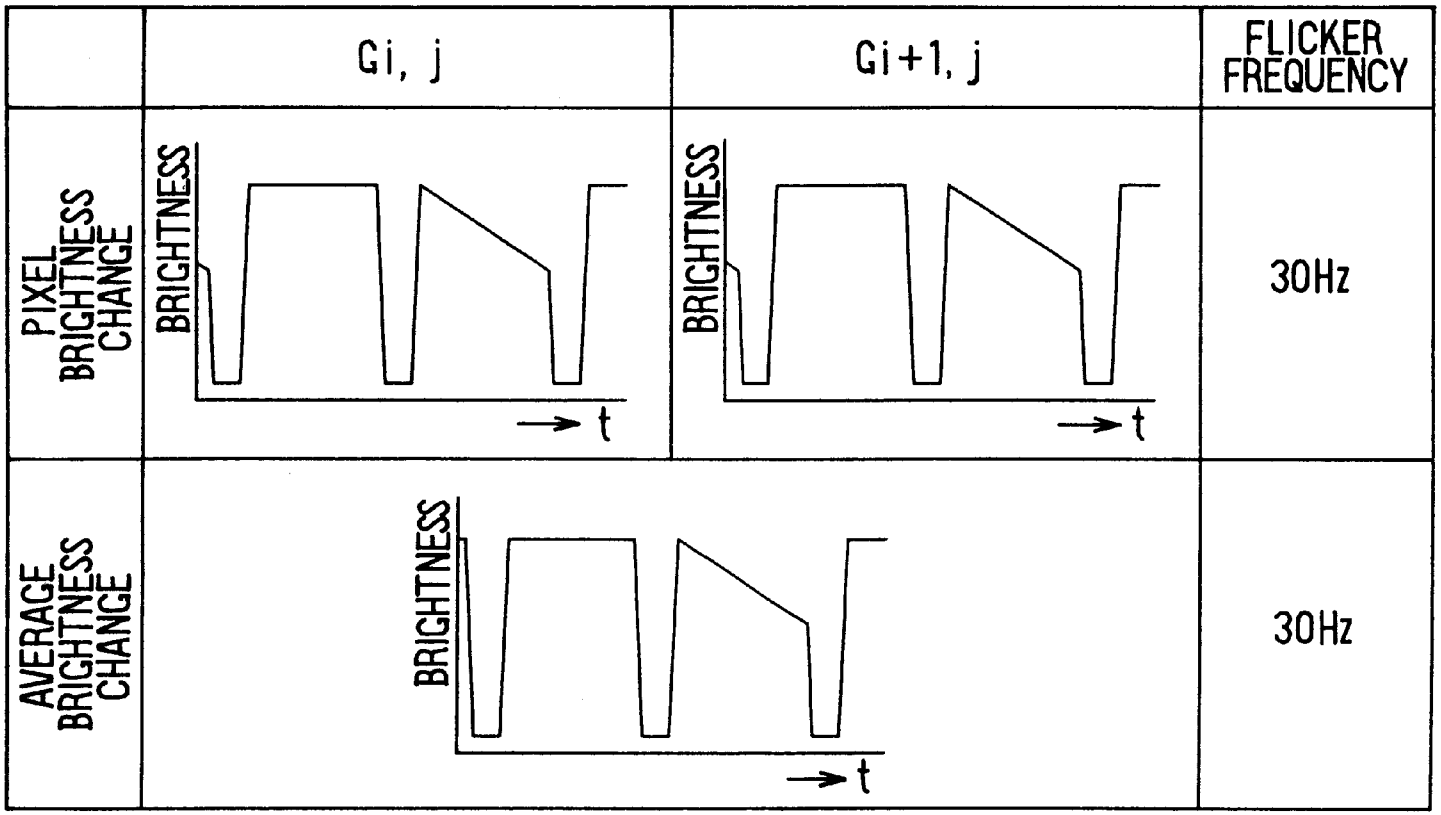
FIG. 45 is a chart showing brightness changes of neighboring two pixels and their average brightness change, being plotted under conditions different from those in FIG. 44 for comparison purpose.

If a display panel having a conventional electrode structure is sequentially scanned, the brightness of two neighboring pixels G(i,j) and G(i+1,j) changes in phase as shown in FIG. 45. Accordingly, the average brightness of two pixels has the same waveform as that of the individual pixel. Therefore, there appear two kinds of flicker, i.e., one flicker having a frequency of 60 Hz which is the same as the frame frequency and another flicker having a frequency of 30 Hz which is a half of the frame frequency. Of the two flickers, the 30 Hz flicker is visible and detrimental to display quality. In contrast, when the display panel having the electrode structure described above is sequentially scanned with the same 60 Hz frame frequency, the brightness of two neighboring pixels G(i,j) and G(i+1,j) does not change in phase as shown in FIG. 44. Accordingly, their average brightness waveform becomes different from those of the individual pixels. In other words, the 30 Hz flicker is practically eliminated by averaging the brightness of two neighboring pixels, and only the 60 Hz flicker exists, which is invisible as mentioned above. Therefore, in the third embodiment of the present invention, the display flicker and the line-scroll are made invisible, and thereby display quality is greatly improved. Since, in this embodiment, the two neighboring pixels in a horizontal display line are driven with alternated polarities without dividing the pixels, the display flicker is effectively suppressed without making the panel complex.

Fourth Embodiment

Figure 46:
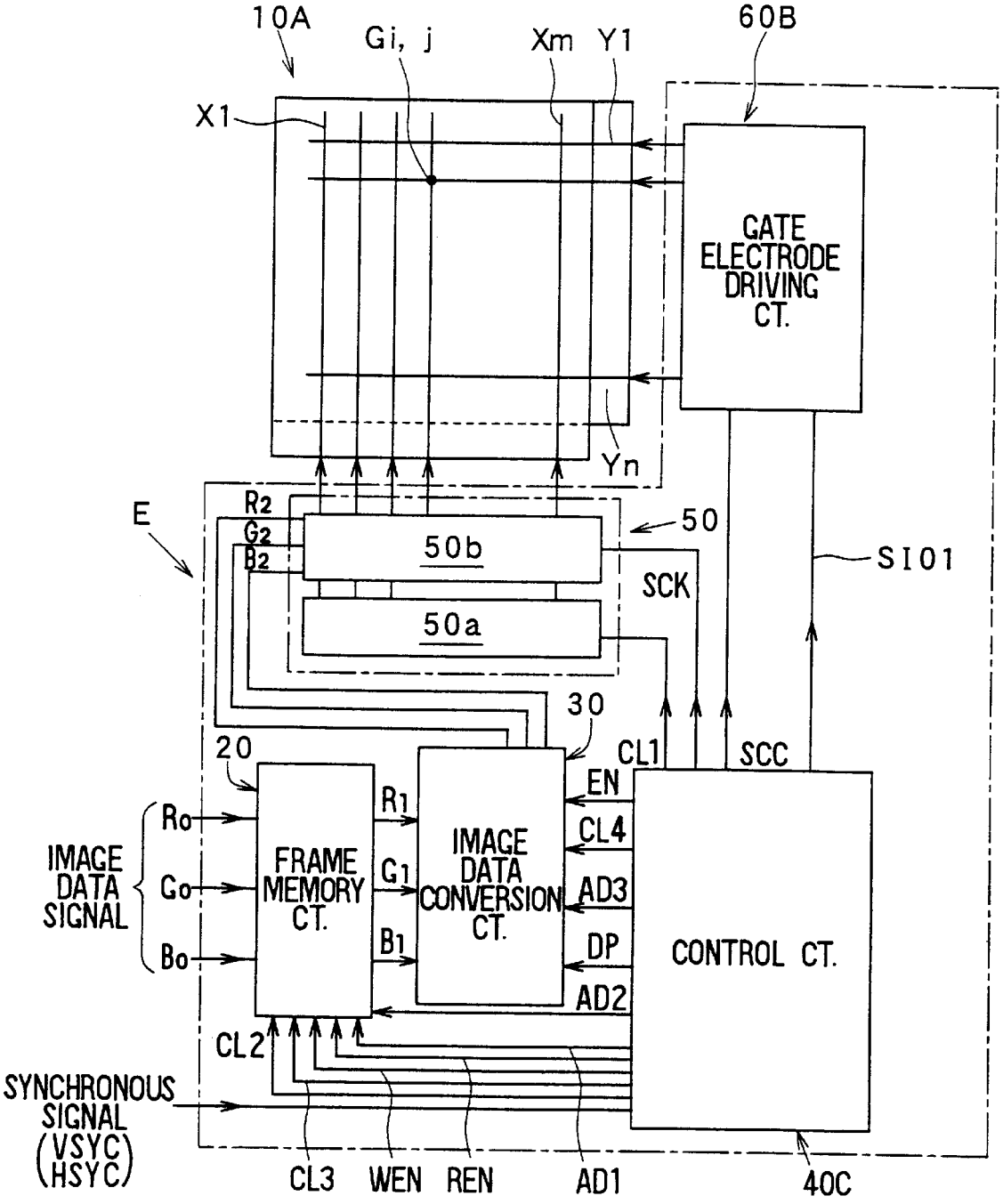
FIG. 46 is a block diagram showing a matrix-display device as a fourth embodiment of the present invention, details of which are shown in the following drawings, FIGS. 47–53.

A fourth embodiment of the present invention will be described in reference to FIGS. 46–53. In this embodiment, the liquid crystal display panel 10 of the first embodiment is replaced with a liquid crystal display panel 10A having an active matrix structure. Referring to FIG. 46, the display panel 10, the control circuit 40 and the scanning electrode driving circuit 60 in the first embodiment are replaced with an active matrix display panel 10A, a control circuit 40C and a gate electrode driving circuit 60B, respectively. Further, the power source circuit 70 used in the first embodiment is eliminated.

Figure 47:
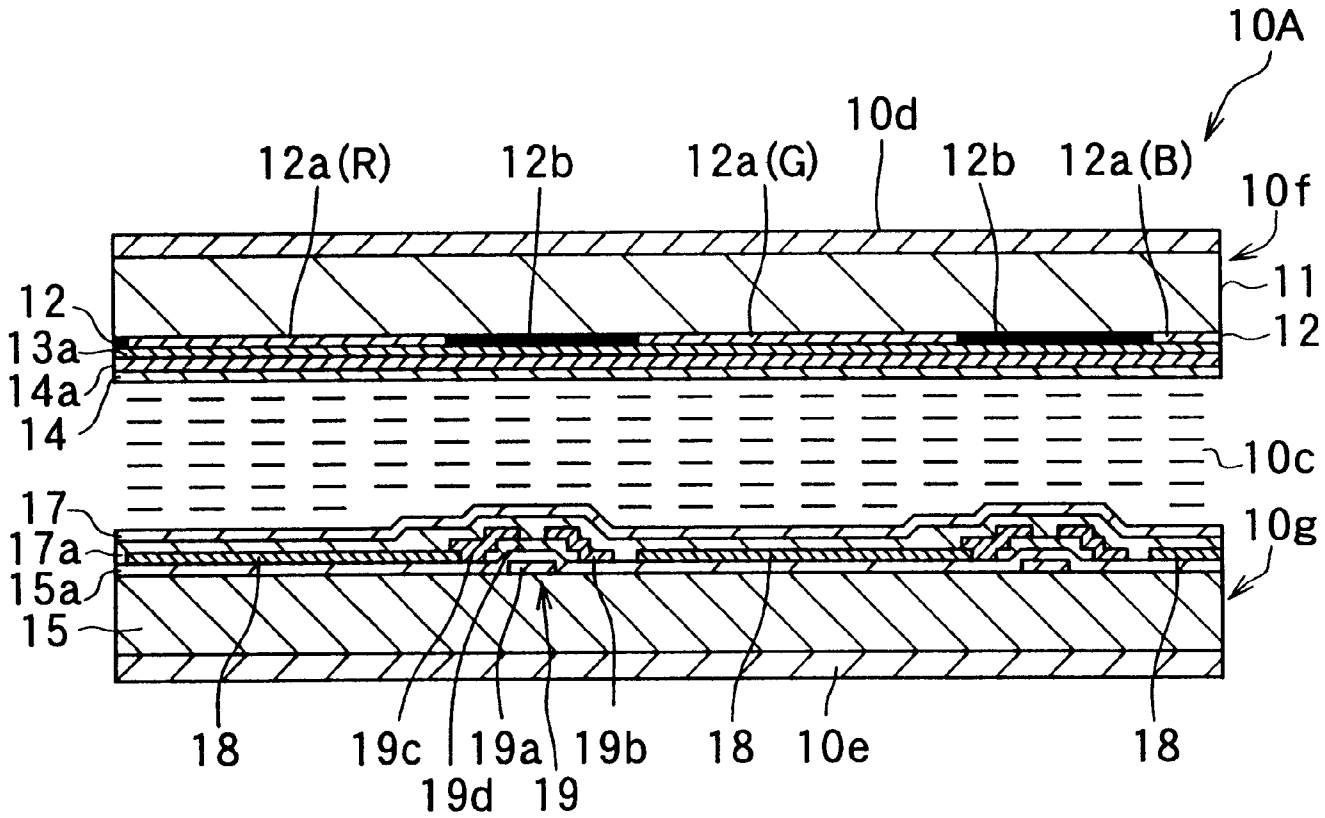
FIG. 47 is a cross-sectional view of a liquid crystal panel.

The liquid crystal display panel 10A is shown in FIG. 47. The first and second electrode substrates 10*a* and 10*b* of the first embodiment are replaced with a first electrode substrate 10*f* and a second electrode substrate log, respectively. In the first electrode substrate 10*f*, the m stripes of the transparent electrode layer 13 are replaced with a common conductor layer 13*a* and an insulating layer 14*a*, both being interposed between m stripes of the color filter 12 and the orientation layer 14. The potential of the common conductor layer 13*a* is a base voltage VE. The insulating layer 14*a* is placed between the common conductor layer 13*a* and the orientation layer 14. The color filter 12 is composed of colored layers 12*a* and light-intercepting layers 11*b*, both being alternately aligned. The colored layer 12*a* includes color filter layers 12*a*(R), 12*a*(G) and 12*a*(B), each corresponding to the R, G, and B filters of the first embodiment, respectively.

Figure 48:
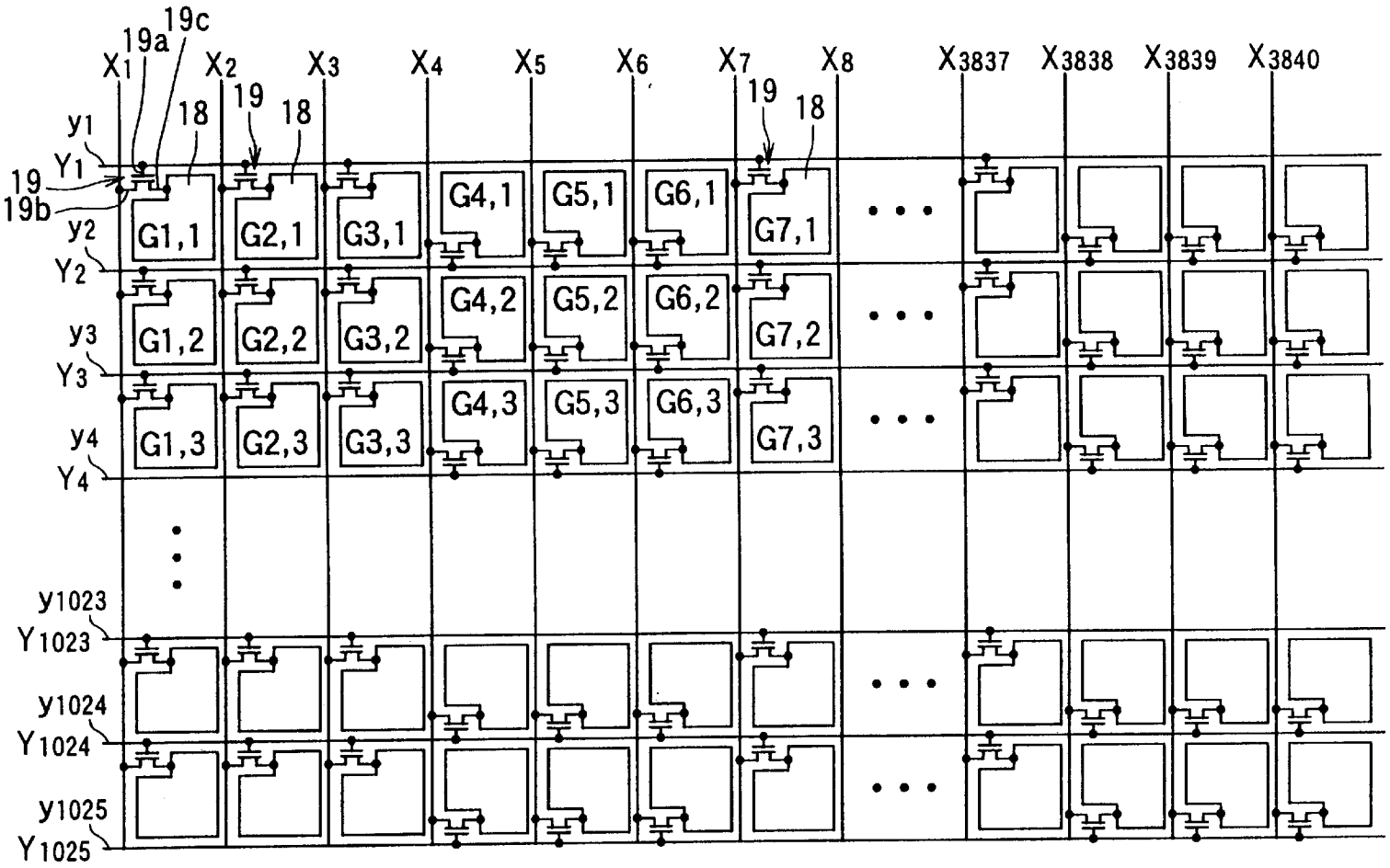
FIG. 48 is a diagram showing a layout of gate lines and source lines in the panel.

In the second electrode substrate log, n stripes of the transparent electrodes 16 of the first embodiment are replaced with an insulating layer 15*a*, pixel electrodes 18, thin film transistors (referred to as TFT) 19 and an insulating layer 17*a*, all being interposed between the glass substrate 15 and the orientation layer 17. The insulating layer (referred to as gate insulating layer) 17*a* is formed along the inside surface of the glass substrate 15. The pixel electrodes 18 are formed on the inside surface of the gate insulating layer 17*a* and aligned as shown in FIG. 48. Each pixel electrode 18 is positioned to correspond to respective color filter layers 12*a*(R), 12*a*(G) and 12(B).

The TFTs 19 are aligned in a matrix as shown in FIG. 48 and disposed between the insulating layer 17*a* and the glass substrate 15. Each TFT constitutes a thin film transistor structure together with the gate insulating layer 15*a*. The TFT 19 includes a gate electrode 19*a*, a drain electrode 19*b*, a source electrode 19*c* and an amorphous silicon layer 19*d*, as shown in FIG. 47. The electrode substrate 10*g* includes scanning leads yn (y1 to y1025) and data leads Xm (X1 to X3840), both being aligned to cross perpendicularly as shown in FIG. 48.

The scanning leads yn together with the TFTs and pixel electrodes 18, both connected to the scanning leads yn, correspond to the scanning electrodes Yn of the first embodiment. For example, the scanning lead y1, the TFTs connected to y1 and pixel electrodes 18 connected to y1 as a whole correspond to the scanning electrode Y1 in the first embodiment. This is also referred to a gate line Y1. The data lead Xm corresponds to the data electrode Xm in the first embodiment and is referred to as a source line Xm. The color filter 12 is different from that of the first embodiment. One stripe of the color filter layer is located between two neighboring data leads X(i−1) and X(i) in this embodiment. The pixels G(m,n), i.e., 3840×1025 pixels, are formed by the scanning leads yn, data leads Xm and the pixel electrodes 18 (refer to FIGS. 48 and 49).

Figure 49:
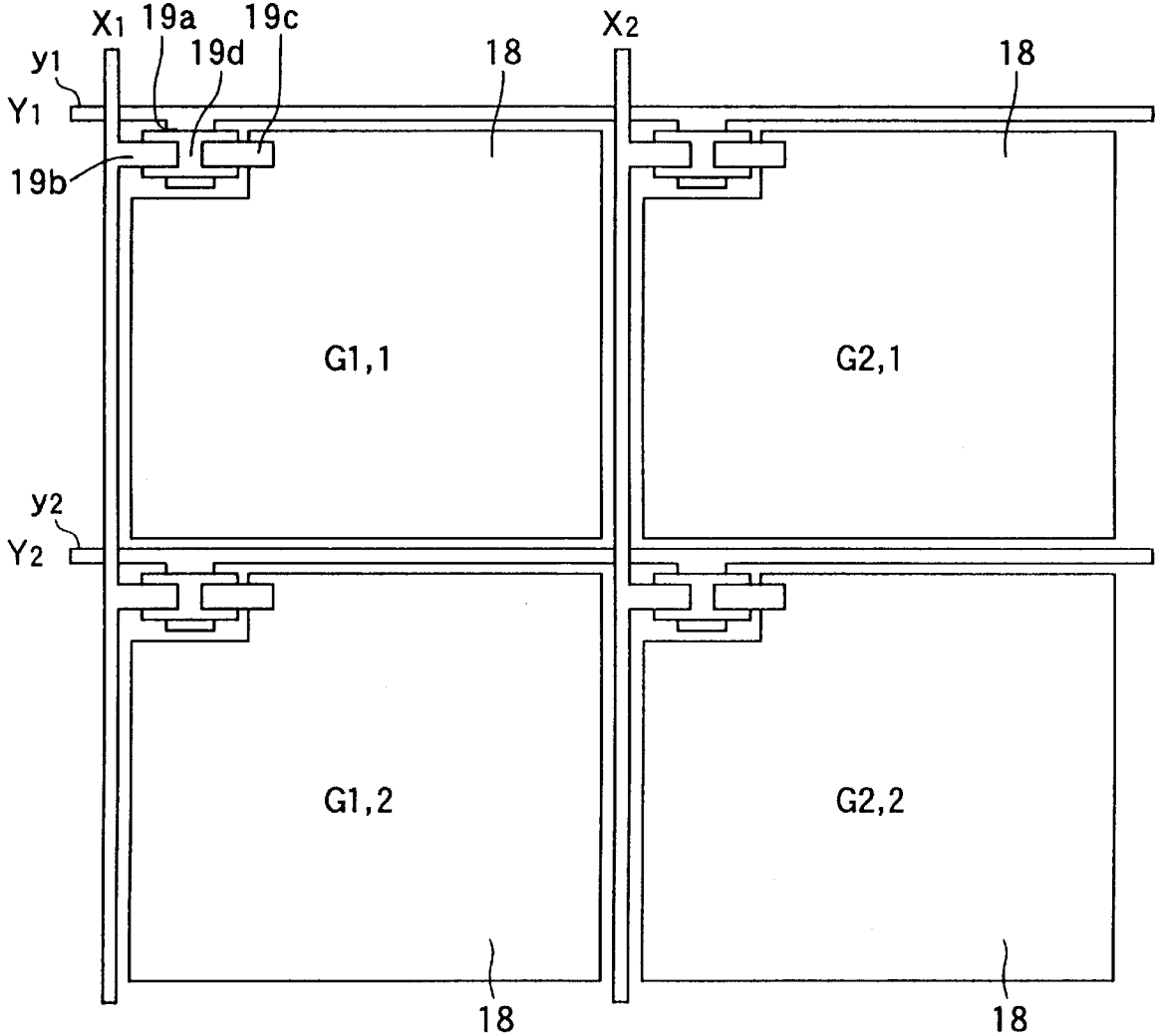
FIG. 49 is a partially enlarged view of the layout shown in FIG. 48.

Referring to FIG. 48 showing the layout of the pixels and FIG. 49 showing a partially enlarged portion of FIG. 48, the interconnection of the scanning leads yn, the data leads Xm, TFTs 19 and pixel electrodes 18 will be explained. As shown in FIG. 48, each group of three pixels, e.g., G(1,1), G(2,1) and G(3,1); G(4,1), G(5,1) and G(6,1); G(1,2), G(2,2) and G(3,2); G(4,2), G(5,2) and G(6,2); G(1,3), G(2,3) and G(3,3); G(4,3), G(5,3) and G(6,3); and so on, is similarly connected. Therefore, the connection will be explained group by group, taking some groups as examples.

As to the pixel G(1,1): a TFT 19 corresponding to the pixel G(1,1) is connected to y1 through its gate electrode 19*a*, to X1 through its drain electrode 19*b* and to a pixel electrode 18 corresponding to the pixel G(1,1) through its source electrode 19*c*. As to the pixel G(2,1): a TFT 19 corresponding to the pixel G(2,1) is connected to y1 through its gate electrode 19*a*, to X2 through its drain electrode 19*b* and to a pixel electrode 18 corresponding to the pixel G(2,1) through its source electrode 19*c*. As to the pixel G(3,1): a TFT 19 corresponding to the pixel G(3,1) is connected to y1 through its gate electrode 19*a*, to X3 through its drain electrode 19*b* and to a pixel electrode 18 corresponding to the pixel G(3,1) through its source electrode 19*c*. As to the pixel G(4,1): a TFT 19 corresponding to the pixel G(4,1) is connected to y2 through its gate electrode 19*a*, to X4 through its drain electrode 19*b* and to a pixel electrode 18 corresponding to the pixel G(4,1) through its source electrode 19*c*. As to the pixel G(5,1): a TFT 19 corresponding to the pixel G(5,1) is connected to y2 through its gate electrode 19*a*, to X5 through its drain electrode 19*b* and to a pixel electrode 18 corresponding to the pixel G(5,1) through its source electrode 19*c*. As to the pixel G(6,1): a TFT 19 corresponding to the pixel G(6,1) is connected to y2 through its gate electrode 19*a*, to X6 through its drain electrode 19*b* and to a pixel electrode 18 corresponding to the pixel G(6,1) through its source electrode 19*c*. Thereafter, the similar connection is repeated throughout the first gate line Y1.

As to the pixel G(1,2): a TFT 19 corresponding to the pixel G(1,2) is connected to y2 through its gate electrode 19*a*, to X1 through its drain electrode 19*b* and to a pixel electrode 18 corresponding to the pixel G(1,2) through its source electrode 19*c*. As to the pixel G(2,2): a TFT 19 corresponding to the pixel G(2,2) is connected to y2 through its gate electrode 19*a*, to X2 through its drain electrode 19*b* and to a pixel electrode 18 corresponding to the pixel G(2,2) through its source electrode 19*c*. As to the pixel G(3,2): a TFT 19 corresponding to the pixel G(3,2) is connected to y2 through its gate electrode 19*a*, to X3 through its drain electrode 19*b* and to a pixel electrode 18 corresponding to the pixel G(3,2) through its source electrode 19*c*. As to the pixel G(4,2): a TFT 19 corresponding to the pixel G(4,2) is connected to y3 through its gate electrode 19*a*, to X4 through its drain electrode 19*b* and to a pixel electrode 18 corresponding to the pixel G(4,2) through its source electrode 19*c*. As to the pixel G(5,2): a TFT 19 corresponding to the pixel G(5,2) is connected to y3 through its gate electrode 19*a*, to X5 through its drain electrode 19*b* and to a pixel electrode 18 corresponding to the pixel G(5,2) through its source electrode 19*c*. As to the pixel G(6,2): a TFT 19 corresponding to the pixel G(6,2) is connected to y3 through its gate electrode 19*a*, to X6 through its drain electrode 19*b* and to a pixel electrode 18 corresponding to the pixel G(6,2) through its source electrode 19*c*. Thereafter, the similar connection is repeated throughout the second gate line Y2.

As to the pixel G(1,3): a TFT 19 corresponding to the pixel G(1,3) is connected to y3 through its gate electrode 19*a*, to X1 through its drain electrode 19*b* and to a pixel electrode 18 corresponding to the pixel G(1,3) through its source electrode 19*c*. As to the pixel G(2,3): a TFT 19 corresponding to the pixel G(2,3) is connected to y3 through its gate electrode 19*a*, to X2 through its drain electrode 19*b* and to a pixel electrode 18 corresponding to the pixel G(2,3) through its source electrode 19*c*. As to the pixel G(3,3): a TFT 19 corresponding to the pixel G(3,3) is connected to y3 through its gate electrode 19*a*, to X3 through its drain electrode 19*b* and to a pixel electrode 18 corresponding to the pixel G(3,3) through its source electrode 19*c*. As to the pixel G(4,3): a TFT 19 corresponding to the pixel G(4,3) is connected to y4 through its gate electrode 19*a*, to X4 through its drain electrode 19*b* and to a pixel electrode 18 corresponding to the pixel G(4,3) through its source electrode 19*c*. As to the pixel G(5,3): a TFT 19 corresponding to the pixel G(5,3) is connected to y4 through its gate electrode 19*a*, to X5 through its drain electrode 19*b* and to a pixel electrode 18 corresponding to the pixel G(5,3) through its source electrode 19*c*. As to the pixel G(6,3): a TFT 19 corresponding to the pixel G(6,3) is connected to y4 through its gate electrode 19*a*, to X6 through its drain electrode 19*b* and to a pixel electrode 18 corresponding to the pixel G(6,3) through its source electrode 19*c*. Thereafter, the similar connection is repeated throughout the third gate line Y3.

Figure 50:
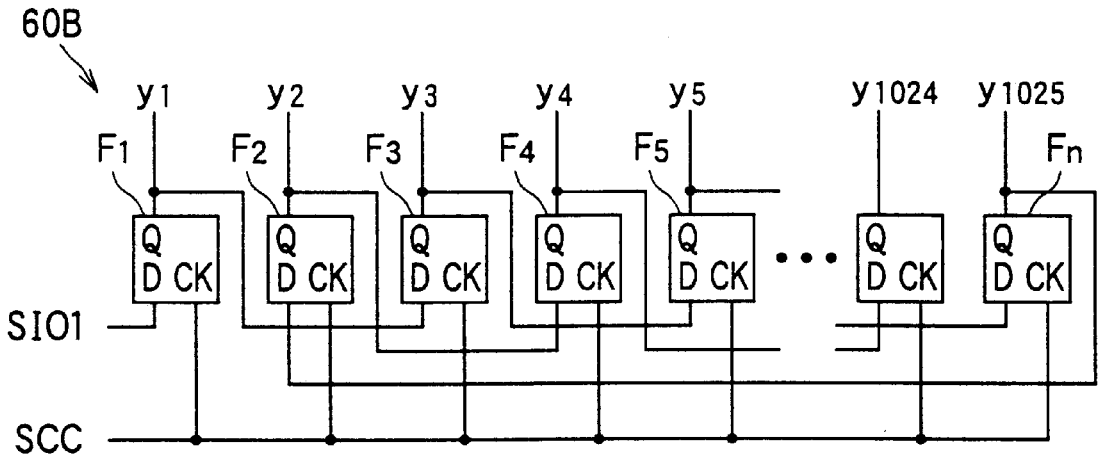
FIG. 50 is a circuit diagram showing a gate electrode driving circuit.

Referring to FIG. 50, the, gate electrode driving circuit 60B will be described. The gate lines Y1 to Yn described above are scanned, under the interlaced scanning, by the gate electrode driving circuit 60B. The interlaced scanning is performed by jumping one gate line every time. The gate electrode driving circuit 60B is constituted by a shift register having 1025 D-type flip-flop circuits F1 to F1025 each corresponding to each scanning leads y1 to y1025. Output terminal Q of the flip-flop circuit F1 is connected to the scanning lead y1 and input terminal D of the flip-flop circuit F3. Output terminal Q of the flip-flop circuit F3 is connected to the scanning lead y3 and input terminal D of the flip-flop circuit F5. Similarly, an odd numbered flip-flop circuit is connected to the next odd numbered flip-flop circuit up to the last flip-flop circuit F1025. Output terminal Q of the flip-flop circuit F1025 is connected to the scanning lead y1025 and input terminal D of the flip-flop circuit F2. Output terminal Q of the flip-flop circuit F2 is connected to the scanning lead y2 and input terminal D of the flip-flop circuit F4. Similarly, an even numbered flip-flop circuit is connected to the next even numbered flip-flop circuit up to the flip-flop circuit F1024.

Figure 51:
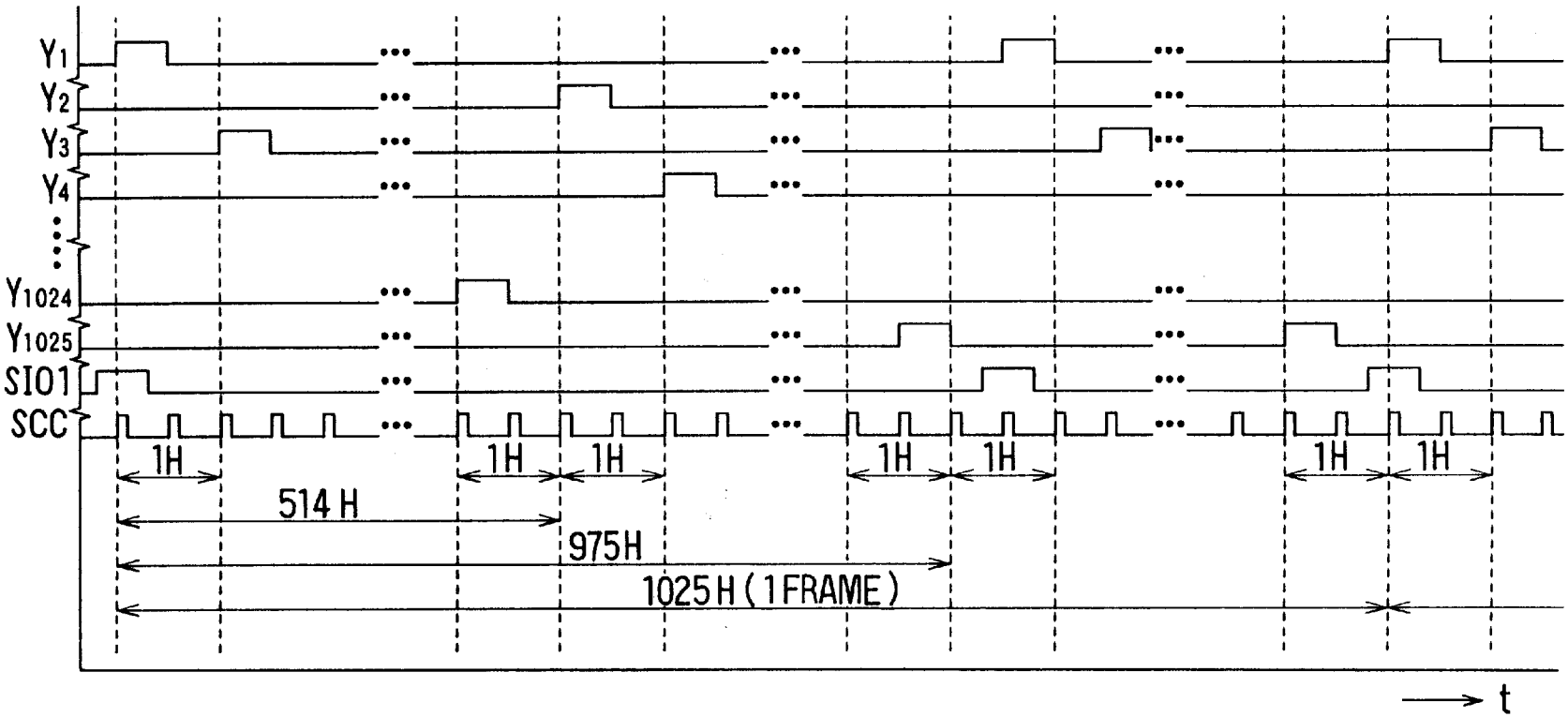
FIG. 51 is a timing chart showing waveforms of voltages supplied to gate lines and waveforms of an SCC signal.

As shown in FIG. 51, the gate electrode driving circuit 60B described above scans the gate lines Y1 to Y1025 under the interlaced scanning by jumping one line every time, based on the SI01 and SCC signals fed from the control circuit 40C. The control circuit 40C of this embodiment feeds only the SI01 and SCC signals to the gate electrode driving circuit 60B. Signals SI02 and ACK used in the first embodiment are eliminated.

Figure 52:
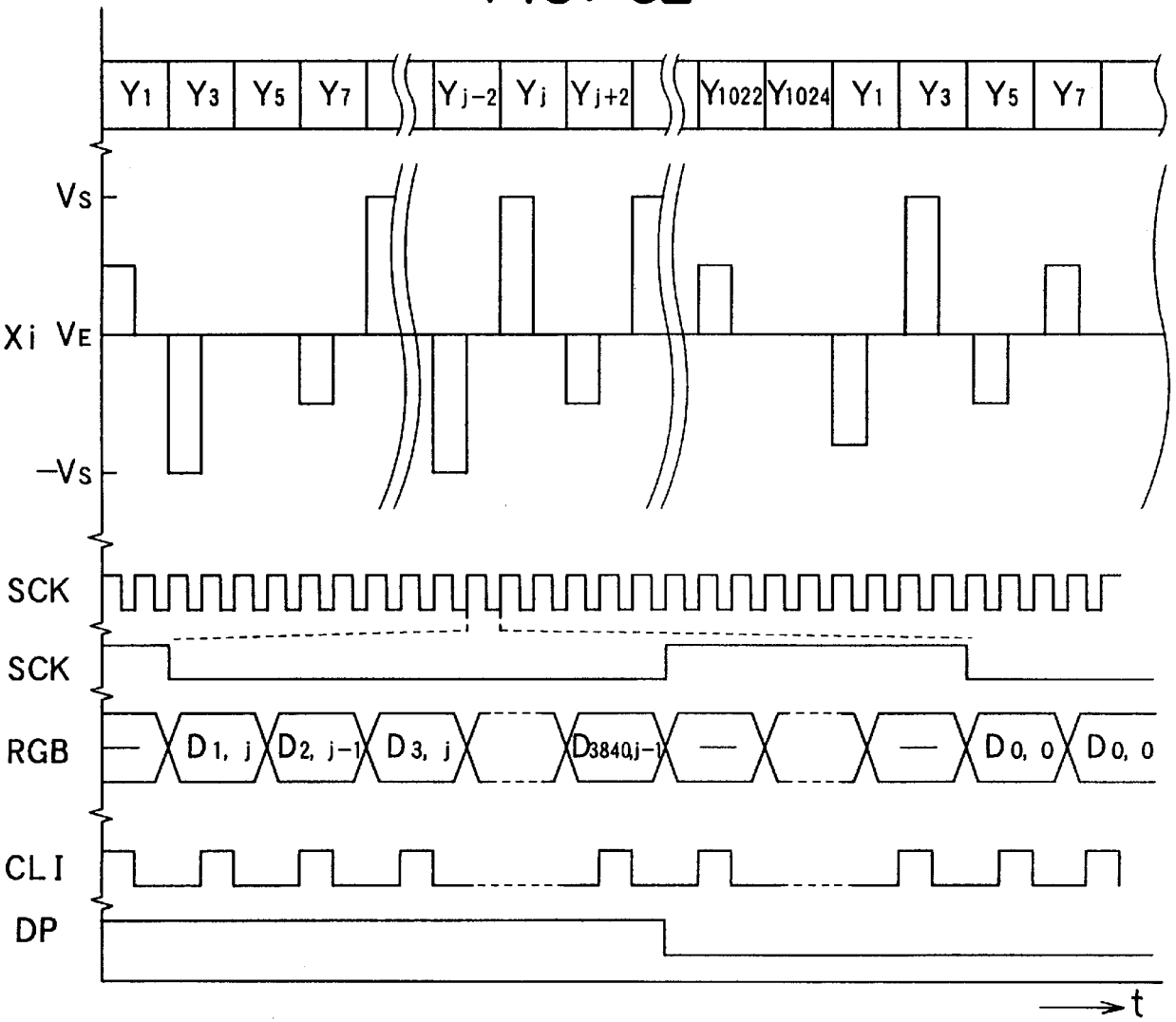
FIG. 52 is a timing chart showing voltages supplied to source lines together with other signals.

The data electrode driving circuit 50 supplies data signal voltages to the data leads Xm (the data leads are also referred to as source lines or column lines). As shown in FIG. 52, the driving circuit 50 supplies a voltage representing an image data in the first period of the selecting period and the base voltage VE (VE=0) in the second period. The base voltage VE corresponds to the data D(0,0) stored in the address(0,0) in the frame memory circuit 20 of the first embodiment. Other structures of the data electrode driving circuit 50 are the same as those of the first embodiment.

Figures 53A, 53B, 53C, 53D, 53E, 53F, 53G, 53H:
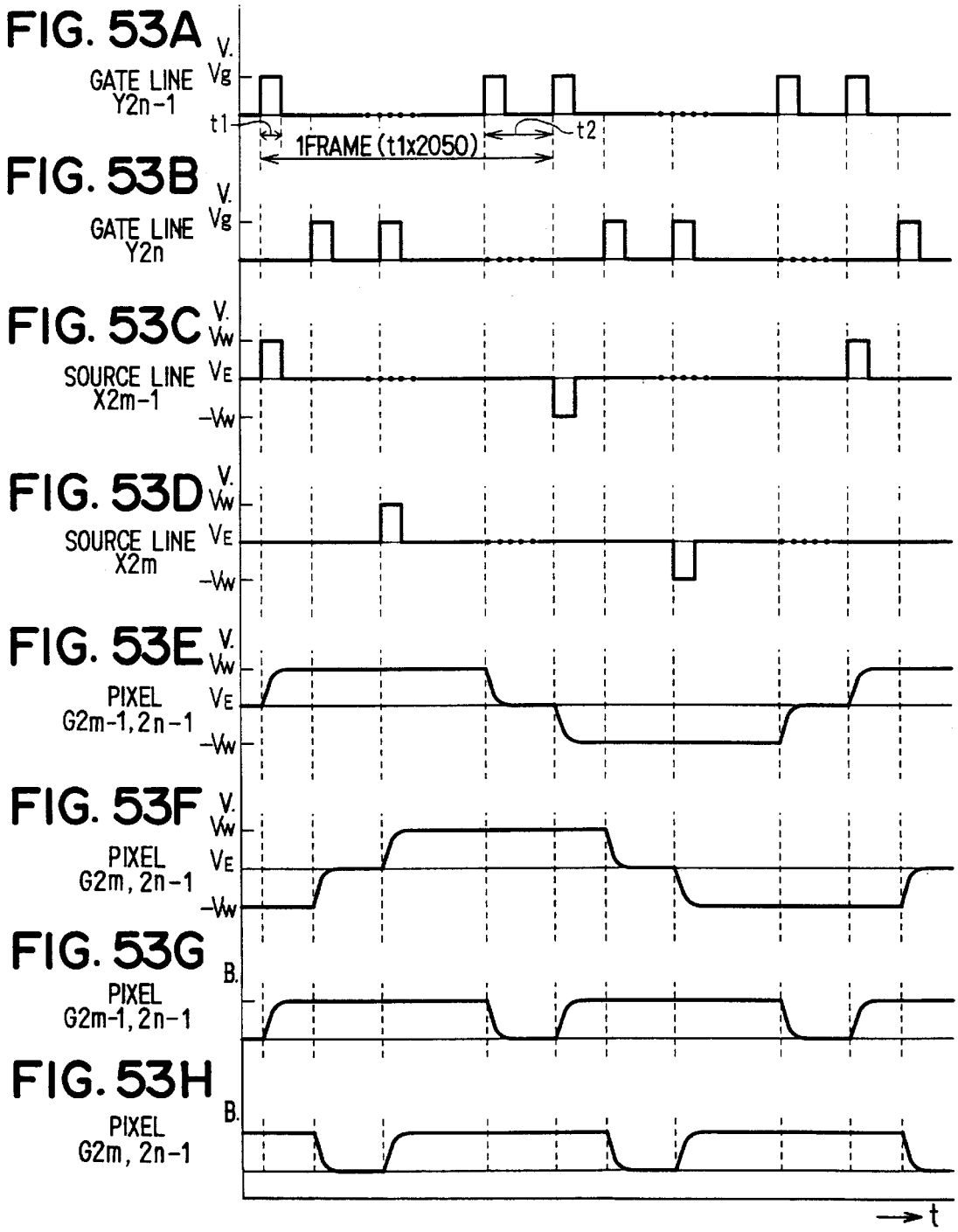
FIGS. 53A and 53B are timing charts showing gate line voltages.
FIGS. 53C and 53D are timing charts showing source line voltages.
FIGS. 53E and 53F are timing charts showing pixel voltages.
FIGS. 53G and 53H are timing charts showing brightness of pixels;.

FIGS. 53A and 53B show voltages supplied to gate lines Y(2n−1) and Y(2n), respectively. FIGS. 53C and 53D show voltages supplied to source lines X(2m−1) and X(2m), respectively. FIGS. 53E and 53F show voltages imposed on pixels G(2m−1,2n−1) and G(2m,2n−1), respectively. FIGS. 53G and 53H show brightness of pixels G(2m−1,2n−1) and G(2m,2n−1), respectively. Those timing charts show a state where only the pixels G(2m−1,2n−1) and G(2m,2n−1) are bright and other pixels are dark. The voltage supplied to the gate line Y(2n−1) is a high level for t1 then it becomes a low level. The voltage of the source line X(2m−1) becomes Vw (Vw is a voltage of a bright state) in synchronism with period t1 during which the Y(2n−1) voltage is high. The time period t1 is a half of one selecting period. For eliminating image data, the Y(2n−1) voltage becomes high again at a time t2 before the end of the frame, and the high level is kept for t1 and then becomes low. In synchronism with this t1, X(2m−1) voltage becomes 0 volt (0 volt is a voltage for a dark state). The time period t2 is 99×t1, and a time period of one frame is t1×2050 in this embodiment. The time period t1 is 16.3 μs since the driving frequency is set to 30 Hz.

A Y(2n) voltage (a voltage supplied to Y(2n)) becomes high t1×1025 after the Y(2n−1) voltage becomes high, and the high level is maintained for t1 and then turns to a low level. A source line X(2m) voltage becomes Vw in synchronism with the high level period of the Y(2n) voltage. The Y(2n) voltage becomes high again at a time t2 before the end of the frame, and the high level is kept for t1 and then becomes low. In synchronism with this t1, X(2m−1) voltage becomes 0 volt (0 volt is a voltage for a dark state).

Under the above operation, voltages shown in FIGS. 53E and 53F are imposed on the pixels G(2m−1,2n−1) and G(2m,2n−1), respectively, and the brightness of the pixels become as shown in FIGS. 53G and 53H. The phase of the brightness change of two pixels is shifted by half a cycle from one another. Therefore, the average flicker frequency becomes 60 Hz under the driving frequency of 30 Hz as in the first embodiment. It is required, in a conventional display device, to increase the driving frequency to 60 Hz to suppress the flicker, thereby decreasing a TFT-on time to 8.15 μs. In contrast, in this embodiment, the flicker frequency can be increased to the invisible level of 60 Hz without increasing the driving frequency of 30 Hz. Therefore, the TFT-on time can be kept at 16.3 μs, and the pixels can be sufficiently charged. The line-scroll can be made invisible at the same time.

Figure 54:
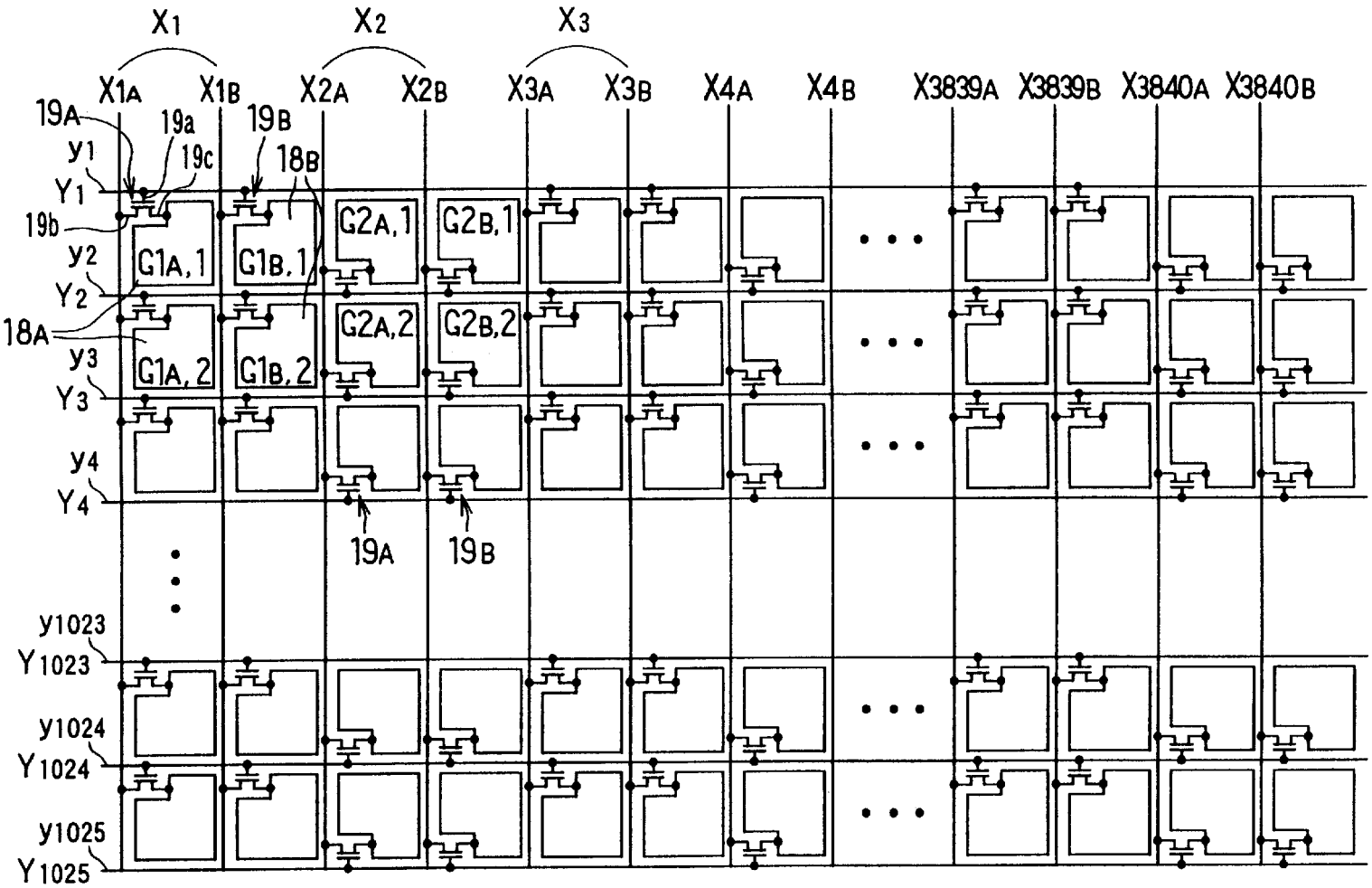
FIG. 54 is a diagram showing a layout of gate lines and source lines in a panel modified from that of the fourth embodiment.
Figure 55:
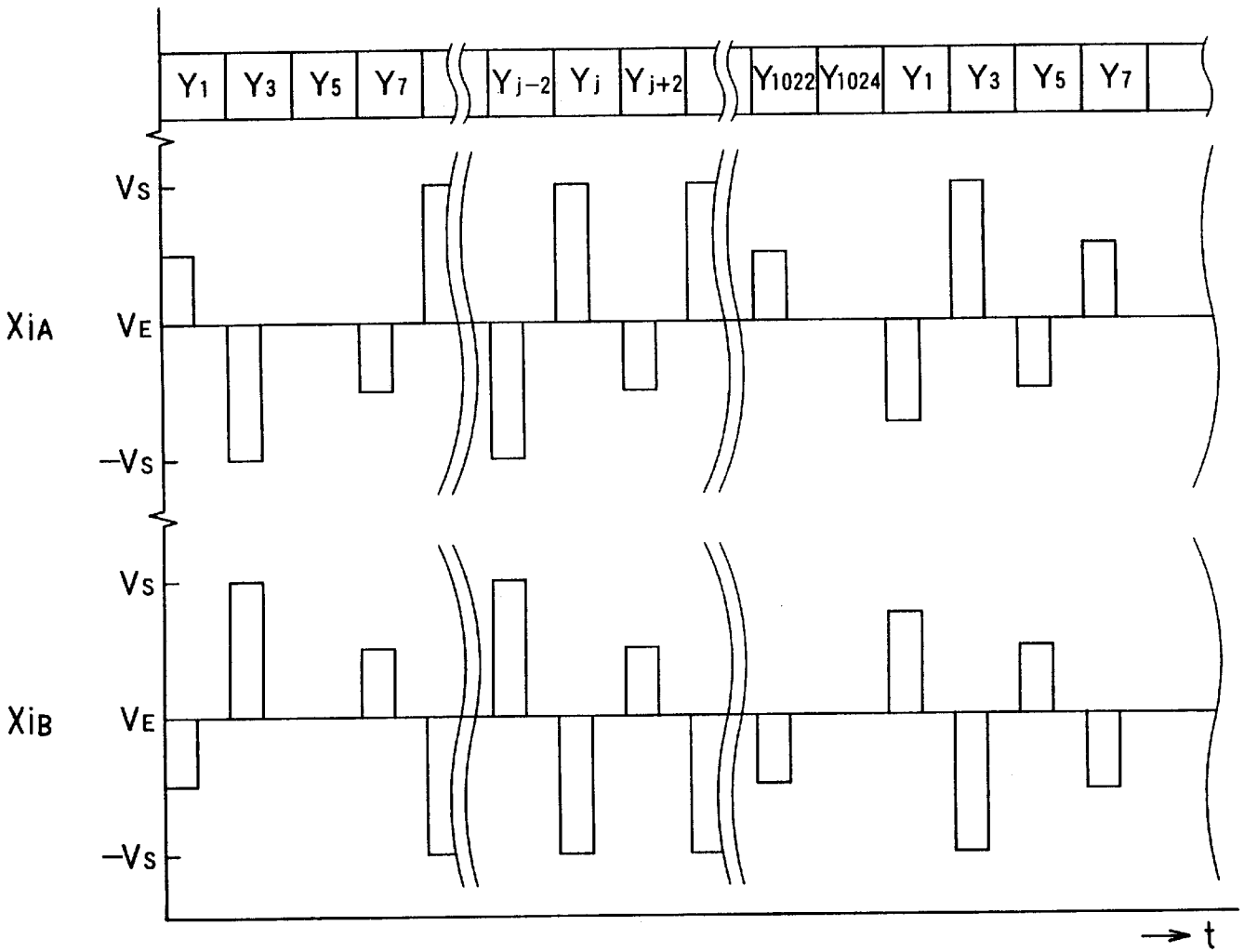
FIG. 55 is a timing chart showing waveforms of source lines in the panel modified from that of the fourth embodiment.

Referring to FIGS. 54 and 55, a modified form of the fourth embodiment will be described. In this modification, each source line Xm of the fourth embodiment is divided into two lines $Xm_A$ and $Xm_B$. Each pixel G(m,n) is also divided into two pixels $G(m_A,n)$ and $G(m_B,n)$. A TFT $\mathbf{19}_A$ corresponds to the pixel $G(m_A,n)$ and a TFT $\mathbf{19}_B$ corresponds to the pixel $G(m_B,n)$. Similarly, a pixel electrode $\mathbf{18}_A$ corresponds to the pixel $G(m_A,n)$ and a pixel electrode $\mathbf{18}_B$ corresponds to the pixel $G(m_B,n)$. Also, each colored layer 12*a* is divided into two portions so that each divided portion corresponds to the pixel $G(m_A,n)$ and the pixel $G(m_B,n)$, respectively. The pixels are arranged as shown in FIG. 54, and pixel groups each consisting of two pixels are connected group by group. The connection of the pixels will be explained below, taking some groups as examples.

As to the pixel $G(\mathbf{1}_A,\mathbf{1})$: a TFT $\mathbf{19}_A$ corresponding to the pixel $G(\mathbf{1}_A,\mathbf{1})$ is connected to y1 through its gate electrode 19*a*, to $X\mathbf{1}_A$ through its drain electrode 19*b* and to a pixel electrode $\mathbf{18}_A$ corresponding to the pixel $G(\mathbf{1}_A,\mathbf{1})$ through its source electrode 19*c*. As to the pixel $G(\mathbf{1}_B,\mathbf{1})$: a TFT $\mathbf{19}_B$ corresponding to the pixel $G(\mathbf{1}_B,\mathbf{1})$ is connected to y1 through its gate electrode 19*a*, to $X\mathbf{1}_B$ through its drain electrode 19*b* and to a pixel electrode $\mathbf{18}_B$ corresponding to the pixel $G(\mathbf{1}_B,\mathbf{1})$ through its source electrode 19*c*. As to the pixel $G(\mathbf{2}_A,\mathbf{1})$: a TFT $\mathbf{19}_A$ corresponding to the pixel $G(\mathbf{2}_A,\mathbf{1})$ is connected to y2 through its gate electrode 19*a*, to $X\mathbf{2}_A$ through its drain electrode 19*b* and to a pixel electrode $\mathbf{18}_A$ corresponding to the pixel $G(\mathbf{2}_A,\mathbf{1})$ through its source electrode 19*c*. As to the pixel $G(\mathbf{2}_B,\mathbf{1})$: a TFT $\mathbf{19}_B$ corresponding to the pixel $G(\mathbf{2}_B,\mathbf{1})$ is connected to y2 through its gate electrode 19*a*, to $X\mathbf{2}_B$ through its drain electrode 19*b* and to a pixel electrode $\mathbf{18}_B$ corresponding to the pixel $G(\mathbf{2}_B,\mathbf{1})$ through its source electrode 19*c*. The same connection is repeated throughout the gate line Y1.

As to the pixel $G(\mathbf{1}_A,\mathbf{2})$: a TFT $\mathbf{19}_A$ corresponding to the pixel $G(\mathbf{1}_A,\mathbf{2})$ is connected to y2 through its gate electrode 19*a*, to $X\mathbf{1}_A$ through its drain electrode 19*b* and to a pixel electrode $\mathbf{18}_A$ corresponding to the pixel $G(\mathbf{1}_A,\mathbf{2})$ through its source electrode 19*c*. As to the pixel $G(\mathbf{1}_B,\mathbf{2})$: a TFT $\mathbf{19}_B$ corresponding to the pixel $G(\mathbf{1}_B,\mathbf{2})$ is connected to y2 through its gate electrode 19*a*, to $X\mathbf{1}_B$ through its drain electrode 19*b* and to a pixel electrode $\mathbf{18}_B$ corresponding to the pixel $G(\mathbf{1}_B,\mathbf{2})$ through its source electrode 19*c*. As to the pixel $G(\mathbf{2}_A,\mathbf{2})$: a TFT $\mathbf{19}_A$ corresponding to the pixel $G(\mathbf{2}_A,\mathbf{2})$ is connected to y3 through its gate electrode 19*a*, to $X\mathbf{2}_A$ through its drain electrode 19*b* and to a pixel electrode $\mathbf{18}_A$ corresponding to the pixel $G(\mathbf{2}_A,\mathbf{2})$ through its source electrode 19*c*. As to the pixel $G(\mathbf{2}_B,\mathbf{2})$: a TFT $\mathbf{19}_B$ corresponding to the pixel $G(\mathbf{2}_B,\mathbf{2})$ is connected to y3 through its gate electrode 19*a*, to $X\mathbf{2}_B$ through its drain electrode 19*b* and to a pixel electrode $\mathbf{18}_B$ corresponding to the pixel $G(\mathbf{2}_B,\mathbf{2})$ through its source electrode 19*c*. The same connection is repeated throughout the gate line Y2.

A pair of source lines $Xi_A$ and $Xi_B$ are driven by respectively opposite polarities, as shown in FIG. 55. A pair of pixels $G(m_A,n)$ and $G(m_B,n)$ is connected to one scanning lead yn as a group, and the next pair of pixels is connected to the next scanning lead as a group. For example, a group of $G(\mathbf{1}_A,\mathbf{1})$ and $G(\mathbf{1}_B,\mathbf{1})$ is connected to y1, and a group of $G(\mathbf{2}_A,\mathbf{1})$ and $G(\mathbf{2}_B,\mathbf{1})$ is connected to y2. Therefore, if there is a response characteristic difference of antiferroelectric liquid crystal between its positive state and negative state, such difference is canceled by the pair of pixels $G(m_A,n)$ and $G(m_B,n)$, and thereby the flicker and the line-scroll are further reduced.

Fifth Embodiment

Figure 56:
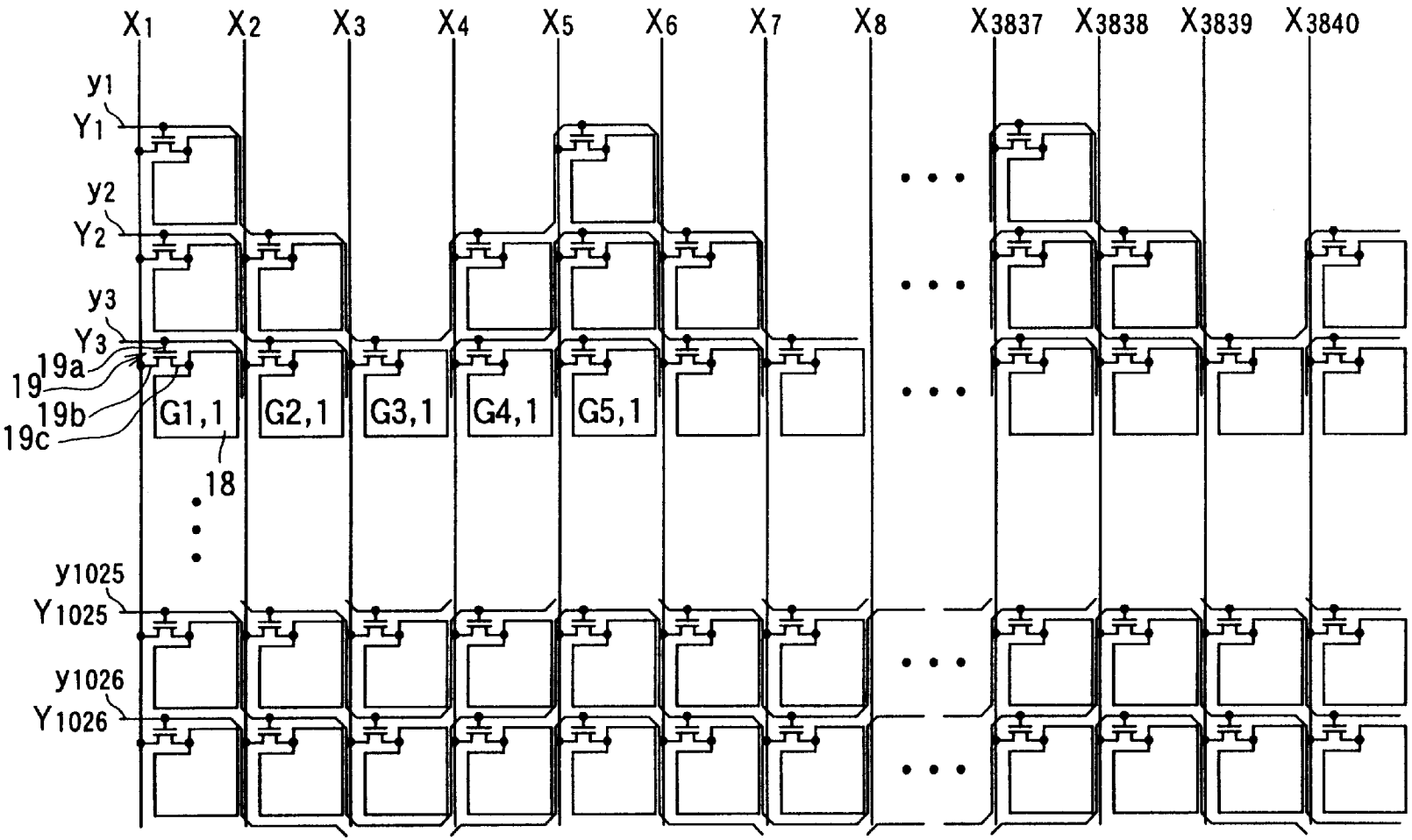
FIG. 56 is a schematic diagram showing a layout of gate lines and source lines in a fifth embodiment of the present invention, other details of which are shown in the following drawings, FIGS. 57–61.

A fifth embodiment of the present invention will be described in reference to FIGS. 56 to 61. In this embodiment, the scanning leads yn of the liquid crystal display panel 10A are connected in a zigzag manner as shown in FIG. 56, and the interlaced scanning is performed by jumping two lines every time. Other structures and operation are similar to the fourth embodiment described above.

Referring to FIG. 56, the scanning lead connection will be explained. The gate electrode 19*a* of the TFT 19 corresponding to the pixel G(1,1) is connected to the scanned lead y3. The gate electrode 19*a* of the TFT 19 corresponding to the pixel G(2,1) is connected to the scanning lead y2. The gate electrode 19*a* of the TFT 19 corresponding to the pixel G(3,1) is connected to the scanning lead y1. The gate electrode 19*a* of the TFT 19 corresponding to the pixel G(4,1) is connected to the scanning lead y2. The gate electrode 19*a* of the TFT 19 corresponding to the pixel G(5,1) is connected to the scanning lead y3. Other TFTs are similarly connected to the respective scanning leads. The number of the scanning leads yn is 1026 in this embodiment, i.e., one lead more than that of the fourth embodiment.

Figure 57:
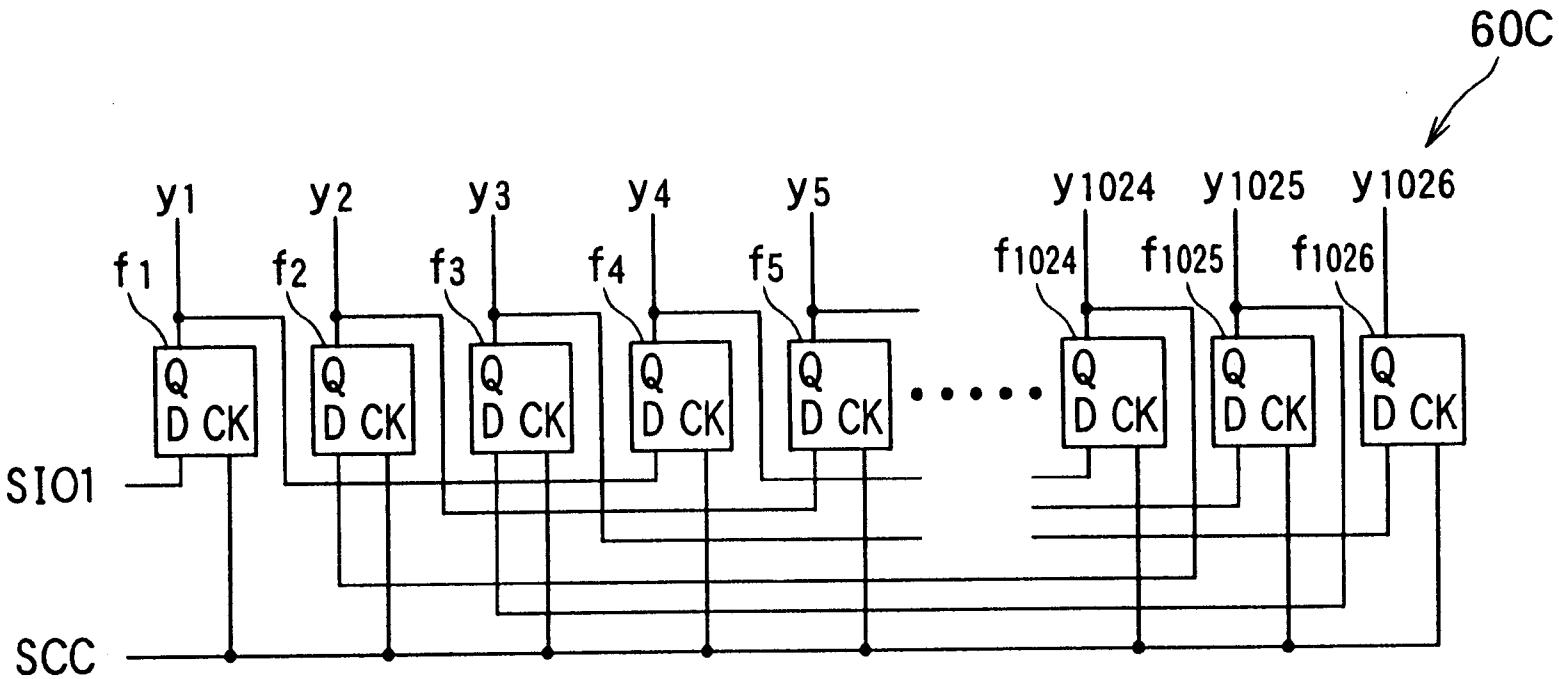
FIG. 57 is a circuit diagram showing a gate electrode driving circuit.
Figure 58:
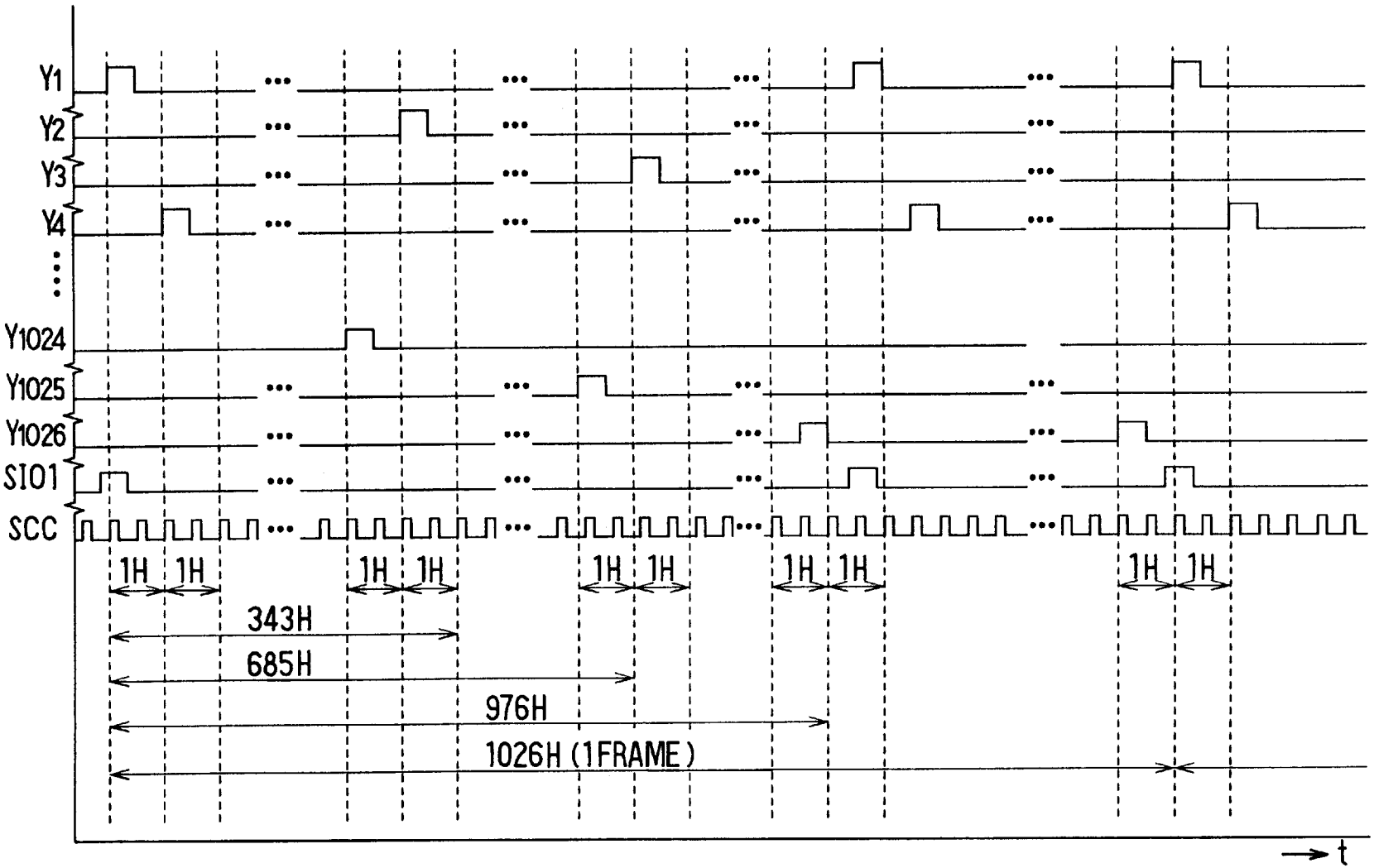
FIG. 58 is a timing chart showing gate line voltages together with SI01 and SCC signals.

The gate electrode driving circuit 60B of the fourth embodiment is replaced with 60C to perform the interlaced scanning by jumping two lines. The gate electrode driving circuit 60C is shown in FIG. 57. It is constituted by a shift register consisting of 1026 D-type flip-flop circuits f1 to f1026, each corresponding to each scanning lead y1 to y1026. Terminal Q of the flip-flop circuit f1 is connected to the scanning lead y1 and terminal D of the flip-flop circuit y4. Terminal Q of the flip-flop circuit f2 is connected to scanning lead y2 and terminal D of the flip-flop circuit f5. Following flip-flop circuits are similarly connected, jumping two flip-flop circuits. However, at a certain point, the connection is switched back. That is, terminal Q of the flip-flop circuit f1024 is connected to the scanning lead y1024 and terminal D of the flip-flop circuit f2. Terminal Q of the flip-flop circuit f1025 is connected to scanning lead y1025 and terminal D of the flip-flop f3. Terminal Q of the last flip-flop f1026 is connected to scanning lead y1026.

Figure 59:
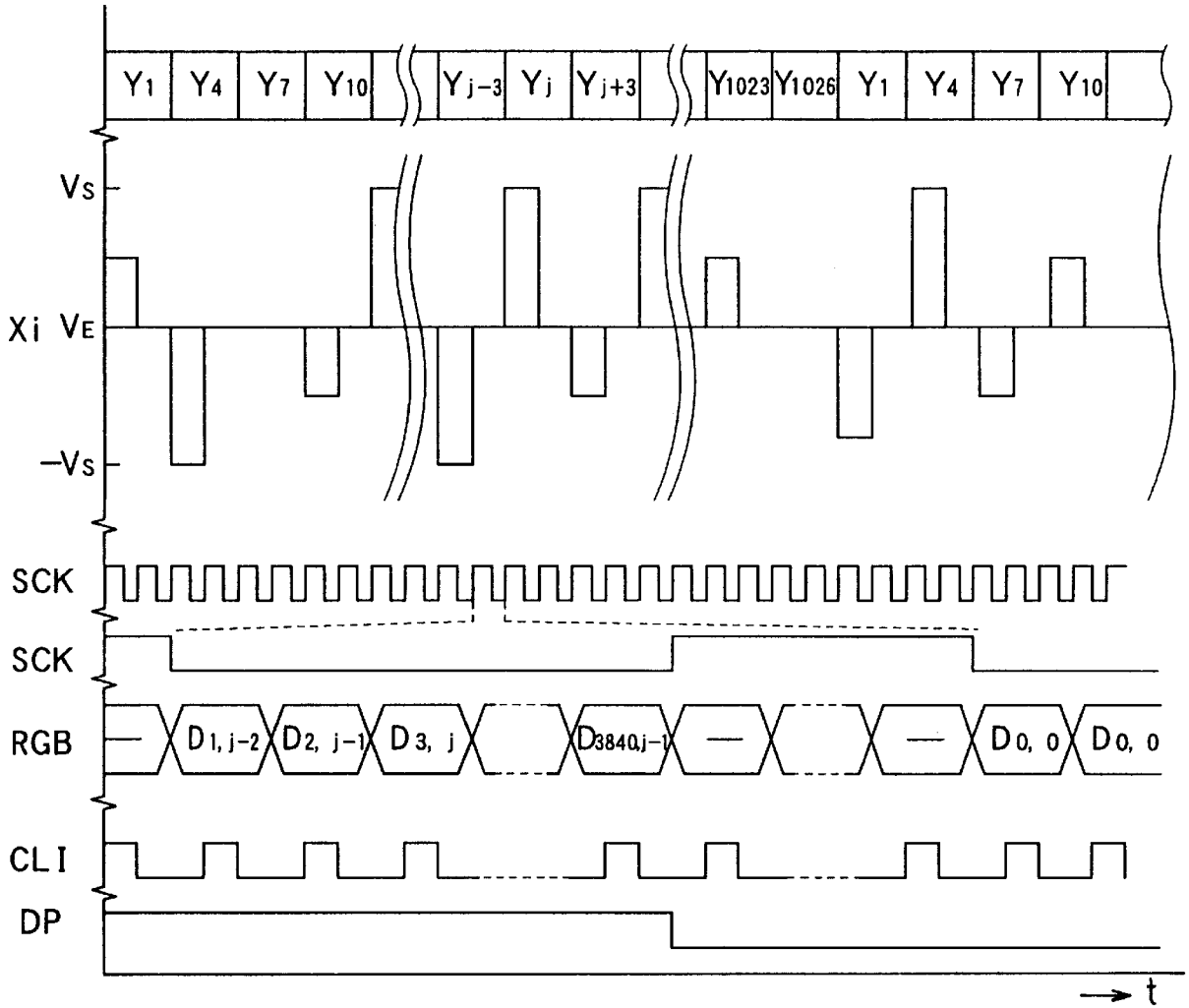
FIG. 59 is a timing chart showing waveforms of a data electrode driving circuit.

The gate electrode driving circuit 60C described above supplies voltages shown in FIG. 58 to scanning leads y1 to y1026 to perform the interlaced scanning by jumping two leads. The voltages shown in FIG. 59 are supplied to the source lines Xi from the data electrode driving circuit 50.

Figures 60A, 60B, 60C, 60D, 60E, 60F:
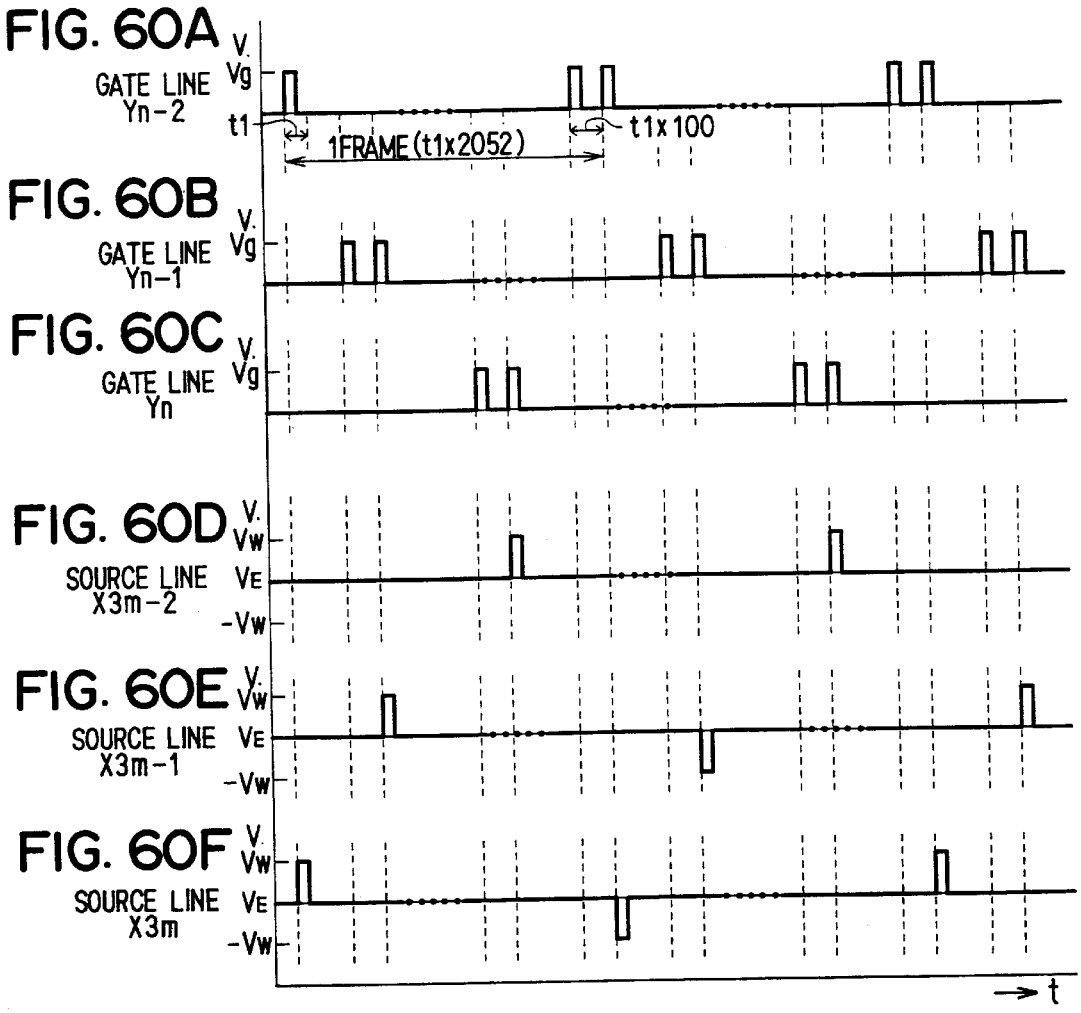
FIGS. 60A, 60B and 60C are timing charts showing gate line voltages.
FIGS. 60D, 60E and 60F are timing charts showing source line voltages.
Figures 61A, 61B, 61C, 61D, 61E, 61F:
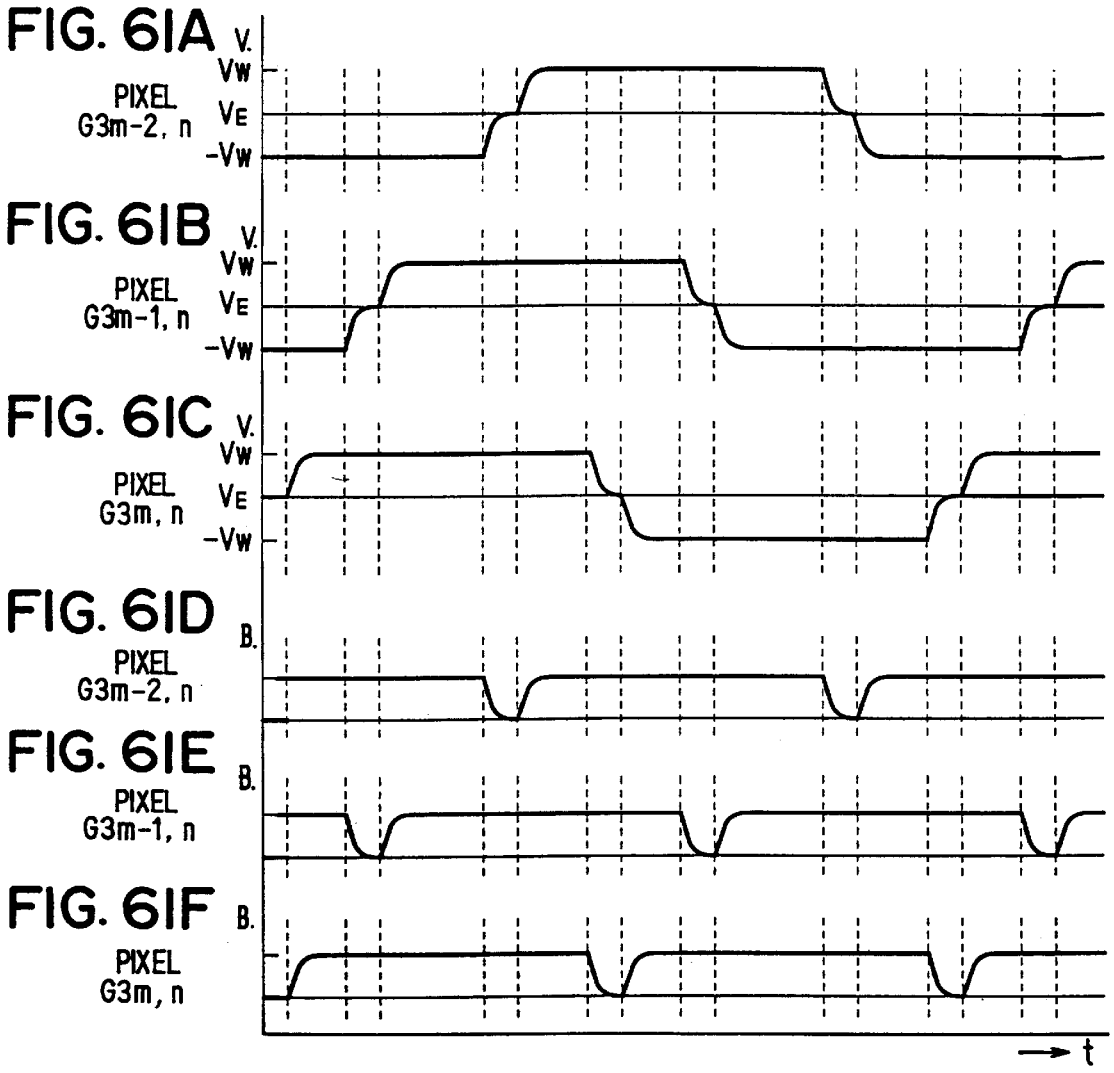
FIGS. 61A, 61B and 61C are timing charts showing voltages imposed on pixels.
FIGS. 61D, 61E and 61F are timing charts showing brightness changes in pixels.

FIGS. 60A, 60B and 60C show gate line voltages supplied to the gate lines Y(n−2), Y(n−1) and Y(n), respectively. FIGS. 60D, 60E and 60F show voltages supplied to the source lines X(3m−2), X(3m−1) and X(3m), respectively. FIGS. 61A, 61B and 61C show voltages imposed on the pixels G(3m−2,n), G(3m−1,n) and G(3m,n). FIGS. 61D, 61E and 61F show brightness of the pixels G(3m−2,n), G(3m−1,n) and G(3m,n), respectively. When the display panel is driven with a driving frequency of 20 Hz, the average brightness of three neighboring pixels G(3m−2,n), G(3m−1,n) and G(3m,n) in the gate line direction changes with a frequency of 60 Hz, as seen in FIGS. 61D, 61E and 61F. Therefore, the visible flicker and the line-scroll are sufficiently suppressed. Since the panel can be driven with such a low frequency as 20 Hz, the TFT-on time can be made sufficiently long, i.e., 24.4 $\mu$s.

The present invention is not limited to the embodiments described above, but it may be variously modified. The liquid crystal used in the panel is not limited to the antiferroelectric liquid crystal, but other liquid crystals such as ferroelectric or smectic liquid crystal may be used. This invention is applicable not only to simple or active matrix-liquid crystal display panels but to electroluminescent display panels.

The polarities of the holding voltages may be variously selected. For example, it is possible to make the holding voltage polarities of two neighboring scanning electrodes different from each other for a period longer than a half of a time cycle of a selecting period repetition frequency. In this manner, the switching frequency of the holding voltage polarity can be made look like higher than that of the field reversing system. As a result, the display flicker due to switching of the holding voltage polarities can be further reduced, while keeping the effects of averaging brightness of neighboring pixels and imposition of the refreshing pulse.

The hard logic structure of the embodiment described above may be replaced with a program performed in a computer. Voltage VE of the power source circuit and voltage VG of the data electrode driving circuit are not limited to a zero level voltage, but they may be set at other levels independently from each other. The refreshing pulse supplied in the beginning of the holding period may be eliminated while periodically alternating the holding voltage polarities, in case it is possible to supply a voltage that is independent from the image data voltage at the time of polarity switching.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A matrix-display panel comprising:

n row electrodes;

m column electrodes disposed perpendicularly with respect to the n row electrodes;

an electro-optical material disposed between the row electrodes and the column electrodes; and n×m pixels formed at each intersection of the row and column electrodes together with the electro-optical material, the pixels being arranged in a matrix, wherein:

each pixel is divided into a pair of sub pixels;

each sub pixel includes a pixel electrode and a semiconductor switching element having a gate electrode for selectively supplying voltages to the sub pixel electrode; and gate electrodes of switching elements corresponding to a pair of sub pixels located along a row electrode are connected to the row electrode, and gate electrodes of switching elements corresponding to a subsequent pair of sub pixels located along the row electrode are connected to an adjacent row electrode, so that all subpixel pairs are connected to the row electrodes in an alternating manner.

2. A matrix-display device comprising:

the matrix-display panel defined in claim 1;

a row electrode driving circuit for supplying scanning voltages to the row electrodes of the matrix-display panel under an interlaced scanning by jumping one electrode every time the scanning moves one electrode to another electrode, the scanning voltages including a writing voltage that turns on the switching elements for writing image data on the pixels and an eliminating voltage that turns on the switching elements for eliminating the written image data from the pixels; and a column electrode driving circuit for supplying image data to the column electrodes in synchronism with the scanning voltages, the polarities of the image data being alternated between neighboring column electrodes, thereby to display images on the matrix-display panel.

* * * * *